US012746589B2

(12) United States Patent
Duscher et al.

(10) Patent No.: US 12,746,589 B2
(45) Date of Patent: Sep. 29, 2026

(54) METHOD FOR PRODUCING A RECESS USING A BENDING MACHINE, AND BENDING MACHINE CONFIGURED FOR THIS PURPOSE

(71) Applicant: EVOBEND GmbH, Ainring (DE)

(72) Inventors: Nikolaus Franz Duscher, Bergheim bei Salzburg (AT); Emanuel Allerberger, Ainring (DE)

(73) Assignee: EVOBEND GmbH (DE)

( * ) Notice: Subject to any disclaimer, the term of this patent is extended or adjusted under 35 U.S.C. 154(b) by 179 days.

(21) Appl. No.: 18/886,011

(22) Filed: Sep. 16, 2024

(65) Prior Publication Data

US 2025/0100039 A1 Mar. 27, 2025

(30) Foreign Application Priority Data

Sep. 27, 2023 (DE) ..... 10 2023 126 271.8

(51) Int. Cl.
*B21D 5/16* (2006.01)
*B21D 31/00* (2006.01)

(52) U.S. Cl.
CPC ..... *B21D 5/16* (2013.01); *B21D 31/005* (2013.01)

(58) Field of Classification Search
CPC ..... B21D 5/16; B21D 31/005; B21D 5/045; B21D 17/02; B21D 19/08; B21D 5/042
See application file for complete search history.

(56) References Cited

U.S. PATENT DOCUMENTS 4,115,182 A * 9/1978 Wildmoser ..... B29C 65/7841 53/553
4,761,197 A * 8/1988 Christine ..... B29C 66/8322 493/203

(Continued)

FOREIGN PATENT DOCUMENTS

DE 4206417 A1 9/1993
DE 19901797 A1 7/2000

(Continued)

OTHER PUBLICATIONS

Search Report issued in German Application No. 10 2023 126 271.8.

(Continued)

*Primary Examiner* — Khaled Annis
(74) *Attorney, Agent, or Firm* — The Belles Group, P.C.

(57) ABSTRACT

A method for producing a recess in a workpiece made of flat material using a bending machine is disclosed. The bending machine comprises a first clamping jaw, a movable second clamping jaw configured to clamp, together with the first clamping jaw, the workpiece, a first bending unit arranged on the first clamping jaw having a first bending tool, and a second bending unit arranged on the second clamping jaw having a second bending tool. The method comprises clamping the workpiece with the clamping jaws such that a protruding portion of the workpiece protrudes from the clamping jaws, moving one of the two bending tools into a counteraction position such that it rests against the protruding portion at a distance from the clamping jaws, and extending the other bending tool such that it presses against the workpiece so that a recess is formed in the workpiece.

14 Claims, 29 Drawing Sheets

(56) References Cited

U.S. PATENT DOCUMENTS

| | | | | |
|---|---|---|---|---|
| 5,678,392 | A * | 10/1997 | Konno | B29C 66/8122 53/551 |
| 6,427,511 | B1 | 8/2002 | Kutschker et al. | |
| 9,849,494 | B2 * | 12/2017 | Plummer | B21D 7/04 |
| 11,045,855 | B2 * | 6/2021 | Hershberger | B21D 5/16 |
| 11,541,442 | B2 | 1/2023 | Kern | |
| 2003/0033845 | A1 * | 2/2003 | Forlow | B21D 5/04 72/316 |
| 2004/0089043 | A1 * | 5/2004 | Meinig | B21D 19/046 72/86 |
| 2004/0194531 | A1 * | 10/2004 | Klinkhammer | B21D 5/042 72/478 |
| 2007/0068632 | A1 * | 3/2007 | Bertram | B29C 66/8122 156/583.1 |
| 2009/0013748 | A1 | 1/2009 | Franze | |
| 2010/0050729 | A1 * | 3/2010 | Kulkarni | B21D 22/06 72/361 |
| 2015/0298191 | A1 * | 10/2015 | Da Silva Alves | B30B 15/041 72/389.3 |
| 2019/0217362 | A1 * | 7/2019 | Kappes | B21D 19/086 |
| 2020/0122211 | A1 | 4/2020 | Hershberger | |
| 2020/0346265 | A1 * | 11/2020 | Duscher | B21D 5/004 |
| 2021/0039150 | A1 * | 2/2021 | Dal Lago | B21D 5/0218 |
| 2021/0245223 | A1 | 8/2021 | Ruegenberg | |
| 2024/0238860 | A1 * | 7/2024 | Duscher | B21D 43/145 |
| 2025/0100038 | A1 * | 3/2025 | Duscher | B21D 5/04 |
| 2025/0100039 | A1 * | 3/2025 | Duscher | B21D 31/005 |
| 2025/0242399 | A1 * | 7/2025 | Speziali | B21D 5/04 |
| 2026/0077398 | A1 * | 3/2026 | Duscher | B21D 5/04 |

FOREIGN PATENT DOCUMENTS

| | | | |
|---|---|---|---|
| DE | 69707894 | T2 | 4/2002 |
| DE | 202020002598 | U1 | 7/2020 |
| DE | 102019008118 | A1 | 5/2021 |
| DE | 102022003799 | B3 | 3/2024 |
| EP | 2014381 | A2 | 1/2009 |
| EP | 3403738 | A1 | 11/2018 |
| EP | 3778048 | A1 | 2/2021 |
| WO | 9732677 | A1 | 9/1997 |
| WO | 2017051441 | A2 | 3/2017 |
| WO | 2020002466 | A1 | 1/2020 |

OTHER PUBLICATIONS

Search Report issued on Jan. 29, 2025 in European Application No. 24198552.2.

* cited by examiner

METHOD FOR PRODUCING A RECESS USING A BENDING MACHINE, AND BENDING MACHINE CONFIGURED FOR THIS PURPOSE

CROSS-REFERENCE TO RELATED APPLICATION

This patent application claims priority from German patent application no. 10 2023 126 271.8 filed on Sep. 27, 2023, the entire disclosure of which is incorporated herein by reference.

TECHNICAL FIELD

The invention relates to a method for producing a recess, in particular a bead or reverse bend, in a workpiece made of flat material, in particular sheet metal, using a bending machine, and to a bending machine configured for this purpose.

BACKGROUND

Bending machines, such as swivel bending machines, into which flat material can be clamped and provided with straight bending points or folds, are sometimes used to bend flat material, i.e. flat material such as sheet metal. Multiple folds can be produced on the flat material by repeatedly advancing and bending it such that different bend geometries can be produced depending on the amount of advance and the direction of bending. Typically, a flat material to be formed is clamped by opposing clamping jaws and bent about a bending edge by a bending tool that is movable relative to the clamping jaws. After the bending process, the bending tool can be moved back and the clamping jaws temporarily opened so that the flat material, now provided with a fold, can be shifted to another bending point for another bending process.

A bending machine for bending sheet metal comprising two bending tools arranged on opposing clamping jaws so that double bending is possible is generally known from the prior art. The sheet metal to be formed can thus be bent in opposite directions by moving one of the bending tools at a time. Such movement of the bending tool can be achieved by swiveling or displacing, especially with linear movements that are inclined to each other. When the bending tool swivels, the bending machine is also referred to as a swivel bending machine.

When forming sheet metal into a desired sheet metal profile, it may be necessary to provide one edge of a sheet with one or more folds, which are generally referred to as seam or folding. Folds are produced by bending a portion of sheet metal relative to the remaining portion of sheet metal. The seam may be formed, for example, as a U bend, standing seam, profile leg or a combination thereof. A fold with a bending angle of approximately 90° is referred to as a standing seam or forms a standing seam with the correspondingly bent workpiece portion. A fold with a bending angle of approximately 180° is referred to as a U bend or completely closed fold. A seam with a U bend can be referred to as a closed seam. An example of a profile leg is a combination of a U bend and a standing seam, wherein the U bend is bent into a standing seam with another fold. A combination may include two standing seams, for example, so that a U-shaped seam is formed. The respective bending angles may be chosen freely and are by no means limited to the 90° or 180° bending angles mentioned for explanatory purposes. For example, a combination may form a V-shaped, W-shaped, Z-shaped or any other seam with any bending angle.

Conventional bending machines, especially swivel bending machines, reach their limits when producing a seam having a bending angle of more than 90°. The only known bending machines are those able to produce the seam with a bending angle of slightly more than 90° using the bending tool and then use one of the clamping jaws to bend the seam further, i.e. to close it or close it completely. Closing the seam using the clamping jaws has the disadvantage that it is not very precise and that is also involves a risk of causing damage to the sheet metal. Furthermore, the area of the clamping jaw must be free of any structures of a seam already bent, e.g. profile legs already bent, since they would otherwise be compressed by the clamping jaw together with the part of the seam to be bent further.

Alternatively or additionally, it may further be necessary to change the angle of a seam, in particular an upright profile leg, on one edge of a sheet in relation to an adjacent portion. Such further deformations are not known in conventional bending machines, in particular swivel bending machines.

When machining sheet metal, in particular in addition to the bending operations, it may further be necessary to form a recess such as a bead or reverse bend. Conventional bending machines, in particular swivel bending machines, cannot perform such a machining step without changing the tool.

DE 20 2020 002 598 U1 discloses a bending machine for bending a workpiece made of flat material such as sheet metal. The bending machine comprises a first clamping jaw, a second clamping jaw that is mounted movably relative to the first clamping jaw and can clamp, together with the first clamping jaw, a portion of the workpiece in a clamping plane, and a bending unit that is arranged on the first clamping jaw and has a bending tool for bending a portion of the workpiece by displacing it.

This bending machine can be used to produce standing seams as well as U bends. The production of U bends is known in a pinch bending operating mode in which a pre-bending point is further compressed through a kind of pinching movement between the bending tool and the clamping jaw to form a U bend at a main bending point. This method for producing a seam thus uses the clamping jaw to close a seam to form a U bend.

Based on the prior art, the invention is based on the object of providing a method for a bending machine as well as a dedicated bending machine, both configured to provide efficient and reliable bending processes.

This object is achieved with a device and a method as described herein and defined in the claims.

DESCRIPTION OF THE INVENTION

A method for producing a seam, in particular a closed seam, on a workpiece made of flat material, in particular of sheet metal, according to a first aspect, with a bending machine comprising a first clamping jaw, a second clamping jaw that is mounted movably relative to the first clamping jaw and configured to clamp, together with the first clamping jaw, a workpiece to be provided with a seam, and a bending unit that is arranged on one of the clamping jaws, in particular on the first clamping jaw, and has a bending tool, wherein the bending unit is configured to bend a portion of the workpiece by moving the bending tool relative to the associated clamping jaw, in particular relative to the first clamping jaw, to form a fold, comprises producing a pre-seam on the workpiece, comprising forming a first fold, and closing the pre-seam into a seam by closing the first fold with the bending unit in a state in which the other of the clamping jaws, in particular the second clamping jaw, is spaced from the seam.

A bending machine for producing a seam, in particular a closed seam, on a workpiece made of flat material, in particular of sheet metal, according to the first aspect comprises a first clamping jaw, a second clamping jaw that is mounted movably relative to the first clamping jaw and configured to clamp, together with the first clamping jaw, a workpiece to be provided with a seam, a bending unit that is arranged on one of the clamping jaws, in particular on the first clamping jaw, and has a bending tool, wherein the bending unit is configured to bend a portion of the workpiece by moving the bending tool relative to the associated clamping jaw, in particular the first clamping jaw, to form a fold, and a control unit that is configured to perform the method for producing a seam, in particular a closed seam.

The method and the bending machine make it possible to form the seam on the workpiece in an efficient and reliable manner. In other words, the first aspect may in particular also be based on the object of forming a seam in an efficient and reliable manner. Since the bending tool is used to close the pre-seam, the bending process can be carried out with accuracy and precision. Thus, a high degree of bending quality is achieved. The method according to the invention is of particular advantage when further folds have already been formed on the workpiece to form a profile leg and the pre-seam can only be closed afterwards. This, for example, involves the risk of unintentional deformation or damage to the workpiece when a clamping jaw is used to close the pre-seam. In particular, the typically relatively large flat surface of the clamping jaw is unsuitable for precise bending and may unintentionally deform, in particular crush, folds already produced and forming a profile leg, for example, when the pre-seam is closed. Such profile legs, which are already produced when a seam is closed, may be present, for example, when a sheet of metal with a drip edge for eaves is produced.

According to a second aspect, a method for producing a seam, in particular an inclined seam, on a workpiece made of flat material, in particular of sheet metal, with a bending machine, wherein the bending machine comprises a first clamping jaw, a second clamping jaw that is mounted movably relative to the first clamping jaw and configured to clamp, together with the first clamping jaw, a workpiece to be provided with a seam in a clamping plane, and a bending unit that is arranged on one of the clamping jaws, in particular on the first clamping jaw, and has a bending tool, wherein the bending unit is configured to bend a portion of the workpiece by moving, in particular by displacing or swiveling, the bending tool relative to the associated clamping jaw, in particular relative to the first clamping jaw, to form a fold, comprises producing a pre-seam on the workpiece such that it is located in an area in front of the clamping jaws, comprising forming a fold, wherein the pre-seam extends at an angle relative to the clamping plane, and changing the angle by displacing the bending tool.

A bending machine for producing a seam on a workpiece made of flat material, in particular of sheet metal, according to the second aspect comprises a first clamping jaw, a second clamping jaw that is mounted movably relative to the first clamping jaw and configured to clamp, together with the first clamping jaw, a workpiece to be provided with a seam in a clamping plane, the bending unit that is arranged on one of the clamping jaws, in particular on the first clamping jaw, and has a bending tool, wherein the first bending unit is configured to bend a portion of the workpiece by moving, in particular by displacing or swiveling, the bending tool relative to the associated clamping jaw, in particular relative to the first clamping jaw, to form a fold, and a control unit that is configured to perform the method for producing a seam.

The method and the bending machine allow for reliable and precise adjustment of a seam's geometry. In other words, the second aspect may in particular also be based on the object of a reliable and precise adjustment of a seam's inclination or direction of extension. In particular, the angle at which the seam extends can be changed in an efficient and reliable manner. The method according to the invention is of particular advantage when the seam is formed as a profile leg. In this case, the profile leg, whose direction of extension is defined by its leg, can be provided with a predetermined angle in a particularly efficient manner after having been bent.

According to a third aspect, a method for producing a recess, in particular a reverse bend or bead, in a workpiece made of flat material, in particular of sheet metal, with a bending machine, wherein the bending machine comprises a first clamping jaw, a second clamping jaw that is mounted movably relative to the first clamping jaw and configured to clamp, together with the first clamping jaw, a workpiece to be provided with a recess, a first bending unit that is arranged on the first clamping jaw and has a first bending tool, wherein the first bending unit is configured to bend a portion of the workpiece by moving the bending tool relative to the first clamping jaw, and a second bending unit that is arranged on the second clamping jaw and has a second bending tool, wherein the second bending unit is configured to bend a portion of the workpiece by moving the second bending tool relative to the second clamping jaw, comprises clamping the workpiece with the first clamping jaw and the second clamping jaw such that a protruding portion of the workpiece protrudes from the clamping jaws, and moving one of the two bending tools into a counteraction position such that it rests against the protruding portion of the workpiece at a distance from the clamping jaws, and extending the other bending tool such that it presses against the workpiece so that the recess is formed in the workpiece.

A bending machine for producing a recess, in particular a reverse bend or bead, in a workpiece made of flat material, in particular of sheet metal, according to the third aspect comprises a first clamping jaw, a second clamping jaw that is mounted movably relative to the first clamping jaw and configured to clamp, together with the first clamping jaw, a workpiece to be provided with a recess, a first bending unit that is arranged on the first clamping jaw and has a first bending tool, wherein the first bending unit is configured to bend a portion of the workpiece by moving the bending tool relative to the first clamping jaw, a second bending unit that is arranged on the second clamping jaw and has a second bending tool, wherein the second bending unit is configured to bend a portion of the workpiece by moving the second bending tool relative to the second clamping jaw, and a control unit that is configured to perform the method for producing a recess.

The method and the bending machine allow for reliable and precise production of a recess. In other words, the third aspect may in particular also be based on the object of producing a recess in an efficient and reliable manner. A recess in a sheet metal is usually produced using deep-drawing tools or embossing tools. Since this involves no tool change, sheet metal machining can be particularly efficient.

This means that complex structures can be produced efficiently. In addition, it is easy to realize a wide variety of movement paths.

It is understood that the aforementioned aspects can be realized independently of one another. In some embodiments, two or three aspects may be combined. In particular, a method may, for example, comprise any two of or all three aspects. Alternatively or additionally, a bending machine may comprise the features of any two of or all three aspects. The features of the first aspect may be partially or completely combined with the features of the second aspect, in particular with respect to the method and/or with respect to the bending machine. The features of the first aspect may be partially or completely combined with the features of the third aspect, in particular with respect to the method and/or with respect to the bending machine. The features of the second aspect may be partially or completely combined with the features of the third aspect, in particular with respect to the method and/or with respect to the bending machine. The features of the first aspect, the second aspect and the third aspect may be partially or completely combined with each other, in particular with respect to the method and/or with respect to the bending machine.

A seam may be a portion of the workpiece bent once or several times. A fold may be a bending point between a bent portion and a remaining portion of the workpiece. In particular, a seam has at least one fold. In particular, a fold has an angle or bending angle indicating an extent of a bend with respect to a remaining portion of the workpiece. A seam may be formed as a standing seam. A standing seam may have a fold with a 90° bending angle. A fold may be a completely closed fold or a U bend. A completely closed fold or a U bend may have a fold with an approximately 180° bending angle. A seam with a U bend may be a closed seam. A pre-seam is in particular a seam having one or more folds with any bending angle, which is configured, for example, for further machining by changing one of the bending angles. A pre-seam may have a fold with a bending angle of at least 10°, 20°, 30°, 40°, 50°, 60°, 70°, 80°, 90°, 100°, 110°, 120°, 130°, 140°, 150°, 160° or 170°. A pre-seam may be formed as a standing seam. A fold can be produced by folding a portion of the workpiece. A fold can be produced by folding with the bending machine's bending tool. A pre-seam can be produced by moving, in particular by displacing or swiveling, the bending tool relative to the first clamping jaw. Closing the pre-seam may involve increasing a fold's bending angle. A closed seam may be a partially closed pre-seam with a partially closed fold with a bending angle of more than 135°. A closed seam may be a partially closed pre-seam with a partially closed fold with a bending angle of more than 140°, 150° 160° or 170°. A pre-seam may have a fold with a bending angle of more than 90°. A pre-seam may have a fold with a bending angle of less than 90°.

A workpiece may be a flat workpiece. It may be a workpiece made of flat material. The workpiece may be a sheet of metal, for example. The workpiece may be made of metal, for example, and/or it may be a metallic workpiece. Alternatively, the workpiece may be a workpiece made of plastic. The workpiece may also comprise a composite material, for example. In general, however, the workpiece may be made of any material suitable for the purpose. The workpiece may have a non-uniform profile.

A state in which the second clamping jaw is spaced from the seam is, in particular, a state in which the second clamping jaw is not in contact with the seam. A state in which the second clamping jaw is spaced from the seam may be a state in which there is a distance of at least 1 cm, at least 2 cm, at least 3 cm or at least 4 cm between the second clamping jaw and the seam.

Resting against the workpiece in the counteraction position may mean that the bending tool can absorb at least such an amount of force from a portion of the workpiece that this portion will not move during a machining process performed by the bending machine.

The recess may be a bead or reverse bend, for example. The recess may, in particular, be an elongated recess. The recess may be a groove-shaped recess. The recess may be configured to have a stiffening effect on the workpiece.

Clamping the workpiece may mean that the workpiece is firmly fixed. The tool may be clamped in such a way that a workpiece remains fixed during a bending process of the bending machine. The clamping plane may be arranged perpendicular to a vertical axis of the bending machine. The clamping plane may, for example, extend through a center of gravity of a clamped portion and/or be parallel to a main plane of extension of the same. In general, however, it is also possible to arrange the clamping plane parallel or at any angle to the vertical axis.

The bending machine may comprise a table on which the workpiece can be placed. In a clamped state of the workpiece and/or before the workpiece is clamped, a clamped portion or a portion to be clamped of the workpiece may rest on the table at least partially. The table may be part of a holding unit that also comprises a holding member that can be used to hold the workpiece independently of the clamping jaws. The holding unit to be controlled. Optionally, the table is immovably connected to a machine frame of the bending machine or can be displaced relative to the machine frame. The bending machine may have the drive for the table, which makes it possible, for example, to extend and/or raise or lower the table. According to the invention, it is conceivable that the first clamping jaw and the second clamping jaw are movable relative to the table, in particular in a positive or negative vertical direction parallel to the vertical axis of the bending machine.

The control unit may further be configured to control the bending unit and, if applicable, the further bending units as well as the clamping jaws to move the bending tool or bending tools as well as the clamping jaws. The control unit may further be configured and programed for use as a central control unit in the bending machine according to the invention.

The first clamping jaw and/or the second clamping jaw may be configured to define, by counteraction, at least one bending axis about which the workpiece can be bent with the bending unit and/or the further bending unit. If several bending axes are provided, they may be spaced apart in a direction perpendicular to the clamping plane.

The first clamping jaw and the second clamping jaw may be an upper clamping jaw and a lower clamping jaw, respectively. Alternatively, the first clamping jaw and the second clamping jaw may be a lower clamping jaw and an upper clamping jaw, respectively. The same applies to the bending units.

The first and/or second clamping jaw may have a clamping surface that rests against the workpiece when the workpiece is clamped. The clamping surface may be parallel to the clamping plane, at least when the workpiece is clamped. The workpiece can be clamped reliably if the first clamping jaw and the second clamping jaw each have a clamping surface, wherein the clamping surfaces of the clamping jaws are arranged opposite each other. This allows the workpiece to be held by the clamping jaws from above and from below.

At least one of the clamping jaws may be configured as a beveled plate, with the bevel forming one of the clamping surfaces. A longitudinal axis of the clamping jaw preferably extends substantially parallel to the first bending axis. The first bending axis preferably extends parallel to the ground and/or perpendicular to the vertical axis of the bending machine. The first bending axis is preferably parallel to a longitudinal axis of the bending machine. In addition, a transverse axis of the bending machine is preferably arranged perpendicular to the longitudinal axis and perpendicular to the vertical axis of the bending machine. Preferably, portions of the clamping jaws comprising at least the clamping surfaces are arranged mirror-symmetrically to one another with respect to the clamping plane.

The bending unit and/or the further bending unit may be configured to extend and retract the respective bending tool relative to the associated clamping jaw. The bending unit and/or the further bending unit may have a linear guide to linearly guide the respective bending tool for displacement in an advance plane. This allows precise maneuverability to be defined in a simple manner, with the bending machine's design allowing multiple paths of movement. The linear guide of the bending unit may define a guide axis that extends parallel to the advance plane and, in particular, lies in the advance plane. Preferably, the bending unit has multiple linear guides that are arranged at different positions along the longitudinal axis, in particular at equal distances. The guide axes of the linear guides are preferably parallel to each other.

Alternatively or additionally, the bending unit and/or the further bending unit may have a swivel mechanism to extend and retract the respective bending tool relative to the associated clamping jaw.

The bending machine may comprise a machine frame configured for installation on a surface such as a hall floor. In a regular installation state of the bending machine, the machine frame is installed on a level surface whose surface normal defines a vertical axis of the bending machine.

In addition, the bending machine may comprise a positioning unit to shift the workpiece in and/or perpendicular to the clamping plane, for example when the workpiece is deposited on the table. The control unit may be configured to control the positioning unit to cause the workpiece to advance relative to the clamping jaws. The positioning unit may be formed by the holding unit. The positioning unit may comprise a suitable drive and/or suitable stops, grippers, slides, rollers or the like to exert a positioning force and/or movement on the workpiece. It is also conceivable that at least one of the clamping jaws is movable parallel or at any angle to the clamping plane so that, for example, the workpiece is movable by coordinated movements of the clamping jaws.

A surface of at least one of the clamping jaws facing away from the clamping plane and/or the clamped portion of the workpiece preferably extends at an angle relative to the clamping plane and, together with the clamping plane, encloses, for example, an angle of less than 90°, preferably no more than 45°, preferably no more than 30° and particularly preferably no more than 45°. This surface is advantageously flat. The respective other clamping jaw may also have a surface that is mirror-symmetrical to this surface with respect to the clamping plane. In this case, the clamping jaws are preferably disposed in a V arrangement, wherein the clamping plane may define an angle bisector. When the workpiece is clamped, the clamped portion is arranged within a clamping area defined by the clamping jaws, which may include, for example, the table. The workpiece may protrude from the clamping area between the clamping jaws, for example between their clamping surfaces, wherein a protruding portion of the workpiece then forms a portion to be machined, in particular a portion to be bent.

The bending tool may have an extension along the longitudinal axis of the bending machine that substantially corresponds to an extension of the corresponding clamping jaw along the longitudinal axis. Uniform bending may be achieved, for example, if the bending tool is configured to apply a bending force to the workpiece over its entire length along the respective bending axis. This allows a bending point to be created along the respective bending axis when the workpiece is bent. The bending tool may be configured to apply a bending force to the workpiece when the bending tool is retracted and/or extended relative to the corresponding clamping jaw.

Preferably, the bending units are substantially identical in construction. It is also possible to use bending units that are not identical in construction. The bending unit arranged on the first clamping jaw may be configured to bend a portion toward the second clamping jaw and/or the bending unit arranged on the second clamping jaw may be configured to bend the portion toward the first clamping jaw.

According to another embodiment, the bending unit comprises at least one bending tool drive configured to move the bending tool in an advance plane. Preferably, the bending tool drive is a linear drive. The bending tool drive may also be a lever drive. However, a hydraulic drive or any other drive could be considered. The bending tool drive may, for example, comprise a linear drive with a roller screw drive, a linear drive with a drive cylinder, an electromagnetic linear motor or the like and/or be configured as such. In addition, the bending tool drive may comprise multiple linear drives arranged in series or parallel. Alternatively, the bending tool drive may comprise a rotary drive, such as an electric motor, as well as suitable elements, such as levers, crankshafts or the like, for converting rotary motion into linear motion. Preferably, the bending tool drive comprises at least one ball screw drive. Particularly preferably, the bending unit comprises multiple bending tool drives that may, in particular, be arranged at equal distances in a direction parallel to the first bending axis. A number of bending tool linear guides and a number of bending tool drives may be identical or differ from one another.

The advance plane may intersect or be parallel to the clamping plane. If the advance plane and the clamping plane intersect, their line of intersection is preferably parallel to or coincides with the first bending axis. During bending, the advance plane may move in translation relative to the clamping plane and/or relative to the first bending axis. This makes it possible to precisely move along a movement path of the bending tool.

Great leeway with regard to realizable movement paths of the bending tool may be achieved in particular if the bending unit and/or the further bending unit comprise a base member that is movably mounted on the first clamping jaw or the second clamping jaw and on which the bending tool is mounted so as to be linearly movable, in particular slidable. The base member may have opposing sites that enclose an angle of less than 90° but more than 0°. An upper side of the base member facing away from the corresponding clamping jaw may be inclined relative to the clamping jaw. For example, the base member has a triangular and/or three-sided cross section. In particular because of its triangular cross section, the base member may incline the bending tool and/or the advance plane of the bending tool relative to the clamping jaw associated with the bending unit. For example, in a region of the first bending axis, the bending tool may thus be advanced at an angle of at least 45° and advantageously at least 60°, for example when the base member has moved into a front region, e.g. a region of the clamping surface, of the clamping jaw associated with the bending unit and the bending tool is displaced in its advance plane. Preferably, a longitudinal axis of the base member is substantially parallel to the first bending axis. The bending tool may be linearly guided on a side of the base member facing away from the corresponding clamping jaw. This side of the base member is preferably substantially flat and/or parallel to the advance plane of the bending tool. Furthermore, a side of the base member opposite this side may be arranged movably on the surface of the corresponding clamping jaw facing away from the clamping plane and/or the clamped portion of the workpiece and/or parallel to this surface.

The bending unit and/or the further bending unit may have at least one linear guide to linearly guide the base member for displacement in an advance plane. This helps to implement a wide range of possible movement paths, with the rigidity of moving components being largely independent of the corresponding movement path, meaning that there is no need for complex corrections. For bending, the bending tool is movable in its advance plane as well as in the advance plane of the base member. A movement of the bending tool may be a superimposed movement in the advance plane of the bending tool and in the advance plane of the base member, with the base member preferably moving relative to the corresponding clamping jaw and the bending tool moving relative to the base member. The base member is preferably configured such that the linear guide of the bending tool and the linear guide of the base member enclose an angle ranging between 0° and 90°, this angle preferably corresponding to the angle between the advance planes and/or the angle between the opposing surfaces of the base member. This angle may, for example, be at least 10° and advantageously no more than 20° and/or no more than 70° and advantageously no more than 50°. For example, an angle of 25° or 30° is possible.

According to one embodiment of the invention, the bending tool comprises a hook-shaped bending portion having an inner surface and an outer surface. The hook-shaped bending portion of the bending tool may be configured to be hook-shaped when viewed parallel to the first bending axis. The hook-shaped bending portion may have an end portion. The end portion may form a foremost portion of the bending tool. The end portion may be located between the inner surface and the outer surface. The end portion may be located in an area where the inner surface merges into the outer surface. The end portion may have a curved surface. The curved surface may have the shape of a circular arc when viewed parallel to the longitudinal direction. Preferably, the hook-shaped bending portion of the bending tool has a substantially constant and preferably hook-shaped cross section in a direction parallel to the first bending axis. The hook-shaped bending portion of the bending tool may be configured to be pressed against a portion of the workpiece, optionally with its outer surface, when the workpiece is being machined, particularly when the workpiece is being bent. Additionally or alternatively, the hook-shaped bending portion of the bending tool may be configured to be pressed against a portion of the workpiece, optionally with its inner surface such as a hook inner section of the hook-shaped bending portion of the bending tool, when the workpiece is being machined, particularly when the workpiece is being bent. Additionally or alternatively, the hook-shaped bending portion of the bending tool may be configured to be pressed against a portion of the workpiece, optionally with the end portion of the hook-shaped bending portion of the bending tool, when the workpiece is being machined, particularly when the workpiece is being bent. The hook inner section may surround a bending point that has already been partially formed. Preferably, the inner surface of the hook-shaped bending portion of the bending tool faces the clamping area defined by the clamping jaws and/or the outer surface of the hook-shaped bending portion of the bending tool faces away from the clamping area defined by the clamping jaws.

According to one embodiment, the control unit is configured to generate a movement path for the first bending tool by superimposing at least two linear movements. Alternatively or additionally, the control unit may be configured to generate a movement path for the second bending tool by superimposing at least two linear movements. Preferably, the movement path is a curved path that defines a non-linear movement. Particularly preferably, the movement path runs in a plane perpendicular to the first bending axis. The movement path may, for example, be a path of a movement of a specific unchanged but moved point of the corresponding bending tool, such as a foremost point of the hook-shaped bending portion of the corresponding bending tool. Preferably, the control unit is configured to control the drive of the corresponding bending tool and/or the drive of the corresponding base member. The control unit may be configured to generate control signals intended to cause a movement of the corresponding bending tool in its advance plane as well as a movement of the corresponding base member in its advance plane. The control unit may be configured to superimpose the two movements in the advance plane of the corresponding bending tool and the advance plane of the corresponding base member in such a way that different non-linear movement paths can be generated.

It may further be provided that the first clamping jaw and/or the second clamping jaw are movable in a direction perpendicular to the clamping plane. The corresponding clamping jaw may be linearly movable. Alternatively or additionally, the first clamping jaw may be movable relative to the second clamping jaw along a swivel path so that a displacement also takes place perpendicular to the clamping plane. Vertical maneuverability may also be achieved by swiveling the first clamping jaw away from the second clamping jaw or vice versa.

According to one embodiment, the control unit is configured to control the clamping jaws in a pre-bending operating mode such that they define a bending axis and to control the bending unit such that the workpiece is bent about the bending axis, thereby enabling a pre-bending point to be produced. The control unit may be configured to cause the workpiece to be bent at the pre-bending point at an angle of more than 90°. The bending axis may be defined by the fact that the two clamping jaws clamp the workpiece.

Alternatively or additionally, the control unit may be configured to control the clamping jaws in an inclined operating mode such that they define the bending axis and to control the second bending unit such that the workpiece is bent about the bending axis, thereby enabling an inclined bending point to be produced. The control unit may be configured to cause the workpiece to be bent at the inclined bending point at an angle of substantially 90°. In general, however, any angle is possible for an inclined bending point. It may, in particular, be selected depending on the desired target geometry.

The control unit may further be configured to cause the workpiece to advance parallel to the clamping plane after the pre-bending operating mode and before the inclined operating mode so that a portion of the workpiece that includes the pre-bending point can be bent in the inclined operating mode. The advance of the workpiece may define a length of a portion of the workpiece between the pre-bending point and the inclined bending point.

The bending machine may, in particular, be used to form bending points in an already advanced portion of a workpiece if the control unit is configured to control the clamping jaws in a pinch bending operating mode such that they define a further bending axis and to control the bending unit such that the workpiece is bent about the further bending axis, thereby enabling a main bending point to be produced. The pinch bending operating mode could also be referred to as seam bending operating mode or standing seam bending mode. In particular, a standing seam is closed in the pinch bending operating mode. In the pinch bending operating mode, the workpiece may be compressed between the first bending tool of the first bending unit and the counteracting first clamping jaw to perform, for example, a pinch movement. The control unit may be configured to control the clamping jaws and the bending unit in such a way that the main bending point can be formed from the pre-bending point in the pinch bending operating mode. The counteraction of the first clamping jaw may take place near the pre-bending point so that the second bending axis extends through the pre-bending point. In the pinch bending operating mode, the first clamping jaw may be spaced from the second clamping jaw and from the clamping plane.

According to one embodiment, the control unit is configured to receive a target profile specified by a user for a workpiece to be machined and to determine a suggested bending sequence on the basis of the target profile. The control unit may further be configured to perform a bending simulation. The bending simulation may take into account workpiece properties that define, for example, a degree of overbending or other bending parameters. A high degree of ease of use may be achieved in particular if the bending machine further comprises a user interface configured to allow input of the target profile and/or to display a result of the bending simulation.

In general, it should be noted that a bending point, for example, for producing a pre-seam or a standing seam, may be produced anywhere on the workpiece or at any point in the bending process. The control unit may thus be configured to provide or incorporate individual or all of the described methods for production at any point in a bending program. In addition, the control unit in combination with the user interface may be configured to allow the user to provide for the pre-seam, the seam, the closed seam, the standing seam, the inclined seam, the recess, the bead, the reverse bend or the like to be bent at any point in a bending program.

The bending machine may be a sheet metal bending machine, in particular a long folding machine. The bending machine may be particularly suitable for machining flat workpieces. The bending machine may basically be configured as a single bending machine or a double bending machine. The bending machine may comprise one bending unit or two bending units or only a first bending unit on a first clamping jaw or a first bending unit on a first clamping jaw and a second bending unit on a second clamping jaw. In the case of a single bending machine, the control unit may be configured to perform all bending deformations with the single bending unit.

In the method for producing a seam, in particular a closed seam, according to the first aspect, the step of closing the pre-seam may be performed in a state in which the first clamping jaw or the second clamping jaw is spaced from the workpiece. A distance not only to the seam but from the entire workpiece gives even greater freedom with regard to the workpiece profile before a seam is applied. The distance may be a distance parallel to a surface normal of the workpiece and/or its main plane of extension. The distance may be at least 5 mm, at least 10 mm, at least 15 mm or at least 20 mm.

The step of closing the pre-seam may be performed in particular in a state in which the workpiece rests on the first or second clamping jaw. Placing the workpiece on the first or second clamping jaw during closing supports the precise production of the seam. In particular, the workpiece rests on the clamping jaw on which the bending unit for closing the pre-seam is arranged. The workpiece may rest on the first clamping jaw or the second clamping jaw due to its weight. In addition, the workpiece may be held by the holding unit in such a way that it rests on the first clamping jaw. In particular, the workpiece rests on one of the clamping jaws without touching the other one of the clamping jaws.

The step of closing the pre-seam may be performed when the workpiece is not clamped, especially when the workpiece is not clamped between the clamping jaws. The state in which the workpiece is not clamped may be a state in which the workpiece is only fixed in one direction or in two directions. The non-clamped state may also be a state in which the workpiece is not fixed. Machining of the workpiece becomes more efficient when clamping is omitted.

In the step of producing the pre-seam, the first fold may be formed by the bending machine, in particular by moving the bending tool relative to the first or second clamping jaw. The step of producing the pre-seam on the workpiece may be performed by the bending machine, in particular by displacing or swiveling the bending tool relative to the first or second clamping jaw. In particular, the step of producing the pre-seam on the workpiece may be performed by pressing with the outer side of the hook-shaped bending portion of the bending tool and/or with the end portion of the hook-shaped bending portion of the bending tool. Alternatively or additionally, the step of producing the pre-seam on the workpiece may be performed by pressing with the inner side of the hook-shaped bending portion of the bending tool and/or with the end portion of the hook-shaped bending portion of the bending tool. Pressing may be performed by extending and/or retracting the bending tool relative to the associated clamping jaw. The retraction and extension may be achieved with linear displacement of the bending tool relative to the associated base member and/or with linear displacement of the associated base member together with the bending tool relative to the associated clamping jaw. The retraction and extension may be achieved by swiveling the bending tool relative to the associated clamping jaw. Depending on the shape of the hook-shaped bending portion and/or the shape of the base member, it is advantageous to produce the pre-seam on the workpiece by retracting or extending the bending tool and simultaneously pressing with a specific portion or a specific flat surface of the hook-shaped bending portion. The pre-seam produced may be a profile leg.

Producing a pre-seam on the workpiece may comprise forming multiple folds, in particular with the bending machine. In the step of producing the pre-seam, one or more of the folds may be formed by bending with the further bending tool. Producing the pre-seam may further comprise forming a second fold as a standing seam, the second fold being different from the first fold. Producing the pre-seam may further comprise forming a third fold as a U bend, the third fold being different from the first fold and preferably from the second fold.

The method may further comprise producing a standing seam, including, in particular, a U bend, by bending a portion of the workpiece about a second fold which is different from the first fold, wherein, when producing the pre-seam, the standing seam is bent about the first fold relative to a clamped portion of the workpiece, and wherein, when closing the pre-seam, the standing seam projects from the associated clamping jaw toward the spaced clamping jaws.

After the step of producing the pre-seam, the method may further comprise moving the first clamping jaw or the second clamping jaw away from the workpiece. By moving the relevant clamping jaw away, the bending tool has a high degree of freedom of movement when closing the pre-seam.

The step of closing the pre-seam may be performed by pressing the pre-seam with the bending tool. In particular, the step of closing the pre-seam may be carried out by pressing the pre-seam with the end portion of the hook-shaped bending portion and/or with the inner surface of the hook-shaped bending portion and/or with the outer surface of the hook-shaped bending portion. Closing the pre-seam in this way may be performed extremely precisely. In the step of closing the pre-seam, the first fold may be closed by extending and/or retracting the bending tool relative to the associated clamping jaw. Preferably, the step of closing the pre-seam may be performed by pressing the pre-seam with the end portion of the hook-shaped bending portion and with the inner surface of the hook-shaped bending portion as the bending tool retracts relative to the associated clamping jaw. In particular, the step of closing the pre-seam may comprise closing the first fold completely to form a completely closed fold, i.e. a U bend.

The step of closing the pre-seam may be performed in particular by moving the inner surface of the hook-shaped bending portion toward the first clamping jaw or the second clamping jaw. Such movement is particularly suitable for a more efficient and precise production of the seam. In particular, the step of closing the pre-seam may be performed by moving a flat surface of the inner surface that is parallel to a clamping surface of the second clamping jaw or the first clamping jaw. This allows particularly precise production of a U bend.

The control unit of the bending machine may further be configured to perform the method steps described above.

The method for producing a seam according to a second aspect may involve a seam with a leg, in particular a profile leg. The step of changing the angle may be performed by extending the bending tool relative to the associated clamping jaw, in particular relative to the first clamping jaw. This is particularly beneficial for efficient production. In particular, the step of changing the angle may be performed by pressing with the outer surface of the hook-shaped bending portion and/or the end portion of the hook-shaped bending portion as the bending tool extends relative to the associated clamping jaw, in particular relative to the first clamping jaw. By pressing with the outer surface of the hook-shaped bending portion, the seam may be produced not only efficiently but also precisely. Alternatively, the step of changing the angle may be performed by retracting the bending tool relative to the associated clamping jaw, in particular relative to the first clamping jaw. In particular, the step of changing the angle may be performed by pressing with the inner surface of the hook-shaped bending portion and/or with the end portion of the hook-shaped bending portion as the bending tool extends relative to the associated clamping jaw, in particular relative to the first clamping jaw. Depending on which machining step precedes the step of changing the angle or where the bending tools are located, changing the angle by retracting may also result in the bending tools traveling a short distance, making production efficient. The retraction and extension of the bending tool relative to the associated clamping jaw, in particular relative to the first clamping jaw, may be achieved with linear displacement of the bending tool relative to the associated base member, in particular relative to the first base member, and/or with linear displacement of the associated base member, in particular relative to the first base member, together with the bending tool relative to the associated clamping jaw, in particular relative to the first clamping jaw. The retraction and extension of the bending tool relative to the associated clamping jaw, in particular relative to the first clamping jaw, may be achieved by swiveling the bending tool relative to the associated clamping jaw, in particular relative to the first clamping jaw.

Producing the pre-seam on the workpiece may comprise forming multiple folds. In the step of producing the pre-seam, one fold and/or multiple folds may be formed by bending with the further bending tool.

The control unit of the bending machine may further be configured to perform the method steps described above.

In the method for producing a recess, in particular a reverse bend or bead, according to a third aspect, in the step of moving, in particular displacing or swiveling, the one bending tool may rest against a first side of the workpiece and, in the in the step of extending, the other bending tool may be pressed against the workpiece on a second side of the workpiece opposite the first side such that the recess is formed in the workpiece. Such an embodiment may further increase the efficiency of the production of a recess.

In the step of clamping, the workpiece may be clamped in a clamping plane, and in the step of moving, in particular displacing or swiveling, one of the two bending tools may rest against the protruding portion of the workpiece at a distance along the clamping plane. Clamping in the clamping plane allows particularly precise production of a recess.

Preferably, at least the other bending tool may comprise a hook-shaped bending portion having an inner surface and an outer surface and, in the step of extending the other bending tool, press its outer surface against the workpiece on the second side of the workpiece such that the recess is formed in the workpiece. Producing the recess with the outer surface of the hook-shaped bending portion leads to higher precision.

Alternatively or additionally, at least the other bending tool may comprise a hook-shaped bending portion having an inner surface, an outer surface and an end portion therebetween and, in the step of extending the other bending tool, press its end portion against the workpiece on the second side of the workpiece such that the recess is formed in the workpiece.

The extension of the other bending tool may be an extension relative to the associated clamping jaw. The extension of the other bending tool relative to the associated clamping jaw may be achieved with linear displacement of the other bending tool relative to the associated base member and/or with linear displacement of the associated base member together with the other bending tool relative to the associated clamping jaw.

Preferably, the one bending tool may comprise a hook-shaped bending portion having an inner surface and an outer surface and, in the step of displacing, the one bending tool in the counteraction position may rest with its outer surface against the protruding portion of the workpiece on the first side of the workpiece. Such counteraction may also make the production of the recess more precise.

Alternatively or additionally, the one bending tool may comprise the hook-shaped bending portion having an end portion between the inner surface and the outer surface and, in the step of moving, in particular displacing or swiveling, the one bending tool in the counteraction position may rest against the protruding portion of the workpiece on the first side of the workpiece with its end portion. The movement, in particular displacement, may be achieved with linear displacement of the bending tool relative to the associated base member and/or with linear displacement of the associated base member together with the bending tool relative to the associated clamping jaw. The movement, in particular swiveling, may be achieved by swiveling the bending tool relative to the associated clamping jaw.

The control unit of the bending machine according to the invention may further be configured to perform the method steps described above.

The device according to the invention as well as the method according to the invention shall herein not be limited to the application and embodiment described above. In particular, the device according to the invention and/or the method according to the invention may have a number of individual elements, components and units as well as method steps that differs from a number specified herein to implement a functionality described herein. In addition, where ranges of values are specified in this disclosure, values within the specified limits should also be deemed to be disclosed and applicable.

In particular, it is pointed out that all features and properties described with respect to the device as well as procedures can be applied mutatis mutandis to the method according to the invention and are applicable in the sense of the invention and deemed to be disclosed as well. The same applies vice versa. This means that structural features, i.e. features according to the device, mentioned with respect to the method can also be taken into account, claimed as well as deemed to be disclosed within the scope of the device claims.

Below, the present invention is described by way of example with reference to the accompanying figures. The drawing, the specification and the claims contain combinations of numerous features. The skilled person will appropriately consider the features also individually and use them in useful combinations within the scope of the claims.

If there is more than one example of a particular object, only one of them may have a reference sign in the figures and in the specification. The description of this example can be correspondingly applied to the other examples of the object. In particular, when numerical words are used to describe objects, e.g. first, second, third object etc., they are used to name and/or assign objects. Accordingly, for example, there may be a first object and a third object, but no second object. However, numerical words could also be used to derive a number and/or a sequence of objects.

DETAILED DESCRIPTION OF THE INVENTION

Figure 1:
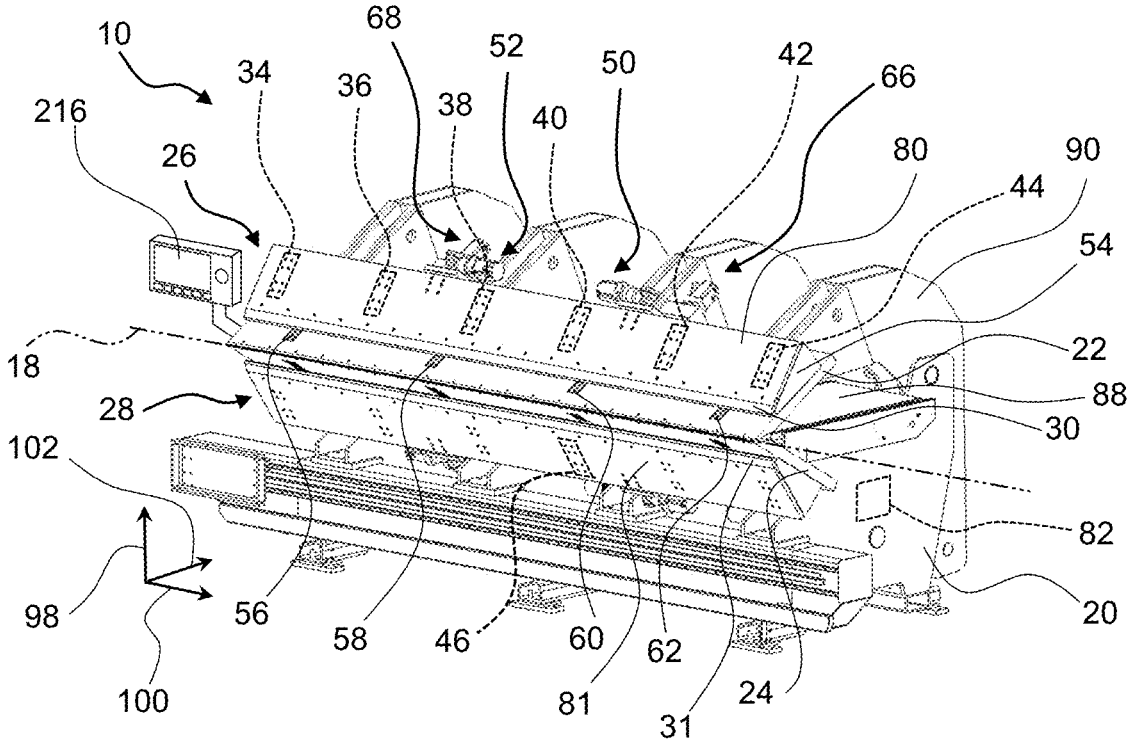
FIG. 1 is a schematic perspective view of a bending machine configured as a double bending machine.
Figure 2:
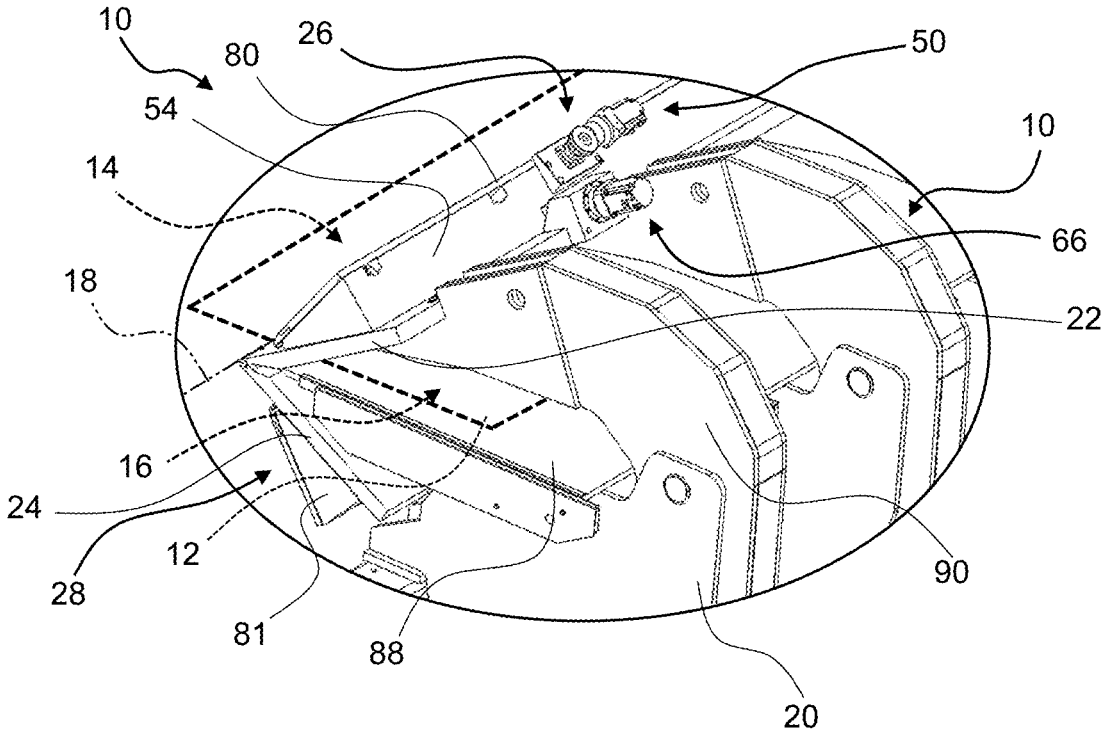
FIG. 2 is a schematic perspective view of a section of a rear side of the bending machine.
Figure 3:
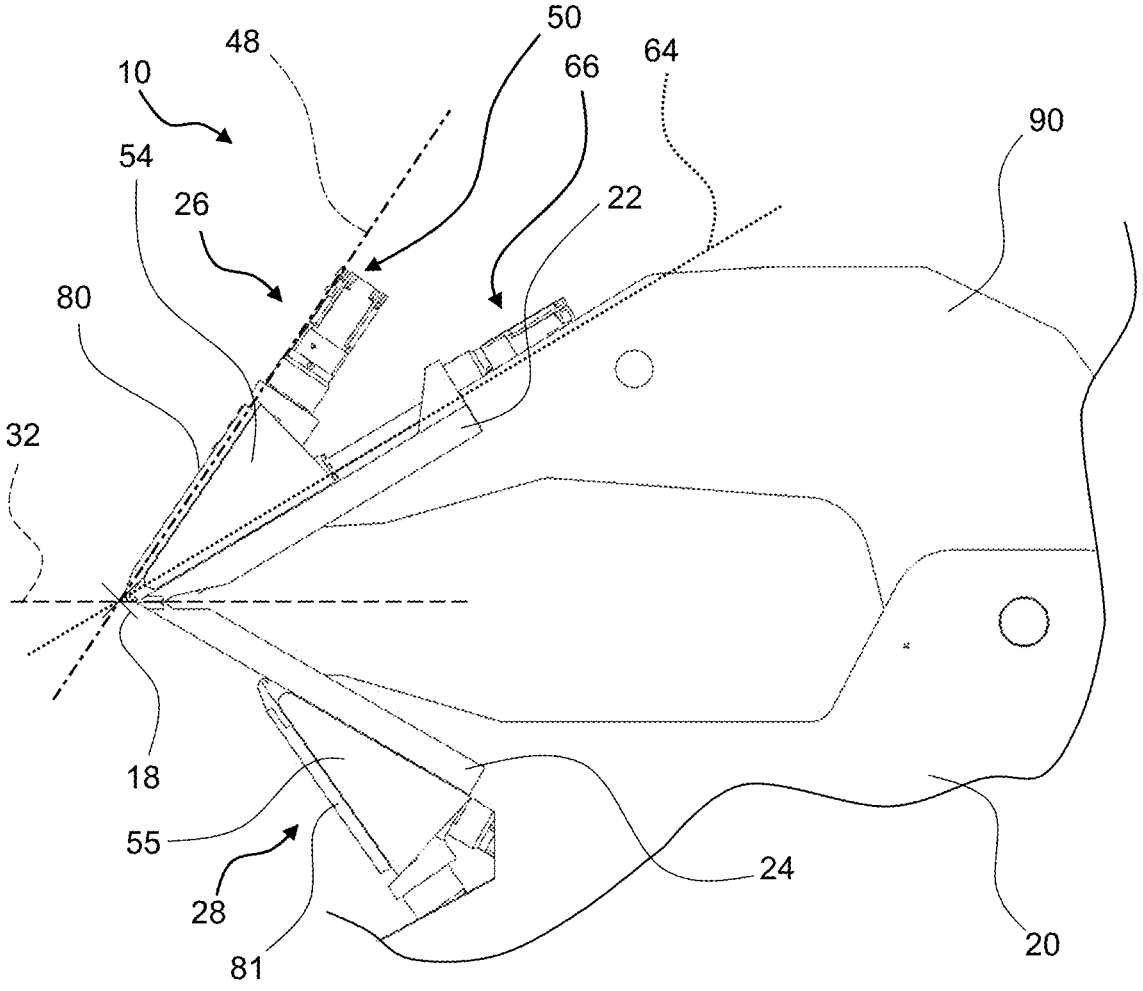
FIG. 3 is a schematic side view of a portion of the bending machine.

FIG. 1 is a perspective view of a bending machine 10, configured as a double bending machine, for performing the method according to the invention. FIG. 2 is a perspective view of a section of a rear side of the bending machine 10. In addition, FIG. 3 is a side view of a section of the bending machine 10. Below, reference may be made to several of these figures at the same time. The bending machine 10 is configured to bend a flat workpiece 12. In the case shown, the flat workpiece 12 is a sheet of metal.

The bending machine 10 comprises a machine frame 20. The bending machine 10 is placed on a level surface with the machine frame 20. A surface normal of the level underground defines a vertical direction 98, a vertical axis of the bending machine 10 that is not shown being parallel to the vertical direction. The bending machine 10 further has a longitudinal axis (not shown) and a transverse axis (not shown) that are parallel to a longitudinal direction 100 and a transverse direction 102, respectively. In the present case, the vertical direction 98, the longitudinal direction 100 and the transverse direction 102 are perpendicular to each other in pairs.

The bending machine 10 further comprises a first clamping jaw 22 and a second clamping jaw 24. In the case shown, the first clamping jaw 22 is an upper clamping jaw while the second clamping jaw 24 is a lower clamping jaw.

The first clamping jaw 22 and the second clamping jaw 24 are configured to clamp the workpiece 12 in a clamping plane 32. The clamping plane 32 is arranged parallel to the level surface or parallel to the horizontal direction 102 and perpendicular to the vertical direction 98. The workpiece 12 is clamped such that it comprises a clamped portion 16 as well as a protruding portion 14 to be machined. The protruding portion 14 and the clamped portion 16 are connected to form one piece and directly adjacent to each other.

The clamping jaws 22, 24 are plate-shaped. In the case shown, the clamping jaws 22, 24 are steel plates. The clamping jaws 22, 24 each have a clamping surface that rests against the workpiece 12 when the latter is clamped. The clamping surfaces are arranged parallel to the clamping plane 32.

The clamping jaws 22, 24 are arranged at an angle of about 60° to each other. The workpiece 12 protrudes from the clamping jaws 22, 24 into a bending area of the bending machine 10 within which the protruding portion 14 of the workpiece 12 can be bent during bending.

The bending machine 10 comprises at least one table 88 on which the workpiece 12 is placed. The table 88 is arranged to be movable, for example. In addition, the table 88 is optionally movable or stationary relative to the machine frame 20. In the case shown, the table 88 can be extended parallel to the clamping plane 32. Furthermore, the table 88 may be movable parallel to the vertical direction 98, for example by at least a few centimeters. In a clamped state, the workpiece 12 is clamped between the clamping jaws 22, 24 and also placed on the table 88 in sections. The bending machine 10 further comprises a positioning unit (not shown) that is configured to move the workpiece 12 parallel to a surface of the table 88. The positioning unit comprises, for example, a plurality of grippers that are capable of grasping the workpiece 12 on a side opposite the protruding portion of the workpiece 12 and movable parallel to the surface of the table 88. Once the workpiece 12 is released from the clamping jaws 22, 24, it can be advanced between the clamping jaws 22, 24 by the positioning unit.

The first clamping jaw 22 is movable relative to the machine frame 20 in a direction perpendicular to the clamping plane 32. The bending machine 10 may have suitable drives for this purpose. The clamping jaws 22, 24 can thus be moved toward and away from each other perpendicular to the clamping plane 32.

In the case shown, the first clamping jaw 22 is secured to a plurality of carriers only one of which has a reference sign. The carriers 90 are pivotally mounted on the machine frame 20. The second clamping jaw 24 is secured to the machine frame 20. By swiveling the carriers 90, the first clamping jaw 22 can be swiveled relative to the second clamping jaw 24, allowing the workpiece 12 to be clamped and released. Moreover, this makes the first clamping jaw 22 movable relative to the second clamping jaw 24 in a direction perpendicular to the clamping plane 32.

The bending machine 10 further comprises a first bending unit 26 disposed on the first clamping jaw 22. The first bending unit 26 comprises a first bending tool 30. The bending machine 10 further comprises a second bending unit 28 disposed on the second clamping jaw 24. The second bending unit 28 comprises a second bending tool 31. The first bending unit 26 and the second bending unit 28 are substantially identical in construction and are arranged in mirror image with respect to the transverse direction 102. The following discussion mainly focuses only on the configuration of the first bending unit 26. However, the description of the first bending unit 26 can be correspondingly applied to the second bending unit 28. In general, however, the bending units 26, 28 may differ in construction.

The first bending unit 26 is configured to bend the protruding portion 14 of the workpiece 12 relative to the clamped portion 16 of the workpiece 12 about a bending axis 18 to form a fold 15. The bending axis 18 is parallel to the longitudinal direction 100. The bending axis 18 defines a connecting area of the clamped portion 16 of the workpiece 12 and the protruding portion 14 of the workpiece 12.

The first bending unit 26 comprises at least one linear guide 34-44 to linearly guide the first bending tool 30 for displacement in an advance plane 48 (see FIG. 1 and FIG. 3). In the case shown, the first bending unit 26 has six linear guides 34-44. The linear guides 34-44 are arranged at equal distances with respect to the longitudinal direction 100.

The second bending unit 28 also has six linear guides 46, only one of which has a reference sign for the sake of clarity.

The first bending unit 26 comprises a first bending tool carrier 80 to which the first bending tool 30 is secured in a replaceable manner. In the case shown, the first bending tool 30 positively rests against and is also screwed to the first bending tool carrier 80. The first bending tool carrier 80 is substantially plate-shaped. A main plane of extension of the first bending tool carrier 80 is parallel to the advance plane 48. The linear guides 34-44 are configured to linearly guide the first bending tool carrier 80. Since the first bending tool 30 is secured to the first bending tool carrier 80, the linear guides 34-44 thus guide the first bending tool 30.

The first bending unit 26 comprises a first base member 54 which is movably mounted on the first clamping jaw 22 and on which the first bending tool 30 is mounted so as to be linearly movable and slidable. The linear guides 34-44 for the first bending tool 30 are integrated in the first base member 54.

The first bending unit 26 comprises a further linear guide 56 to linearly guide the first base member 54 for displacement in a further advance plane 64. The further linear guide 56 guides the first base member 54 parallel to a surface of the first clamping jaw 22. In the case shown, the first bending unit 26 comprises four further linear guides 56-62 for the first base member 54, which are arranged at equal distances along the longitudinal direction 100. The further linear guides 56-62 for the first base member 54 are arranged along the longitudinal direction 100 with an offset from the linear guides 34-44 for the first bending tool 30.

The first base member 54 has a triangular cross section perpendicular to the bending axis 18. The first base member 54 is configured as a member extending in the longitudinal direction 100 and having a triangular cross section. An upper side of the first base member 54 is arranged parallel to the advance plane 48. In addition, a lower side of the first base member 54 is parallel to the further advance plane 64. The upper side and the lower side of the first base member 54 enclose an angle of less than 90°. The further advance plane 64 is in turn parallel to an upper side of the first clamping jaw 22.

The second bending unit 28 comprises a second bending tool carrier 81, a second bending tool 31 and a second base member 55, the description of the first bending unit 26 being correspondingly applicable to the second bending unit 28.

In FIG. 3, the bending machine 10 is shown in a state in which the first bending unit 26 is extended into a region of the bending axis 18 relative to the first clamping jaw 22. Furthermore, in the state shown in FIG. 3, the second bending unit 28 on the second clamping jaw 24 is retracted relative to the second clamping jaw 24, i.e. moved away from the bending axis 18, so that as large a bending area as possible is released in front of the second clamping jaw 24, into which the protruding portion 14 of the workpiece 12 may optionally be bent to form a fold 15.

By displacing the first base member 54 in the further advance plane 64 relative to the first clamping jaw 22 and by displacing the first bending tool 30 in the advance plane 48 relative to the first base member 54, the first bending tool 30 can be moved or displaced along a movement path to bend the workpiece 12. By superimposing the movements in the advance plane 48 and in the further advance plane 64, an overall movement of the first bending tool 30 relative to the clamping plane or relative to the workpiece 12 can be generated, allowing a wide variety of movement paths to be generated. This will be discussed again below.

When the first base member 54 is moved or displaced relative to the first clamping jaw 22, the advance plane 48 is also moved relative to the bending axis 18 along the further advance plane 64. The further advance plane 64, however, is stationary relative to the bending axis 18.

The advance plane 48 intersects the further advance plane 64. A line of intersection between the advance plane 48 and the further advance plane 64 is parallel to the bending axis 18. If the first bending tool 30 and/or the first base member 54 are moved in a suitable manner, the line of intersection may coincide with the bending axis 18. In addition, both the advance plane 48 and the further advance plane 64 intersect the clamping plane 32. If the first bending tool 30 and/or the first base member 54 are moved in a suitable manner, lines of intersection between the clamping plane 32 and the advance plane 48 as well as between the clamping plane 32 and the further advance plane 64 may coincide, for example also with the bending axis 18. The advance plane 48 is inclined at an angle of, for example, 25° relative to the further advance plane 64. This angle corresponds to an angle between the upper side and the lower side of the first base member 54. In addition, the further advance plane 64 is inclined by, for example, 30° relative to the clamping plane 32. This angle corresponds to half an angle between the clamping jaws 22, 24.

The first bending unit 26 comprises a drive 50 for the first bending tool 30, which is configured to move the first bending tool 30 in the advance plane 48. As can be seen in FIG. 1, the bending machine 10 comprises two drives 50, 52 for the first bending tool 30. In the case shown, the drives 50, 52 for the first bending tool 30 are identical in construction, which is why only the drive 50 will be described in more detail. The drive 50 is integrated in the first base member 54. The drive 50 is movable with the first base member 54. The drive 50 is a linear drive. In the case shown, the drives 50, 52 for the first bending tool 30 are arranged with an offset from the linear guides 34-44 for the first bending tool 30.

The first bending unit 26 further comprises a drive 66 for the first base member 54, which is configured to move the first base member 54 in the further advance plane 64. In the case shown, the first bending unit 26 comprises two drives 66, 68 for the first base member 54. The drives 66, 68 are arranged on the first clamping jaw 22. In the case shown, the drives 66, 68 for the first base member 54 are identical in construction, which is why only the drive 66 will be described in more detail. The drive 66 is a linear drive. The drive 66 for the first base member 54 is integrated partly in the first base member 54 and partly in the first clamping jaw 22.

The second bending tool 31 and the second base member 55 of the second bending unit 28 can be moved in the same manner, the description of the first bending unit 26 being correspondingly applicable to the second bending unit 28.

In the following, a bending operation of the bending machine 10 will be described in more detail. In the case of bending with the first bending unit 26, bending is performed about the second clamping jaw 24. The protruding portion 14 of the workpiece 12 may be bent about the second clamping jaw 24 by the first bending tool 30 exerting a bending force on the protruding portion 14 of the workpiece 12 as it is moved or displaced in a suitable manner to form a fold 15. In an analogous manner, when bending with the second bending unit 28, the protruding portion 14 of the workpiece 12 may be bent about the first clamping jaw 22 by the second bending tool 31 exerting a bending force on the protruding portion 14 of the workpiece 12 as it is moved, in the present case displaced, in a suitable manner to form a fold 15. The bending machine 10 is thus configured for double bending.

The first bending tool 30 and the second bending tool 31 each have a hook-shaped bending portion 78 that is brought into contact with the workpiece 12 when the latter is formed. The hook-shaped bending portion 78 exerts a force, in particular a bending force, on the workpiece 12 when the first bending tool 30 or the second bending tool 31 is moved relative to the workpiece 12. The bending tool 30, 31 may exert a force on the workpiece 12 to machine it, in particular bend it, both as the bending tool 30, 31 retracts relative to the corresponding clamping jaw 22, 24 and as the bending tool 30, 31 extends relative to the corresponding clamping jaw 22, 24.

The hook-shaped bending portion 78 has a hook-shaped cross section perpendicular to the longitudinal direction 100.

The hook-shaped bending portion 78 has an inner surface 92 and an outer surface 94. The inner surface 92 is an inner hook surface. For example, the inner surface 92 is composed of a plurality of substantially flat surfaces which merge into each other in a rounded manner. Similarly, the outer surface 94 is composed of a plurality of substantially flat surfaces, with transitions configured as rounded edges.

The hook-shaped bending portion 78 further comprises an end portion 96 between the inner surface 92 and the outer surface 94. The end portion 96 forms a foremost portion of the bending tool 30. In a region of the end portion 96, the inner surface 92 merges with the outer surface 94. The end portion 96 has a curved surface having the shape of a circular arc when viewed parallel to the longitudinal direction 100. According to a bending variant, the workpiece 12 may be bent with the end portion 96 such that the end portion 96 always rests against the workpiece 12 along a line parallel to the bending axis 18. During a bending process, the curved surface of the end portion 96 rolls off the workpiece 12 so that preferably no sliding occurs between the workpiece 12 and the bending tool 30, which might result in the workpiece 12 being scratched. Such rolling off is produced by appropriately selecting a movement path of the bending tool 30 and thus of the end portion 96 so that the end portion 96 does not slide relative to the protruding portion 14 of the workpiece 12.

To control the movement of the bending tools 30, 31 or the base members 54, 55 in their advance planes, for example in the advance plane 48 or in the further advance plane 64, the bending machine 10 has an electronic control unit 82, which is shown schematically in FIG. 1. The control unit 82 is configured to generate a movement path for the bending tool 30 by superimposing at least two linear movements. The same applies to a movement path for the bending tool 31 of the second bending unit 28. In the case shown, these linear movements are the movement of the bending tool 30 in the advance plane 48 as well as the movement of the base member 54 in the further advance plane 64.

As can be seen again with reference to FIG. 1, the bending machine 10 further comprises a user interface 216 comprising, for example, a screen and suitable controls and/or a touch screen. The user interface 216 allows a user to enter a target profile to be bent. The control unit 82 is configured to receive and evaluate the target profile. Based on the target profile, the control unit 82 then calculates a suggested bending sequence. In addition, a simulation of a bending process may be created, which in turn may be displayed to the user via the user interface 216. It may be provided that the user may confirm and/or make changes to the proposed bending sequence based on the simulation, the changes being taken into account by the control unit 82 before a bending process is performed.

Figure 4A:
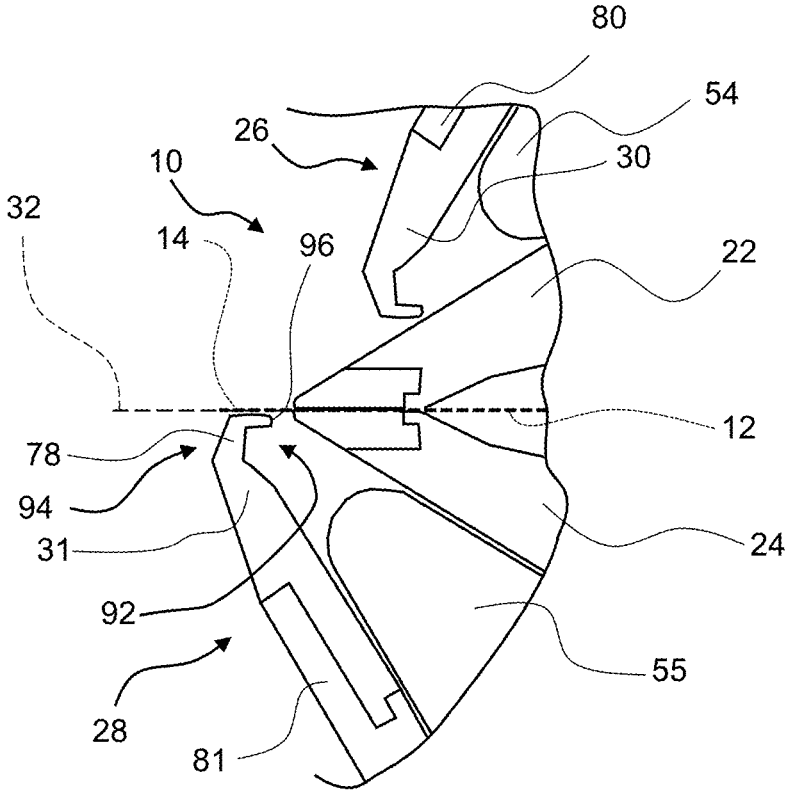
FIG. 4A is a schematic side view of a portion of the bending machine in a first position of a method for producing a closed seam.
Figure 4B:
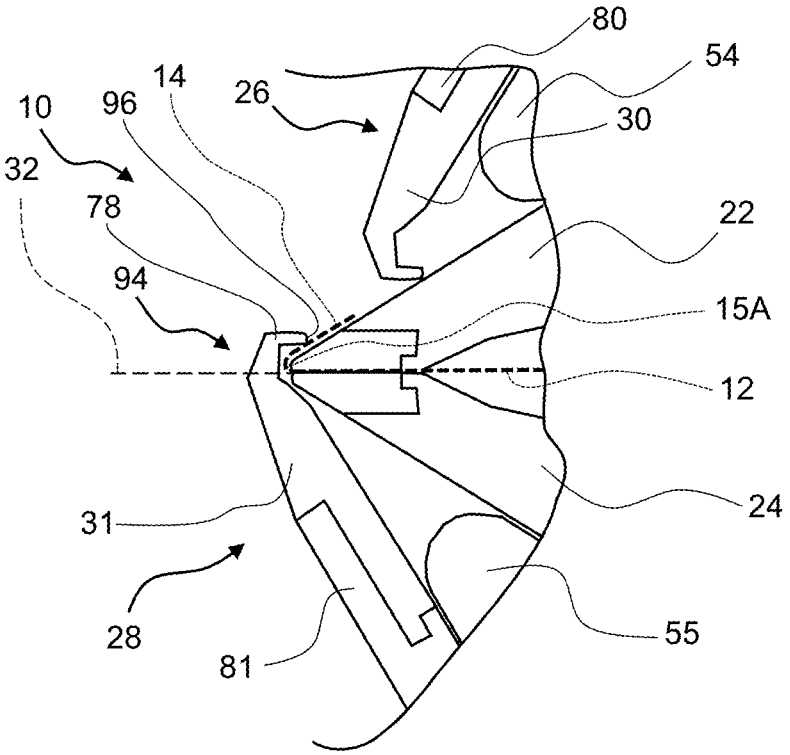
FIG. 4B is a schematic side view of a portion of the bending machine in a second position of the method for producing a closed seam.
Figure 4C:
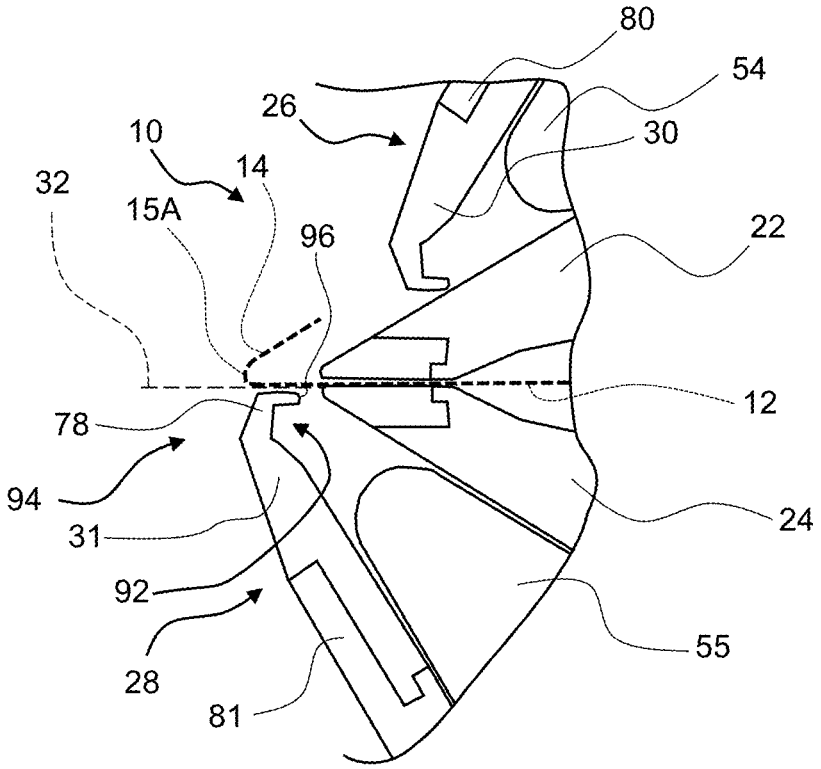
FIG. 4C is a schematic side view of a portion of the bending machine in a third position of the method for producing a closed seam.
Figure 4D:
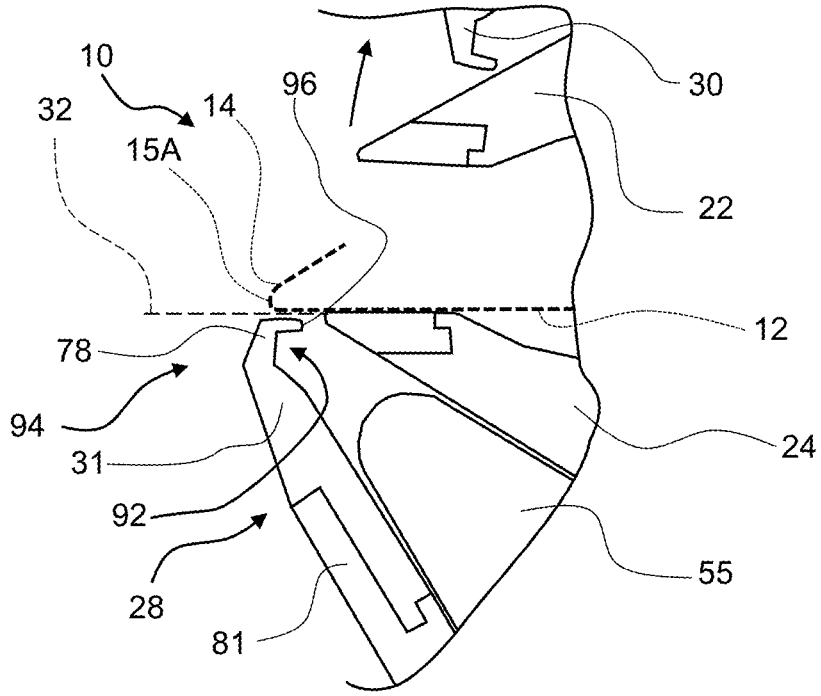
FIG. 4D is a schematic side view of a portion of the bending machine in a fourth position of the method for producing a closed seam.
Figure 4E:
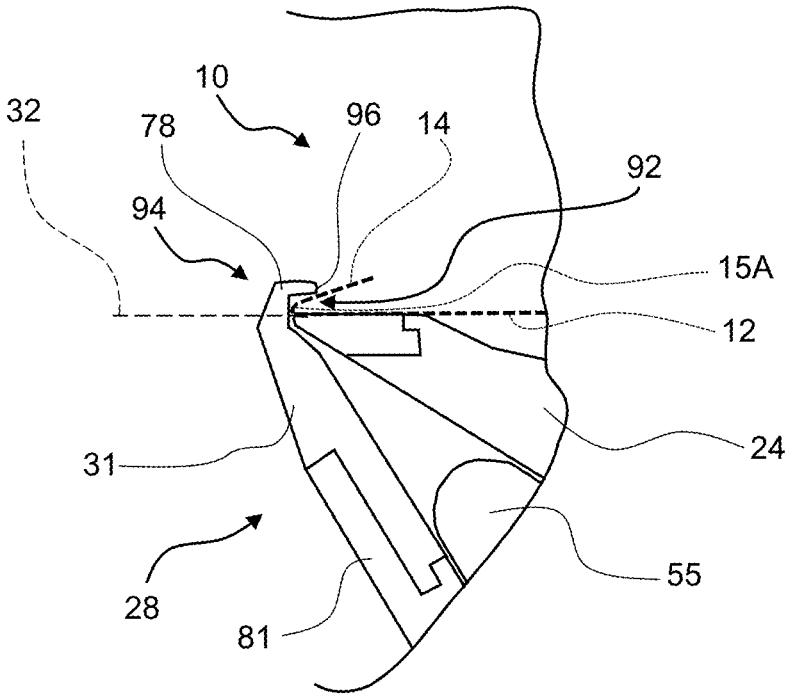
FIG. 4E is a schematic side view of a portion of the bending machine in a fifth position of the method for producing a closed seam.
Figure 4F:
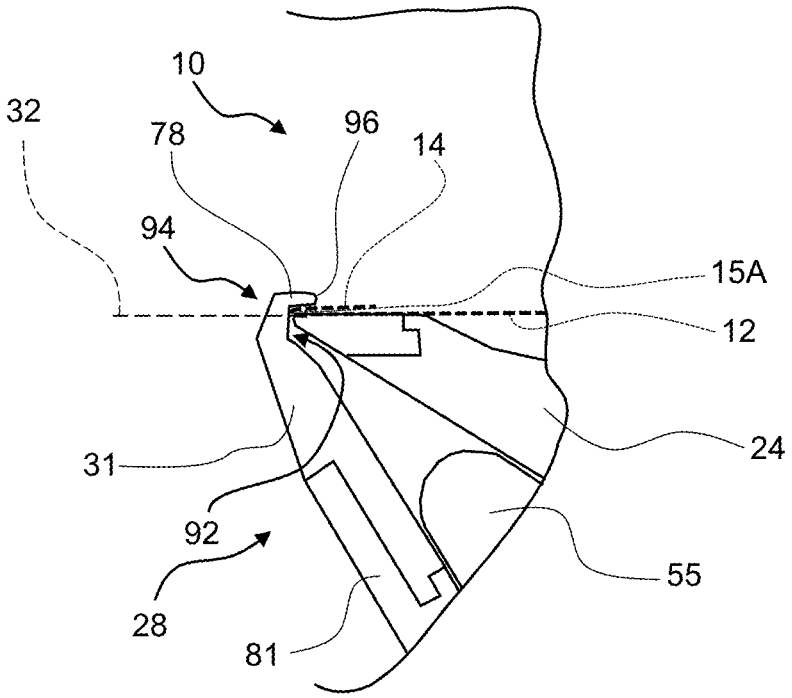
FIG. 4F is a schematic side view of a portion of the bending machine in a sixth position of the method for producing a closed seam.
Figure 5:
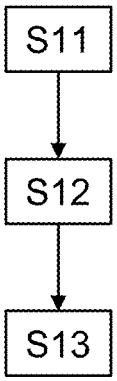
FIG. 5 is a flow chart of the method for producing a closed seam.

FIG. 4A through FIG. 4F and FIG. 5 show a method for producing a closed seam according to a first aspect with the bending machine 10 according to the invention. FIG. 4A is a schematic side view of a portion of the bending machine 10 in a first position of the method for producing a closed seam; FIG. 4B is a schematic side view of a portion of the bending machine 10 in a second position of the method for producing a closed seam, FIG. 4C is a schematic side view of a portion of the bending machine in a third position of the method for producing a closed seam, FIG. 4D is a schematic side view of a portion of the bending machine 10 in a fourth position of the method for producing a closed seam, FIG. 4E is a schematic side view of a portion of the bending machine 10 in a fifth position of the method for producing a closed seam, FIG. 4F is a schematic side view of a portion of the bending machine 10 in a sixth position of the method for producing a closed seam, and FIG. 5 is a flow chart of the method for producing a closed seam. Below, reference may be made to several of these figures at the same time.

The method for producing a closed seam comprises a first step S11 of producing a pre-seam on the workpiece 12, comprising forming a first fold 15A, as shown in FIG. 4A and FIG. 4B. The method further comprises a second step S12 of moving the first clamping jaw 22 away from the workpiece 12, as shown in FIG. 4C and FIG. 4D. In FIG. 4D, an arrow illustrates such a movement of the first clamping jaw 22 away from the workpiece 12. Instead of moving the first clamping jaw 22 away from the workpiece 12, moving it away from the pre-seam would also be sufficient to perform the step according to the invention. The method further comprises a third step S13 of closing the pre-seam to form a completely closed seam by completely closing the first fold 15A with the second bending unit 31 in a state in which the first clamping jaw 22 is spaced from the workpiece 12, as shown in FIG. 4E and FIG. 4F.

The first step S11 of producing the pre-seam on the workpiece 12 with the bending machine 10 is performed by moving, especially displacing, the second bending tool 31 relative to the second clamping jaw 24. During the displacement, the second bending tool 31 is extended relative to the second clamping jaw 24. In particular, the second bending tool 31 is extended with linear displacement relative to the second base member 55 while the second base member 55 is retracted with linear displacement relative to the second clamping jaw 24. As shown in FIG. 4A, this displacement initially causes the outer surface 94 of the hook-shaped bending portion 78 to come into contact with the protruding portion 14 and causes the protruding portion 14 to be bent relative to the clamped portion 16 by pressing with the second bending tool 31. In the course of bending, the end portion 96 of the hook-shaped bending portion 78 comes into contact with the protruding portion 14, bending it further by pressing with the second bending tool 31 so that a pre-seam with the first fold 15A is produced, as shown in FIG. 4B.

In the present case, the second step S12 of moving the first clamping jaw 22 away from the workpiece 12 is performed by swiveling the carrier 90, as shown in FIG. 4C and FIG. 4D. For example, the workpiece 12 is pushed forward and backward relative to the clamping jaws 22, 24 by the positioning unit (not shown) to prevent the first clamping jaw 22 from colliding with the workpiece 12. First, the carrier 90 is slightly swiveled upwards together with the first clamping jaw 22 so that the workpiece 12 is no longer clamped between the first clamping jaw 22 and the second clamping jaw 24, as shown in FIG. 4C. The workpiece 12 can then be partially pushed forward. The positioning unit (not shown) is particularly suitable for this purpose. However, other devices may be used or the workpiece may be pushed forward manually. Subsequently, the first clamping jaw 22 can be moved away from the workpiece 12 by swiveling the carrier 90 upwards, as shown in FIG. 4D, without colliding with the workpiece 12. Afterwards, the workpiece 12 is pushed back again for the third step S13 of closing the pre-seam.

Alternatively, the first fold 15A of the pre-seam could also be bent, for example, at an angle such that it is not necessary to push the workpiece 12 forward and backward to move the first clamping jaw 22 away from the workpiece 12 or the pre-seam without colliding with the workpiece 12. In addition, the bending machine 10 could also be modified such that, for example, the first clamping jaw 22 is movable horizontally along the clamping plane 32 to avoid pushing the workpiece 12 forward and backward.

As shown in FIG. 4E, the third step S13 of closing the pre-seam is performed in a state in which the workpiece 12 rests on the second clamping jaw 24, the first clamping jaw 22 having moved away. The workpiece 12 is thus in a state in which it is not clamped. In the present case, closing is effected by pressing the second bending tool 31 against the protruding portion 14, which in the present case forms the pre-seam with the first fold 15A, as the second bending tool 31 retracts relative to the second clamping jaw 24. In this case, the second bending tool 31 is retracted with linear displacement relative to the second base member 55 while the second base member 55 is extended with linear displacement relative to the second clamping jaw 24. As shown in FIG. 4E, this displacement initially causes the end portion 96 of the hook-shaped bending portion 78 to maintain contact with the protruding portion 14 and causes the protruding portion 14 to be bent further relative to the clamped portion 16 by pressing with the second bending tool 31. In the course of bending, the inner surface 92 of the hook-shaped bending portion 78 comes into contact with the protruding portion 14, bending it further by pressing with the second bending tool 31 so that the first fold 15A of the seam is closed completely, as shown in FIG. 4F. This displacement causes the second bending tool 31 to retract relative to the second clamping jaw 24 for pressing with the inner surface 92 and the end portion 96 in such a way that preferably no sliding occurs between the workpiece 12 and the second bending tool 31. Sliding might result in the workpiece 12 being scratched.

Sliding is prevented by appropriately selecting a movement path of the second bending tool 31 and thus of the inner surface 92 and the end portion 96 so that they do preferably not slide relative to the protruding portion 14 of the workpiece 12.

The first fold 15A is completely closed by moving the inner surface 92 of the hook-shaped bending portion 78 toward the second clamping jaw 24. In particular, a flat surface of the inner surface 92, which is parallel to a clamping surface of the second clamping jaw 24, is moved toward the latter. In this case, the force exerted on the workpiece 12 by the second bending tool 31 is more planar so that the first fold 15A can be completely closed with particular precision.

Alternatively, the pre-seam could also be closed by pressing with the first bending tool 30 as the first bending tool 30 extends relative to the first clamping jaw 22.

The control unit 82 of the bending machine 10 is configured to perform steps S11 to S13 as shown in FIG. 5. The control 82 unit may generate a movement path for the first bending tool 31 required for steps S11 to S13 by superimposing the linear movement between the second clamping jaw 28 and the second base member 55 and the linear movement between the second base member 55 and the second bending tool 31.

It is not necessary to use a bending machine comprising two bending units to perform steps S11 to S13. The method for producing a closed seam may hence also be performed with a bending machine comprising a single bending unit, in particular with a single bending machine, as for example in an embodiment described below. In addition, steps S11 to S13 may also be carried out by an upper bending unit, wherein a closed seam with a closed fold 15 is then produced correspondingly toward an opposite side, and during the third step S13 of closing the pre-seam, the workpiece 12 rests, for example, on the table 88 in a non-clamped state or is held in position by the table 88. Moreover, steps S11 to S13 may also be carried out with a bending machine comprising a bending tool of a different shape, in particular of a different bending geometry, on the respective bending units.

Figure 7:
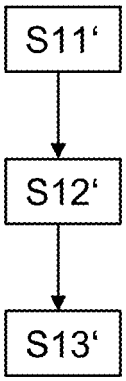
FIG. 7 is a flow chart of the further method for producing a closed seam.
Figure 6A:
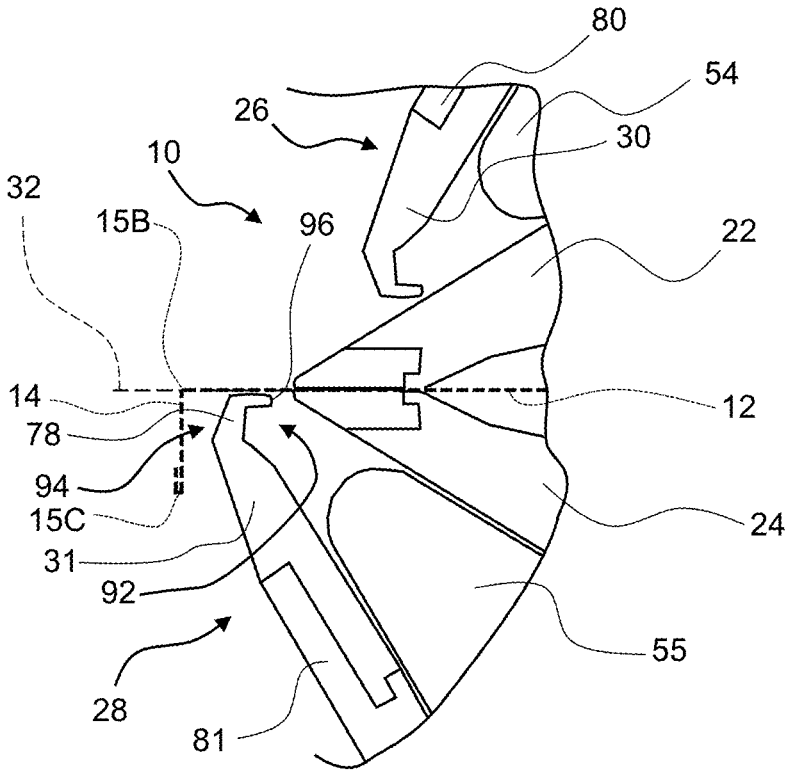
FIG. 6A is a schematic side view of a portion of the bending machine in a first position of a further method for producing a closed seam.
Figure 6B:
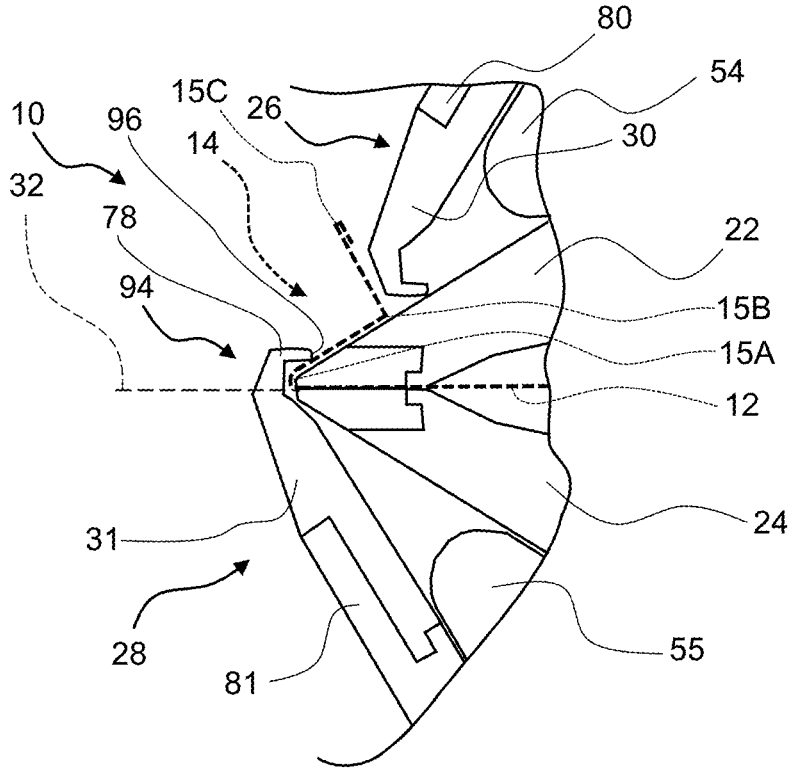
FIG. 6B is a schematic side view of a portion of the bending machine in a second position of the further method for producing a closed seam.
Figure 6C:
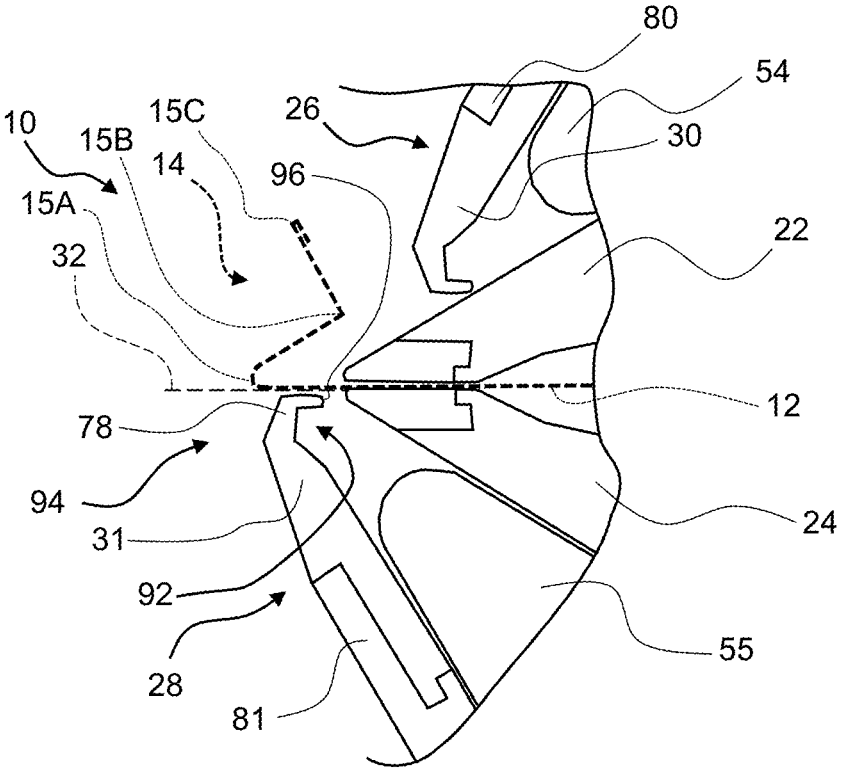
FIG. 6C is a schematic side view of a portion of the bending machine in a third position of the further method for producing a closed seam.
Figure 6D:
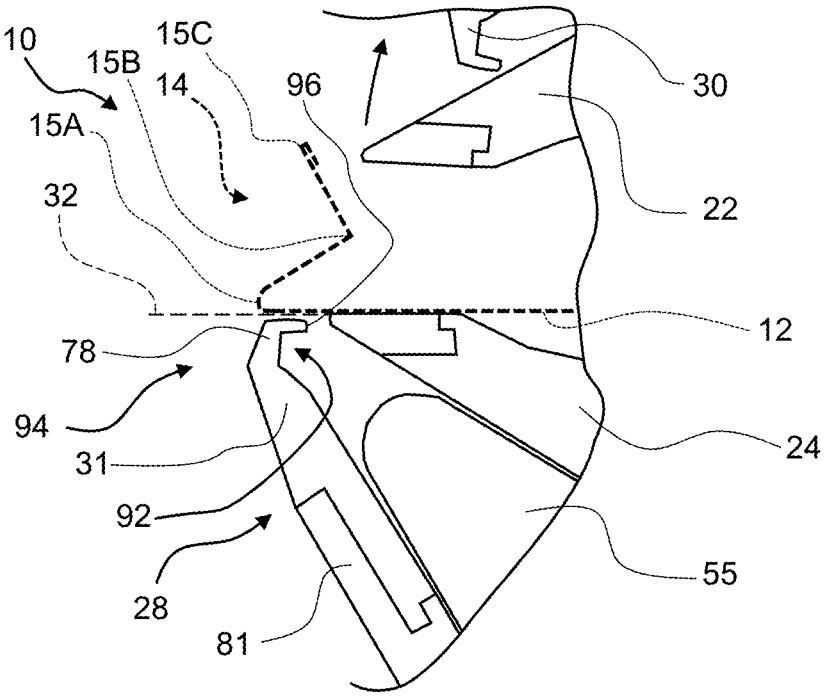
FIG. 6D is a schematic side view of a portion of the bending machine in a fourth position of the further method for producing a closed seam.
Figure 6E:
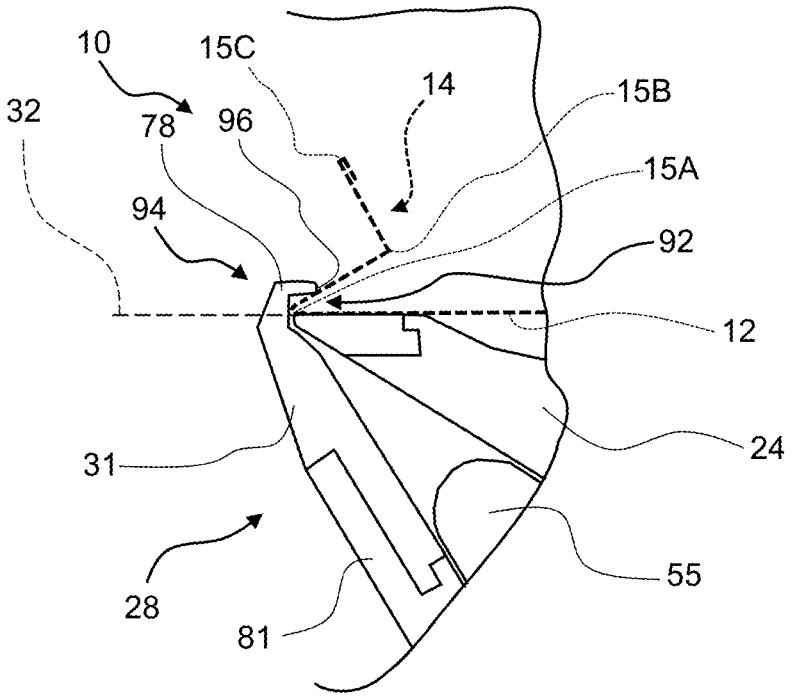
FIG. 6E is a schematic side view of a portion of the bending machine in a fifth position of the further method for producing a closed seam.
Figure 6F:
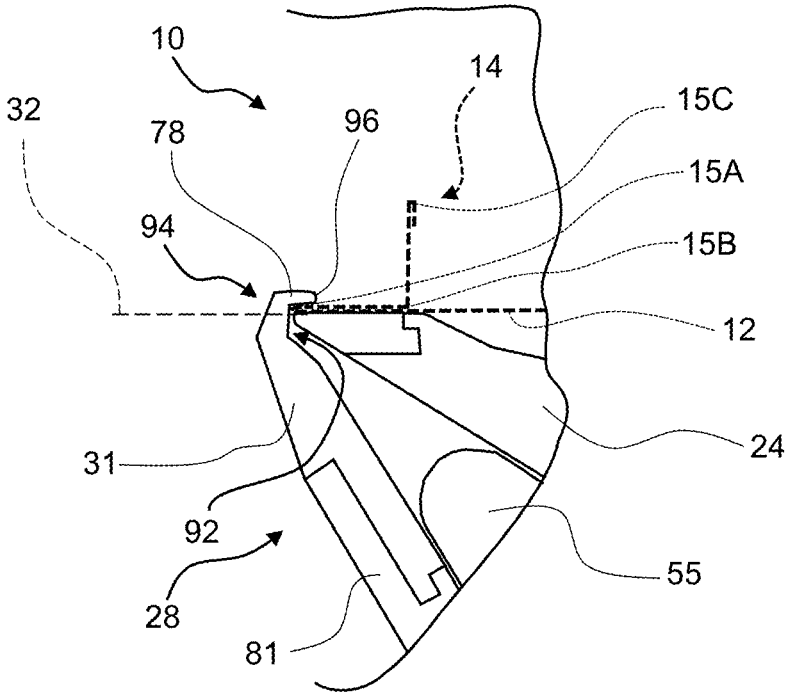
FIG. 6F is a schematic side view of a portion of the bending machine in a sixth position of the further method for producing a closed seam.

FIG. 6A through FIG. 6F and FIG. 7 show a further method for producing a closed seam according to a first aspect with the bending machine 10 according to the invention. FIG. 6A is a schematic side view of a portion of the bending machine 10 in a first position of the method for producing a closed seam; FIG. 6B is a schematic side view of a portion of the bending machine 10 in a second position of the method for producing a closed seam, FIG. 6C is a schematic side view of a portion of the bending machine 10 in a third position of the method for producing a closed seam, FIG. 6D is a schematic side view of a portion of the bending machine 10 in a fourth position of the method for producing a closed seam, FIG. 6E is a schematic side view of a portion of the bending machine 10 in a fifth position of the method for producing a closed seam, FIG. 6F is a schematic side view of a portion of the bending machine 10 in a sixth position of the method for producing a closed seam, and FIG. 7 is a flow chart of the method for producing a closed seam. Below, reference may be made to several of these figures at the same time.

The further method for producing a closed seam on a workpiece 12 with the bending machine 10 comprises a first step S11' of producing the pre-seam on the workpiece 12, comprising forming a first fold 15A, as shown in FIG. 6A and FIG. 6B, a second step S12' of moving the second clamping jaw 22 away from the workpiece 12, as shown in FIG. 6C and FIG. 6D, and a third step S13' of closing the pre-seam to form a seam by closing the first fold 15A with the bending unit 28 in a state in which the second clamping jaw 22 is spaced from the workpiece 12, as shown in FIG. 6E and FIG. 6F.

The further method for producing a closed seam in steps S11' to S13' is an extended embodiment of the method for producing a closed seam in steps S11 to S13 as described above and may be used, for example, to manufacture a sheet of metal having a drip edge for eaves. Step S12' equals step S12, and step S13' equals step S13. Step S11' is based on step S11 but differs in the production of a pre-seam with a profile leg. The same or similar steps have the same reference signs as above although the reference signs of the alternative method steps have inverted commas for identification purposes. With regard to the description, reference can thus be made to the explanations above. Therefore, no further detailed description of these method steps is provided.

The first step S11' of producing the pre-seam with a profile leg on the workpiece 12, comprising forming a plurality of folds 15, with the bending machine 10 is performed in a plurality of bending processes by means of movements, in the present case displacements, of the first and second bending tools 30, 31 relative to the first and second clamping jaws 22, 24. Between the bending processes, the workpiece 12 is pushed forward to perform the bending processes at different positions on the workpiece 12. The positioning unit (not shown) is particularly suitable for this purpose. However, other devices may be used or the workpiece may be pushed forward manually. FIG. 6A and FIG. 6B show the last bending process of the plurality of bending processes of the first step S11' of producing the pre-seam on the workpiece 12.

The first step S11' of producing the pre-seam with a profile leg comprises forming a second fold 15B as a standing seam, the second fold 15B being different from the first fold 15A. The first step S11' further comprises forming a third fold 15C as a U bend, the third fold 15C being different from the first fold 15A and the second fold 15B. The profile leg is produced as a standing seam with a U bend by bending a portion of the workpiece 12 about the second fold 15B. In the first step S11' of producing the pre-seam, the standing seam is bent about the first fold 15A relative to a clamped portion of the workpiece 12. In the third step S13' of closing the pre-seam, the standing seam protrudes from the second clamping jaw 24 in the direction of the spaced first clamping jaw 22, as shown in FIG. 6E and FIG. 6F. In the present case, therefore, the third fold 15C is formed first, followed by the second fold 15B and then the first fold 15A.

For this further method for producing a closed seam, the control unit 82 of the bending machine 10 is further configured to perform steps S11', S12' and S13' as shown in FIG. 7.

Figure 9:
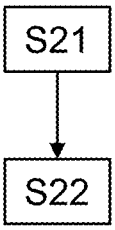
FIG. 9 is a flow chart of the method for producing an inclined seam.
Figure 11:
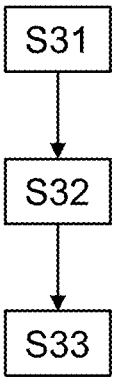
FIG. 11 is a flow chart of the method for producing a recess.
Figure 8A:
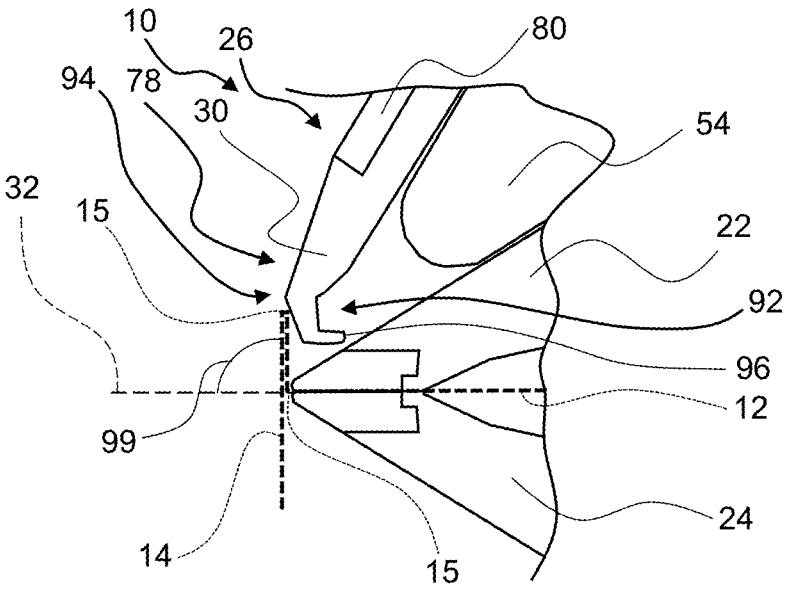
FIG. 8A is a schematic side view of a portion of the bending machine in a first position of a method for producing an inclined seam.
Figure 8B:
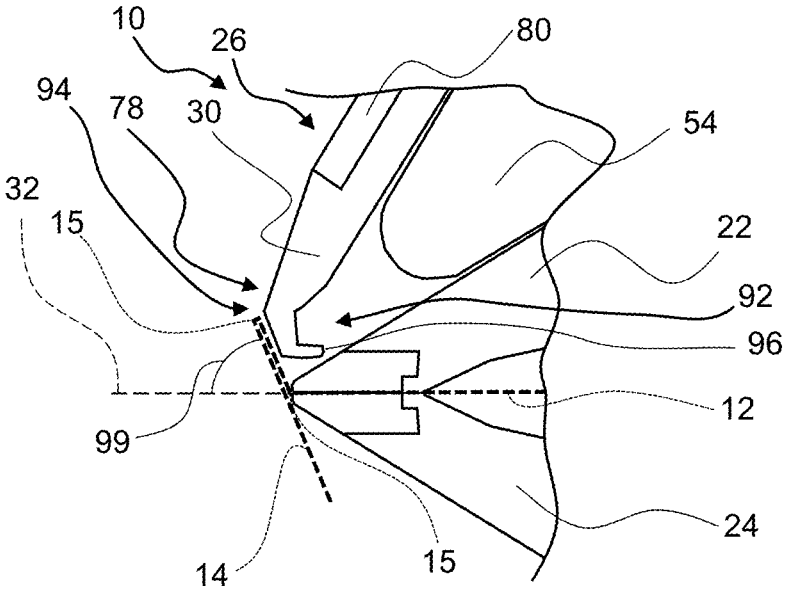
FIG. 8B is a schematic side view of a portion of the bending machine in a second position of the method for producing an inclined seam.

FIG. 8A, FIG. 8B and FIG. 9 show a method for producing an inclined seam with the bending machine 10 according to a second aspect. FIG. 8A is a schematic side view of a portion of the bending machine 10 in a first position of a method for producing an inclined seam; FIG. 8B is a schematic side view of a portion of the bending machine in a second position of the method for producing an inclined seam, and FIG. 9 is a flow chart of the method for producing an inclined seam.

As shown in FIG. 8A and FIG. 8B, the pre-seam comprises a profile leg. The method for producing an inclined seam comprises a first step S21 of producing a pre-seam on the workpiece 12 such that it is located in an area in front of the clamping jaws 22, 24, comprising forming a fold 15, wherein the pre-seam extends at an angle 99 relative to the clamping plane 32, and a second step S22 of changing the angle 99 by displacing the first bending tool 30.

In the present case, step S21 of producing the pre-seam on the workpiece 12 is performed by controlling a bending operation of the bending machine 10 in which a pre-seam with two folds 15 is produced as a pre-seam with a profile leg by bending with the bending tools 30, 31. This involves bending about different bending axes, with the control unit 82 operating in a pre-bending operating mode, an inclined operating mode and a pinch bending operating mode. Such a bending operation for producing a pre-seam as part of a profile leg is known, for example, from DE 20 2020 002 598 U1, the description of which is incorporated herein by reference.

Alternatively, step S21 of producing the pre-seam on the workpiece 12 may correspond to the previously performed step S11, as for example in an embodiment described below, where the pre-seam has no profile leg. The different configuration of the pre-seam has no influence on the following description of step S22 in which the angle 99 is changed.

As shown in FIG. 8A and FIG. 8B, step S22 of changing the angle 99 is performed by pressing with the outer surface 94 of the hook-shaped bending portion 78 as the first bending tool 30 extends relative to the first clamping jaw 22. In this case, the first bending tool 30 is extended with linear displacement relative to the first base member 54 while the first base member 54 together with the first bending tool 30 is retracted with linear displacement relative to the first clamping jaw 22. This displacement causes the first bending tool 30 to extend relative to the first clamping jaw 22 for pressing with the outer surface 94 in such a way that preferably no sliding occurs between the workpiece 12 and the first bending tool 30. Sliding might result in the workpiece 12 being scratched.

Sliding is prevented by appropriately selecting a movement path of the first bending tool 30 and thus of the outer surface 94 so that the outer surface 94 does preferably not slide relative to the protruding portion 14 of the workpiece 12.

The angle 99 is thus changed by pressing with the outer surface 94 of the hook-shaped bending portion 78. In the first position shown in FIG. 8A, the angle 99 of the pre-seam is approximately 90° relative to the clamping plane 32 and is changed by displacing the first bending tool 30 to the angle 99, which is approximately 70° relative to the clamping plane 32 in the second position shown in FIG. 8B.

Alternatively, the angle 99 may be changed as the first bending tool 30 retracts relative to the first clamping jaw 22. In this case, the angle 99 is changed by pressing with the inner surface 92 and the end portion 96 of the hook-shaped bending portion 78 as the first bending tool 30 retracts relative to the first clamping jaw 22. Accordingly, the angle 99 may also be changed in an opposite direction, i.e. toward a larger angle 99. In another alternative embodiment (not shown), the angle 99 is changed by moving or displacing the second bending tool 31 rather than moving or displacing the first bending tool 30.

The control unit 82 of the bending machine 10 is configured to perform steps S21 and S22 as shown in FIG. 9.

Figure 10A:
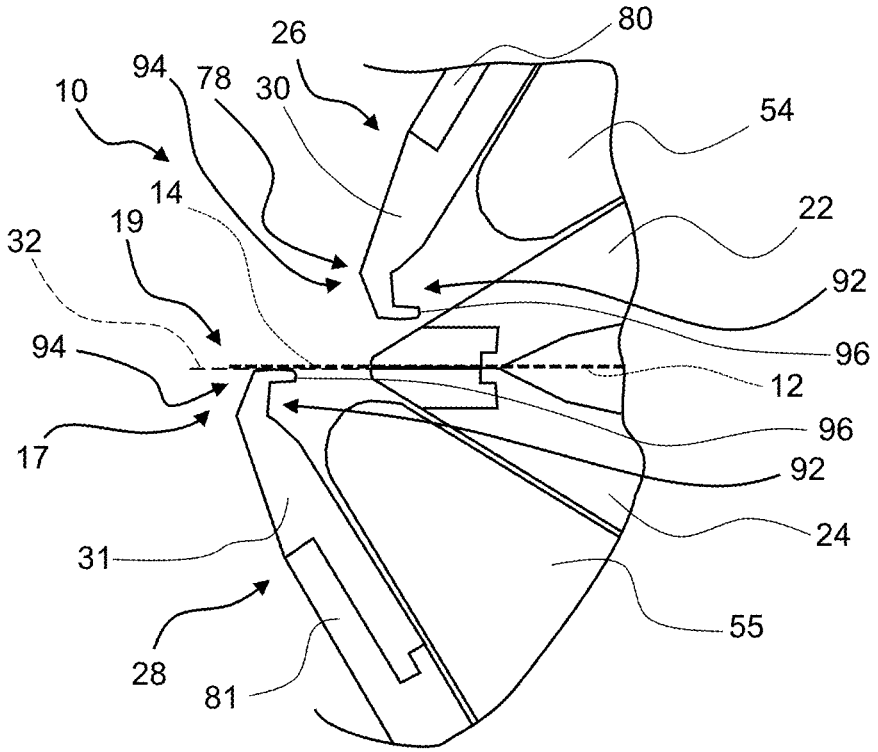
FIG. 10A is a schematic side view of a portion of the bending machine in a first position of a method for producing a recess.
Figure 10B:
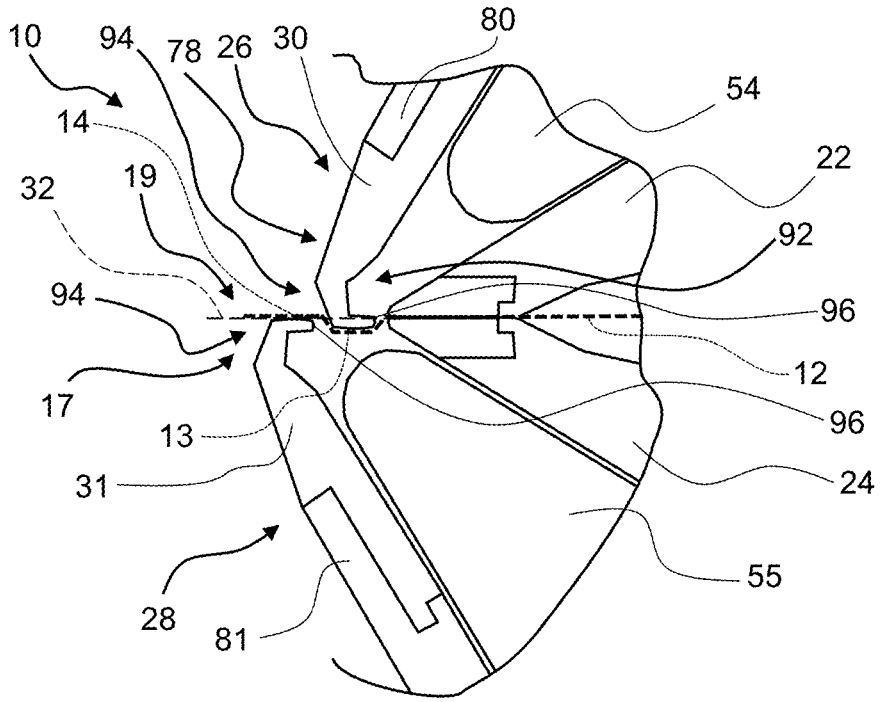
FIG. 10B is a schematic side view of a portion of the bending machine in a second position of the method for producing a recess.

FIG. 10A, FIG. 10B and FIG. 9 show a method for producing a recess with the bending machine 10 according to a third aspect. FIG. 10A is a schematic side view of a portion of the bending machine 10 in a first position of a method for producing a recess; FIG. 10B is a schematic side view of a portion of the bending machine 10 in a second position of the method for producing a recess, and FIG. 9 is a flow chart of the method for producing a recess.

The method for producing a recess comprises a first step S31 of clamping the workpiece 12 with the first clamping jaw 22 and the second clamping jaw 24 such that a protruding portion 14 of the workpiece 12 protrudes from the clamping jaws 22, 24, and a second step S32 of moving or displacing one of the two bending tools 30, 31 into a counteraction position as shown in FIG. 10A such that it rests against the protruding portion 14 of the workpiece 12 at a distance from the clamping jaws 22, 24, and a third step S33 of extending the other bending tool 30, 31 such that it presses against the workpiece 12 so that the recess 13 is formed in the workpiece 12 as shown in FIG. 10B.

In the example shown in FIG. 10A and FIG. 10B, one bending tool is the second bending tool 31, and the other bending tool is the first bending tool 30.

In the first step S31 of clamping the workpiece 12, the workpiece 12 is clamped in the clamping plane 32. As shown in FIG. 10A and FIG. 10B, the workpiece 12 is clamped between the first clamping jaw 22 and the second clamping jaw 24 such that the workpiece 12 is fixed.

In the second step S32 of moving or displacing, the one bending tool 31 rests against a first side 17 of the workpiece 12, and in the third step S33 of extending the other bending tool 30, the other bending tool 30 presses against the workpiece 12 on a second side 19 of the workpiece 12 opposite the first side 17 such that the recess 13 is formed in the workpiece 12. In this case, the bending tool 31 rests against the protruding portion 14 of the workpiece 12 at a distance along the clamping plane 32. In the counteraction position, the bending tool 31 rests with its outer surface 94 against the protruding portion 14 of the workpiece 12 on the first side 17 of the workpiece 12.

In step S33, the extension of the other bending tool 30 is an extension relative to the first clamping jaw 22. In this case, the other bending tool 30 is extended with linear displacement relative to the first base member 54 while the first base member 54 together with the other bending tool 30 is retracted with linear displacement relative to the first clamping jaw 22. This displacement causes the bending tool 30 to extend relative to the first clamping jaw 22 for pressing with the outer surface 94 in such a way that preferably there is as little sliding as possible between the workpiece 12 and the bending tool 30, thereby preventing, at least to the greatest extent possible, the workpiece 12 from being scratched.

In the third step S33 of extending the other bending tool 30, the outer surface 94 thereof is pressed against the workpiece 12 on the second side 19 of the workpiece 12 such that the recess 13 is formed in the workpiece 12 in a manner similar to a deep-drawing operation.

Alternatively, if the bending tool 30 or the associated base member 54 is configured accordingly, pressing with the end portion is possible to form a recess. The control unit 82 of the bending machine 10 is configured to perform steps S31 to S33 as shown in FIG. 9.

The method for producing a recess comprising steps S31, S32 and S33 may be performed in particular in combination with the method of the first aspect or the method of the second aspect, in particular before and/or afterwards in each case. However, a combination of all three methods in any order is also possible.

Figure 12:
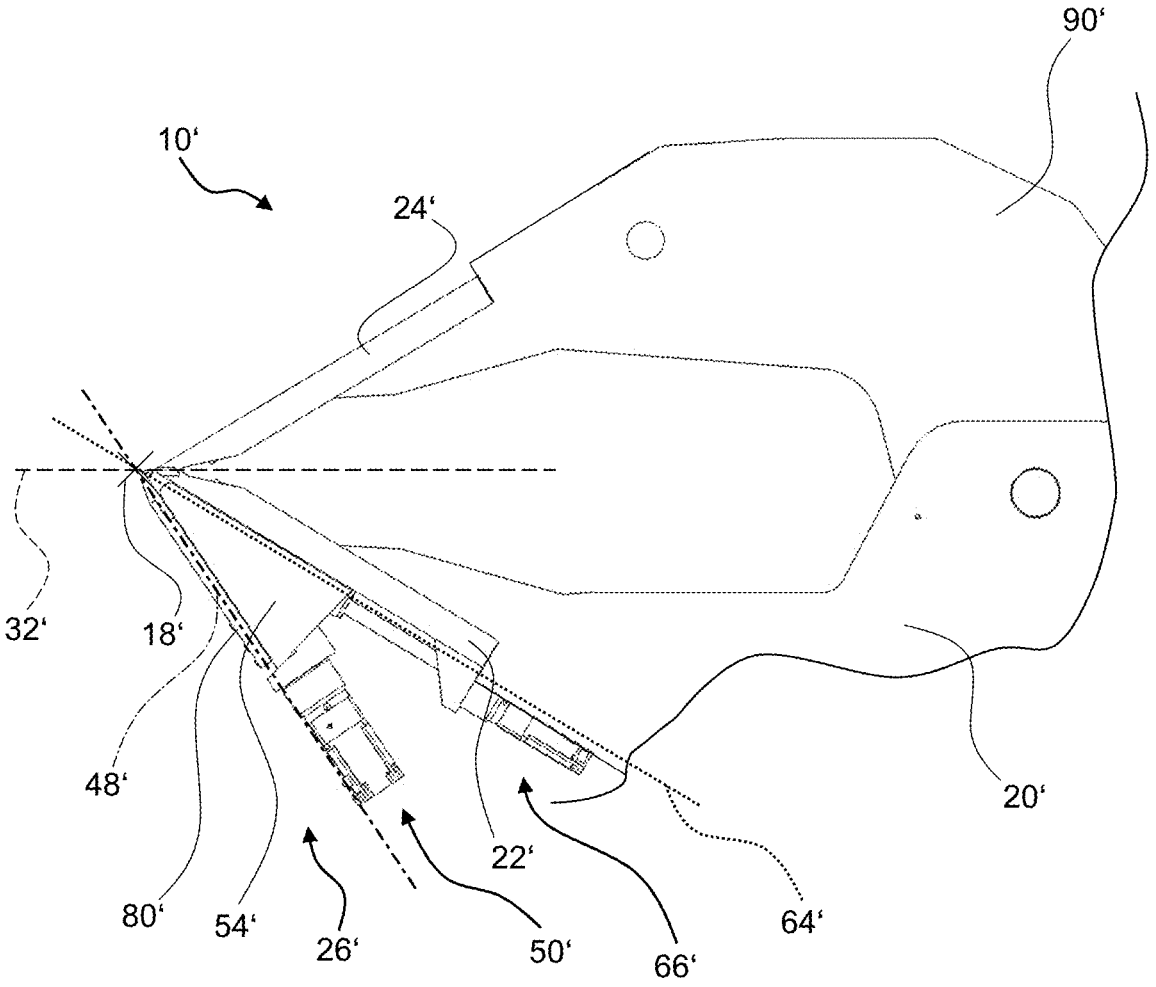
FIG. 12 is a schematic side view of a portion of another bending machine configured as a single bending machine.

FIG. 12 is a schematic side view of a portion of another exemplary bending machine 10', configured as a single bending machine, for performing the method according to the invention as an alternative embodiment of the bending machine 10 described above, configured as a double bending machine. Similar components have the same reference signs as above although the reference signs of the alternative embodiment have inverted commas for identification purposes.

The bending machine 10', which is configured as a single bending machine, largely corresponds to the bending machine 10, which is configured as a double bending machine, wherein the bending machine 10' is formed without an upper bending unit. In addition, the bending machine 10' has a lower bending unit whose bending tool has a different shape. However, the single bending machine can also be used with the bending tool described above or other suitable bending tools. The same applies to the bending tools used with the double bending machine described above.

The bending machine 10' comprises a machine frame 20' and is placed on a level surface with the machine frame 20'. The bending machine 10' further comprises a first clamping jaw 22' and a second clamping jaw 24', wherein, unlike the bending machine 10 described above and configured as a double bending machine, the first clamping jaw 22' is a lower clamping jaw while the second clamping jaw 24' is an upper clamping jaw. The first clamping jaw 22' is thus connected to the machine frame 20', and the second clamping jaw 24' is correspondingly connected to a carrier 90'. The bending machine 10' further comprises only one bending unit 26' that is disposed on the first clamping jaw 22'. With regard to the description, reference can thus also be made to the explanations above, taking into account the differences described herein. In other words, the bending machine 10' has all the features of the bending machine 10 that do not belong to the upper (first) bending unit 22 of the bending machine 10. Therefore, no further detailed description of these features is provided.

The bending unit 26' comprises a bending tool 30' whose hook-shaped bending portion 78' has an inner surface 92' and an outer surface 94'. The inner surface 92' is an inner hook surface. In the present case, the interior surface 92' and the outer surface 94' are each composed of flat and curved surfaces which merge into each other in a rounded manner. The hook-shaped bending portion 78' further comprises an end portion 96' between the inner surface 92' and the outer surface 94'. The end portion 96' forms a foremost portion of the bending tool 30'. In a region of the end portion 96', the inner surface 92' merges with the outer surface 94'. According to a bending variant, the workpiece 12' may be bent with the end portion 96' such that the end portion 96' always rests against the workpiece 12'. During a bending process, the curved surface of the end portion 96' rolls off the workpiece 12' so that preferably no sliding occurs between the workpiece 12' and the bending tool 30', which might result in the workpiece 12' being scratched.

Figure 14:
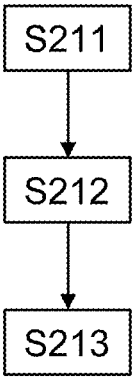
FIG. 14 is a flow chart of the method for producing a closed seam using the other bending machine.
Figure 13A:
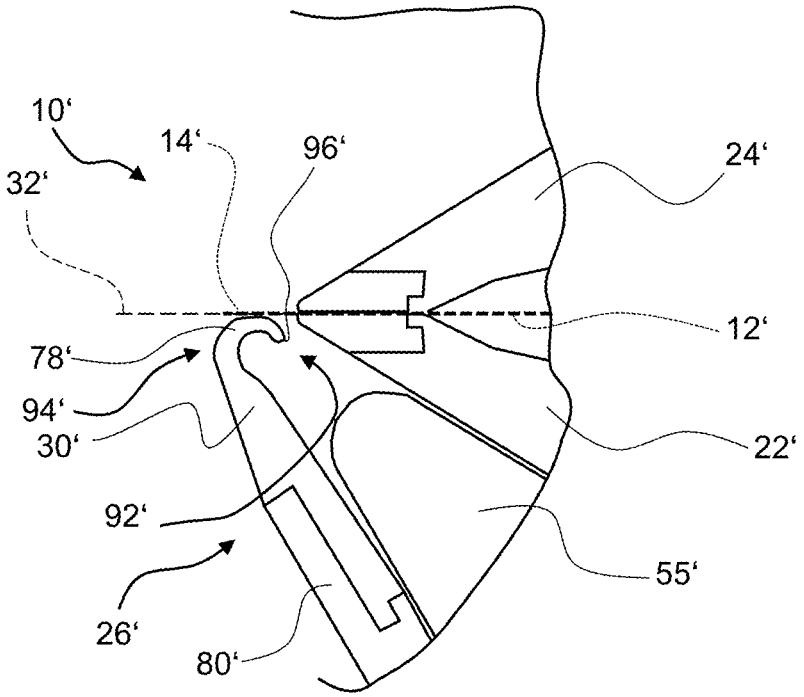
FIG. 13A is a schematic side view of a portion of the other bending machine in a first position of a method for producing a closed seam.
Figure 13B:
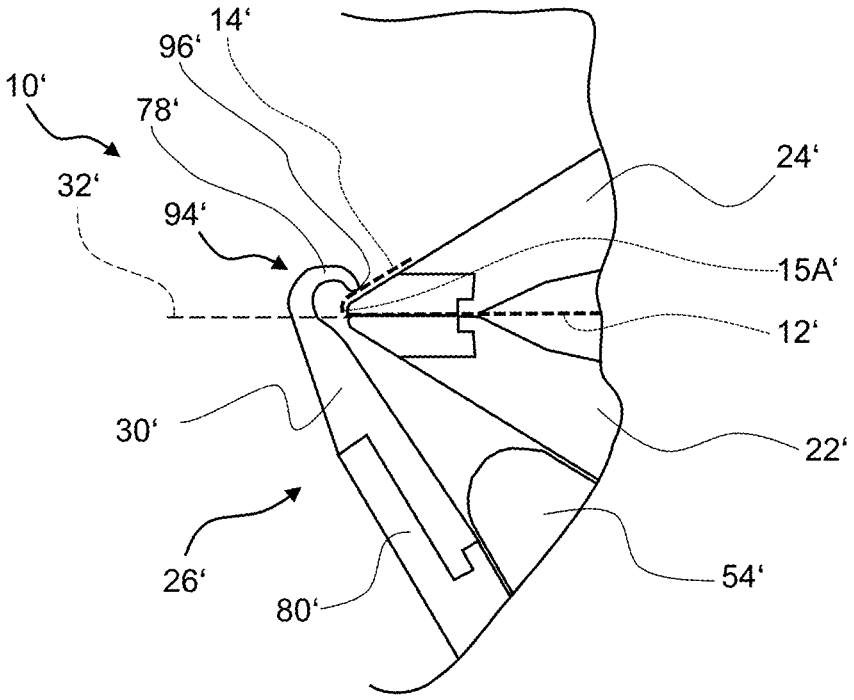
FIG. 13B is a schematic side view of a portion of the other bending machine in a second position of the method for producing a closed seam.
Figure 13C:
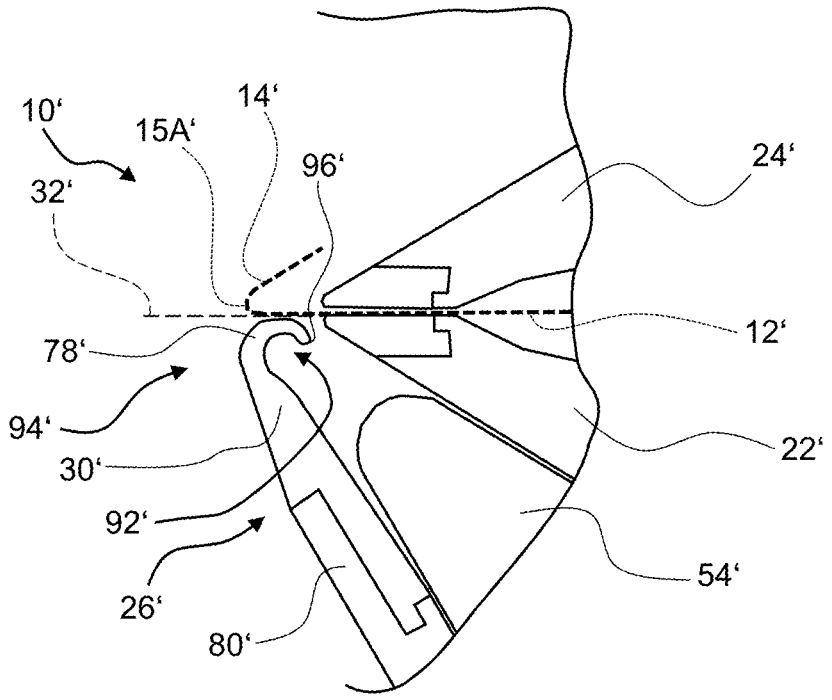
FIG. 13C is a schematic side view of a portion of the other bending machine in a third position of the method for producing a closed seam.
Figure 13D:
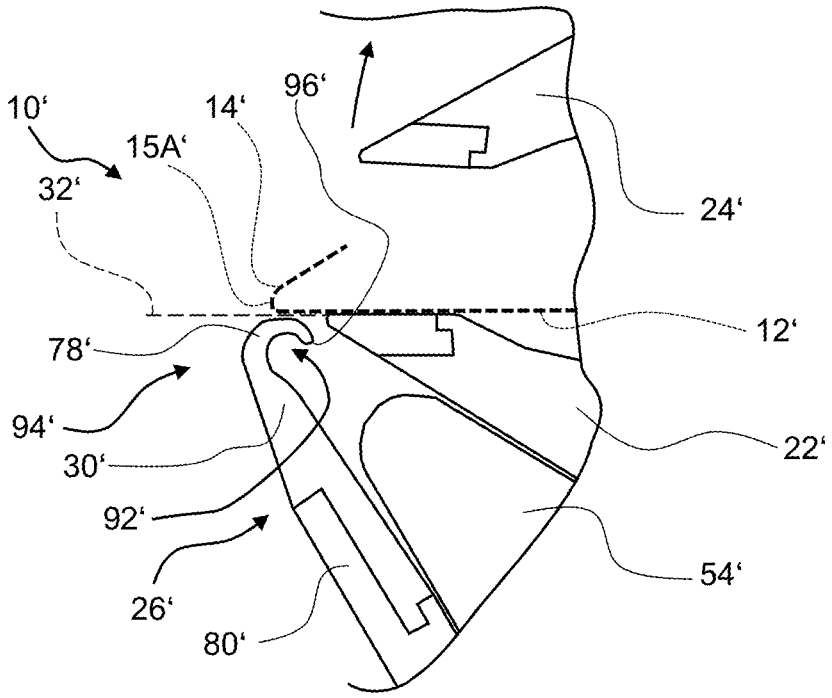
FIG. 13D is a schematic side view of a portion of the other bending machine in a fourth position of the method for producing a closed seam.
Figure 13E:
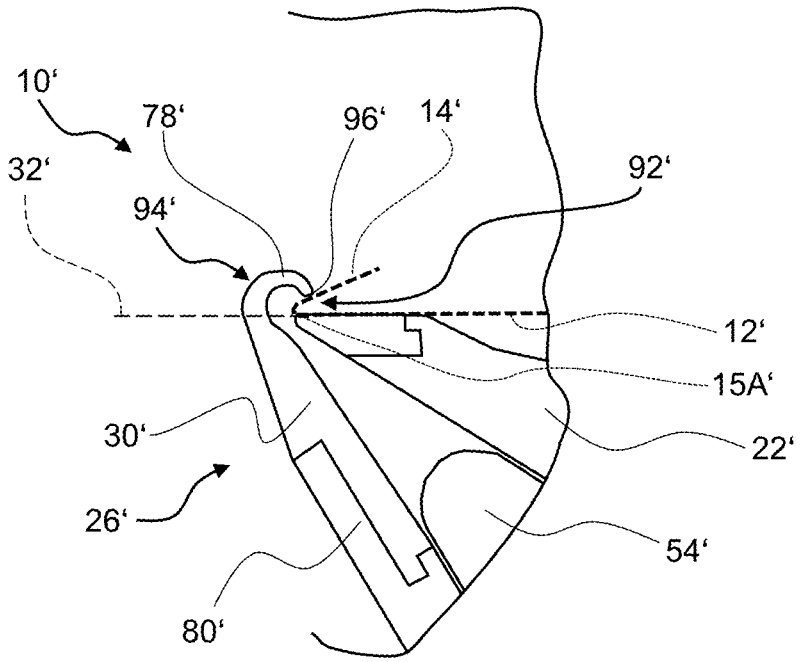
FIG. 13E is a schematic side view of a portion of the other bending machine in a fifth position of the method for producing a closed seam.
Figure 13F:
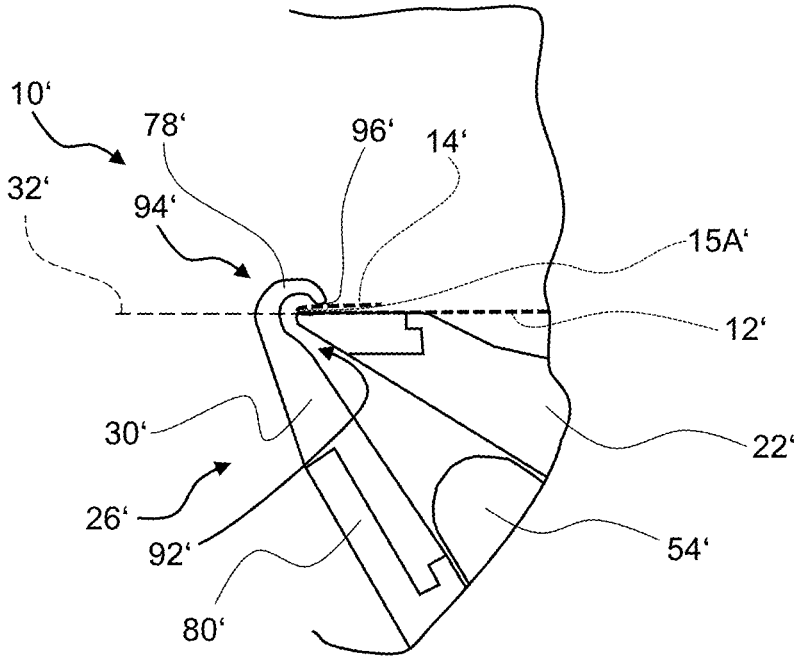
FIG. 13F is a schematic side view of a portion of the other bending machine in a sixth position of the method for producing a closed seam.

FIG. 13A through FIG. 13F and FIG. 14 show a further method for producing a closed seam according to a first aspect with the bending machine 10' according to the invention, which is configured as a single bending machine. FIG. 13A is a schematic side view of a portion of the bending machine 10' in a first position of the method for producing a closed seam; FIG. 13B is a schematic side view of a portion of the bending machine 10' in a second position of the method for producing a closed seam, FIG. 13C is a schematic side view of a portion of the bending machine 10' in a third position of the method for producing a closed seam, FIG. 13D is a schematic side view of a portion of the bending machine 10' in a fourth position of the method for producing a closed seam, FIG. 13E is a schematic side view of a portion of the bending machine 10' in a fifth position of the method for producing a closed seam, FIG. 13F is a schematic side view of a portion of the bending machine 10' in a sixth position of the method for producing a closed seam, and FIG. 14 is a flow chart of the method for producing a closed seam. Below, reference may be made to both figures at the same time.

The further method for producing a closed seam comprises a first step S211 of producing the pre-seam on the workpiece 12', comprising forming a first fold 15A', as shown in FIG. 13A and FIG. 13B, a second step S212 of moving the second clamping jaw 24' away from the workpiece 12', as shown in FIG. 13C and FIG. 13D, and a third step S213 of closing the pre-seam to form a seam by completely closing the first fold 15A' with the bending unit 26' in a state in which the second clamping jaw 24' is spaced from the workpiece 12', as shown in FIG. 13E and FIG. 13F. Step S211 equals step S11, step S212 equals step S12 and step S213 equals step S13, the only difference being the designation of the clamping jaws and the bending unit. With regard to the description, reference can thus be made to the explanations above. Therefore, no further detailed description of these method steps is provided. It is understood that, again by analogy with FIGS. 6A to 6F, the method may also be used to again bend a previously produced standing seam to produce a geometry such as that shown as an example in FIG. 6F.

The control unit 82' of the bending machine 10' is configured to perform steps S211, S212 and S213 as shown in FIG. 14.

Figure 16:
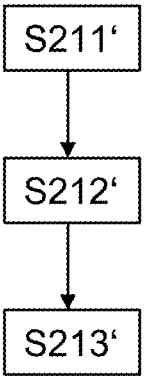
FIG. 16 is a flow chart of the further method for producing a closed seam using the other bending machine.
Figure 15A:
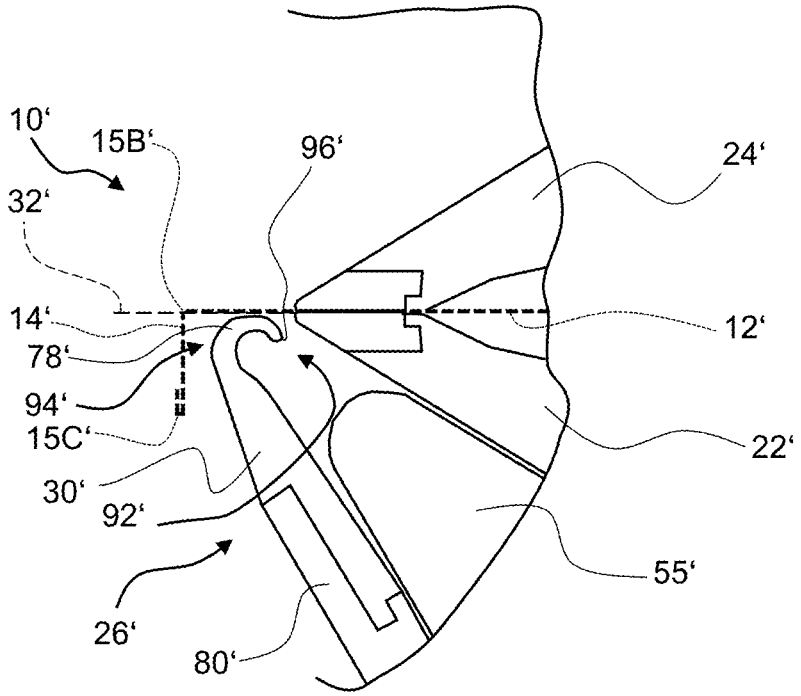
FIG. 15A is a schematic side view of a portion of the other bending machine in a first position of a further method for producing a closed seam.
Figure 15B:
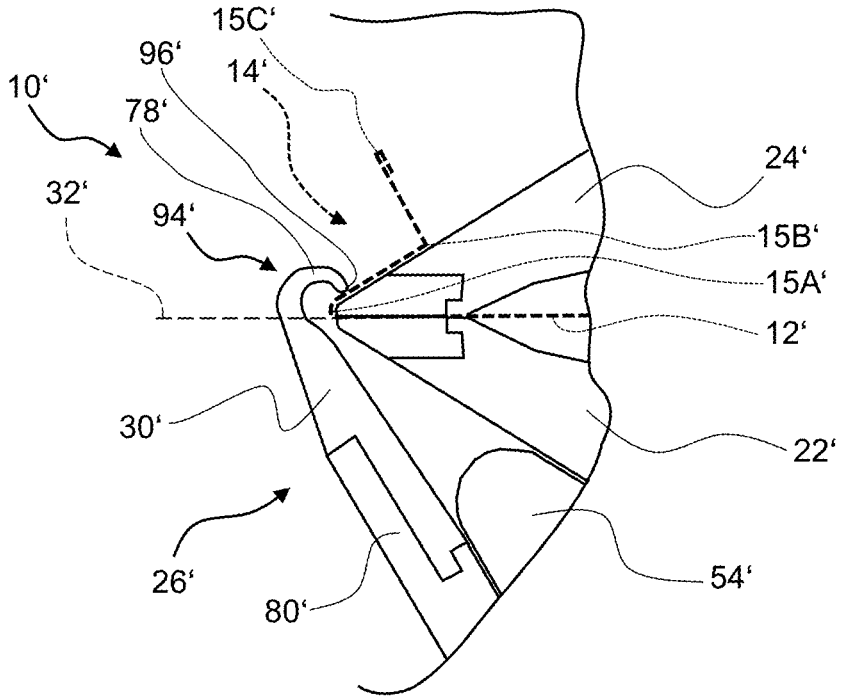
FIG. 15B is a schematic side view of a portion of the other bending machine in a second position of the further method for producing a closed seam.
Figure 15C:
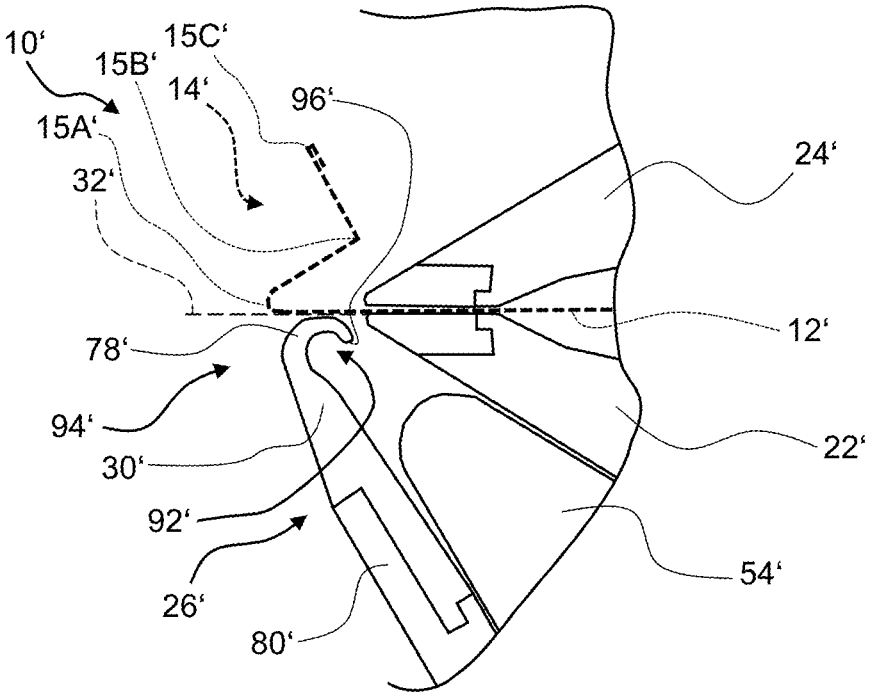
FIG. 15C is a schematic side view of a portion of the other bending machine in a third position of the further method for producing a closed seam.
Figure 15D:
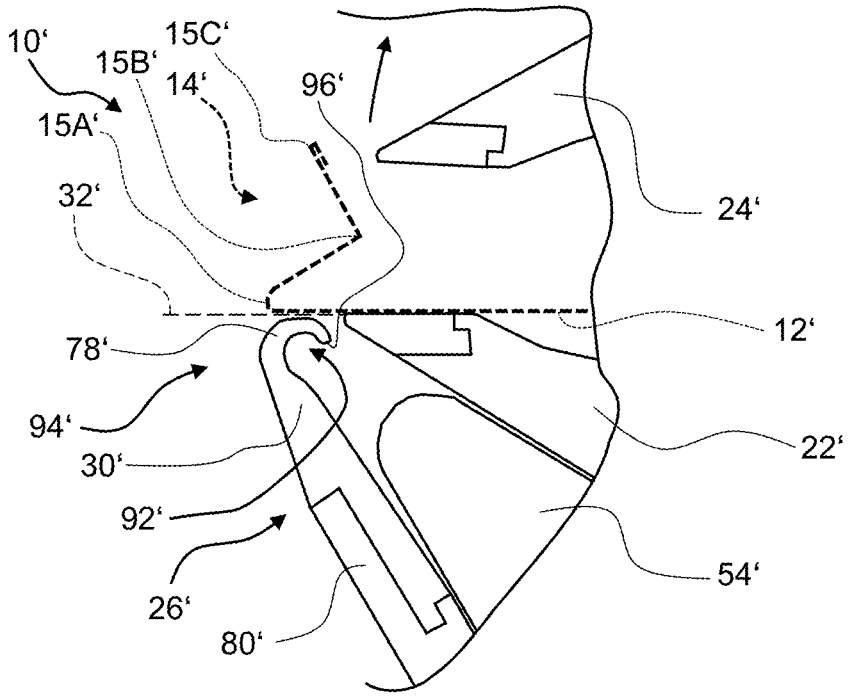
FIG. 15D is a schematic side view of a portion of the other bending machine in a fourth position of the further method for producing a closed seam.
Figure 15E:
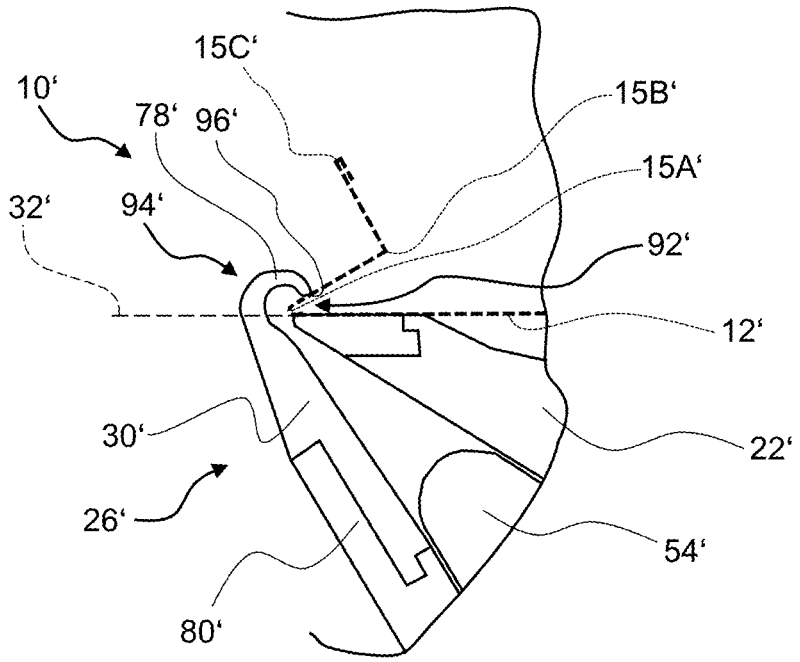
FIG. 15E is a schematic side view of a portion of the other bending machine in a fifth position of the further method for producing a closed seam.
Figure 15F:
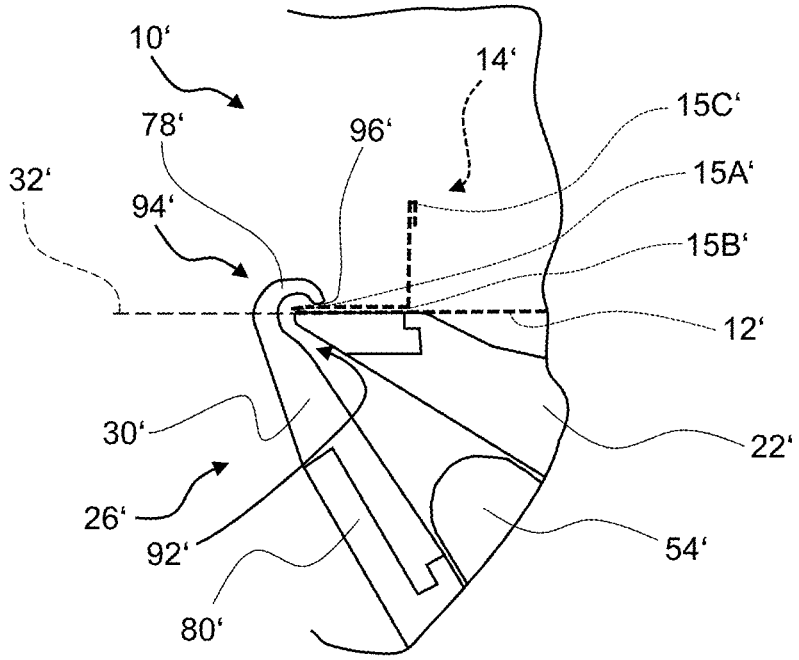
FIG. 15F is a schematic side view of a portion of the other bending machine in a sixth position of the further method for producing a closed seam.

FIG. 15A through FIG. 15F and FIG. 16 show a further method for producing a closed seam according to a first aspect with the bending machine 10' according to the invention, which is configured as a single bending machine. FIG. 15A is a schematic side view of a portion of the bending machine 10' in a first position of the further method for producing a closed seam; FIG. 15B is a schematic side view of a portion of the bending machine 10' in a second position of the further method for producing a closed seam, FIG. 15C is a schematic side view of a portion of the bending machine 10' in a third position of the further method for producing a closed seam, FIG. 15D is a schematic side view of a portion of the bending machine 10' in a fourth position of the further method for producing a closed seam, FIG. 15E is a schematic side view of a portion of the bending machine 10' in a fifth position of the further method for producing a closed seam, FIG. 15F is a schematic side view of a portion of the bending machine 10' in a sixth position of the further method for producing a closed seam, and FIG. 16 is a flow chart of the further method for producing a closed seam. Below, reference may be made to several of these figures at the same time.

The further method for producing a closed seam on a workpiece 12' with the bending machine 10' comprises a first step S211' of producing the pre-seam on the workpiece 12', comprising forming a first fold 15A', as shown in FIG. 15A and FIG. 15B, a second step S212' of moving the second clamping jaw 24' away from the workpiece 12', as shown in FIG. 15C and FIG. 15D, and a third step S213' of closing the pre-seam to form a seam by closing the first fold 15A' with the bending unit 26' in a state in which the second clamping jaw 24' is spaced from the workpiece 12', as shown in FIG. 15E and FIG. 15F.

The further method for producing a closed seam in steps S211' to S213' is an extended embodiment of the method for producing a closed seam in steps S211 to S213 as described above and may be used, for example, to manufacture a sheet of metal having a drip edge for eaves. Step S212' equals step S212, and step S213' equals step S213. Step S211' is based on step S211 but differs in the production of a pre-seam with a profile leg. The same or similar steps have the same reference signs as above although the reference signs of the alternative method steps have inverted commas for identification purposes. With regard to the description, reference can thus be made to the explanations above. Therefore, no further detailed description of these method steps is provided.

The first step S211' of producing the pre-seam with a profile leg on the workpiece 12', comprising forming a plurality of folds 15', with the bending machine 10' is performed in a plurality of bending processes by means of movements, in the present case displacements, of the bending tool 30' relative to the first clamping jaw 22'. Between the bending processes, the workpiece 12' is pushed forward to perform the bending processes at different positions on the workpiece 12'. The positioning unit (not shown) is particularly suitable for this purpose. However, other devices may be used or the workpiece may be pushed forward manually. To form a second fold 15B', the workpiece 12' is turned over accordingly. FIG. 15A and FIG. 15B show the last bending process of the plurality of bending processes of the first step S211' of producing the pre-seam on the workpiece 12'.

The first step S211' of producing the pre-seam with a profile leg comprises forming the second fold 15B' as a standing seam, the second fold 15B' being different from the first fold 15A'. The first step S211' further comprises forming a third fold 15C' as a U bend, the third fold 15C' being different from the first fold 15A' and the second fold 15B'. The profile leg is produced as a standing seam with a U bend by bending a portion of the workpiece 12' about the second fold 15B'. In the first step S211' of producing the pre-seam, the standing seam is bent about the first fold 15A' relative to a clamped portion of the workpiece 12'. In the third step S213' of closing the pre-seam, the standing seam protrudes from the first clamping jaw 22' in the direction of the spaced second clamping jaw 24', as shown in FIG. 15E and FIG. 15F. In the present case, therefore, the third fold 15C' is formed first, followed by the second fold 15B' and then the first fold 15A'.

For this further method for producing a closed seam, the control unit 82' of the bending machine 10' is further configured to perform steps S211', S212' and S213' as shown in FIG. 16.

Figure 18:
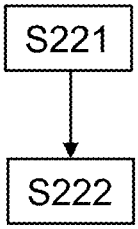
FIG. 18 is a flow chart of the method for producing an inclined seam using the other bending machine.
Figure 17A:
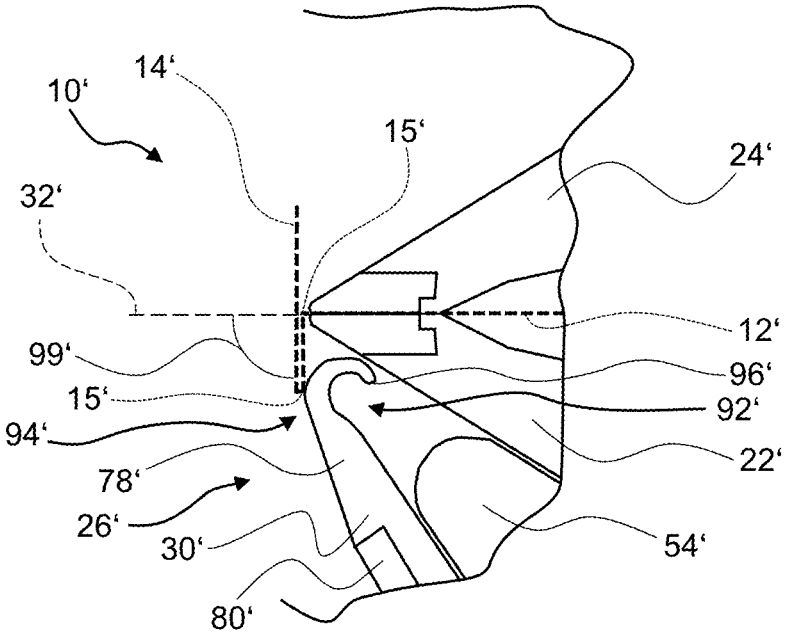
FIG. 17A is a schematic side view of a portion of the other bending machine in a first position of a method for producing an inclined seam.
Figure 17B:
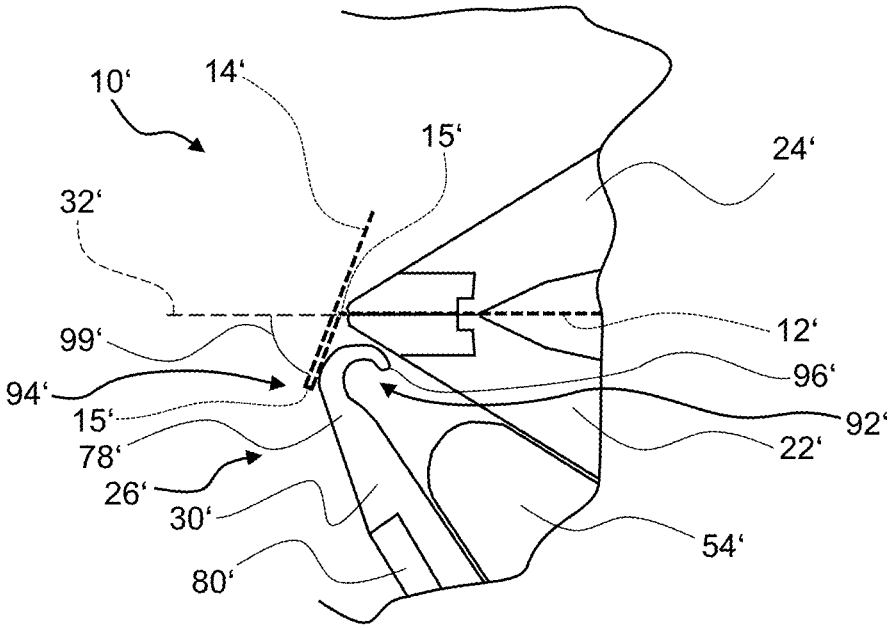
FIG. 17B is a schematic side view of a portion of the other bending machine in a second position of a method for producing an inclined seam.

FIG. 17A, FIG. 17B and FIG. 18 show a further method for producing an inclined seam according to the second aspect with the bending machine 10' according to the invention, which is configured as a single bending machine. FIG. 17A is a schematic side view of a portion of the bending machine 10' in a first position of a method for producing an inclined seam; FIG. 17B is a schematic side view of a portion of the bending machine 10' in a second position of the method for producing an inclined seam, and FIG. 18 is a flow chart of the method for producing an inclined seam. Below, reference may be made to both figures at the same time.

As shown in FIG. 17A, unlike in the previously described method for producing an inclined seam, the pre-seam is a profile leg bent to an opposite side. The further method for producing an inclined seam comprises a first step S221 of producing a pre-seam on a workpiece 12' such that it is located in an area in front of the clamping jaws 22', 24', comprising forming two folds 15' to a profile leg, wherein the pre-seam extends at an angle 99' relative to the clamping plane 32', as shown in FIG. 17A, and a second step S222 of changing the angle 99' by moving, in the present case displacing, the bending tool 30', as shown in FIG. 17B.

In the present case, step S221 of producing the pre-seam on the workpiece 12' is performed by controlling a bending operation of the bending machine 10' in which a pre-seam with a profile leg is produced. This involves repeated bending to form the two folds 15', for example about a bending axis 18' of the bending machine 10' at different locations on the workpiece 12', with the workpiece 12' being turned over accordingly. Bending is controlled by a control unit 82' of the bending machine 10'. Step S221 of producing the pre-seam on a workpiece 12' thus largely corresponds to the steps S11 and S211 described above.

As shown in FIG. 17B, step S222 of changing the angle 99' is performed by pressing with the outer surface 94' of the hook-shaped bending portion 78' as the bending tool 30' extends relative to the first clamping jaw 22'. In this case, the bending tool 30' is retracted with linear displacement relative to the base member 54' while the base member 54' together with the bending tool 30' is retracted with linear displacement relative to the first clamping jaw 22'. This displacement causes the bending tool 30' to extend relative to the first clamping jaw 22' for pressing with the outer surface 94' in such a way that preferably no sliding occurs between the workpiece 12' and the bending tool 30'. Sliding might result in the workpiece 12' being scratched.

The angle 99' is thus changed by pressing with the outer surface 94' of the hook-shaped bending portion 78'. Alternatively, the angle 99' might be changed in an opposite direction as the bending tool 30' retracts relative to the first clamping jaw 22'. In this case, the angle 99' would be changed by pressing with the inner surface 92' and the end portion 96' of the hook-shaped bending portion 78' as the bending tool 30' retracts relative to the first clamping jaw 22'.

The control unit 82' of the bending machine 10' is configured to perform steps S221 and S222 as shown in FIG. 18.

The method for producing an inclined seam comprising steps S221 and S222 may be performed in particular in combination with the method for producing a closed seam comprising steps S211, S212 and S213 according to the first aspect, in particular immediately before or immediately afterwards.

FIG. 19, FIG. 20A through FIG. 20F, FIG. 21, FIG. 22A through FIG. 22F, FIG. 23, FIG. 24A, FIG. 24B and FIG. 25 show an alternative embodiment of a bending machine 310 configured as a swivel bending machine. The bending machine 310 is configured as a single bending machine. Below, reference may be made to several of these figures at the same time.

Comprising a machine frame 320 and a carrier 380, the bending machine 310 is basically constructed in the same way as the bending machine 10' of the previous embodiment but comprises a bending unit 326 for swivel bending operations. The bending machine 310 thus comprises a first clamping jaw 322 to which the bending unit 326 configured for swivel bending is attached, and a second clamping jaw 324. Other than the previous embodiment, the bending unit 326 comprises a bending tool 330 that is slidable along the clamping jaw 322 as well as pivotable relative to the clamping jaw 322. The bending unit 326 may thus bend a protruding portion 314 of a workpiece 312 by swiveling the bending tool 330 about a bending axis 318 while the workpiece 312 is clamped in a clamping plane 332 by the first clamping jaw 322 and the second clamping jaw 324.

A swivel mechanism of the bending unit 326 is realized with multiple swivel joints and/or lifting cylinders. The swivel mechanism may, for example, be configured in accordance with the swivel bending machine disclosed in the publication EP 3 403 738 A1.

Figure 19:
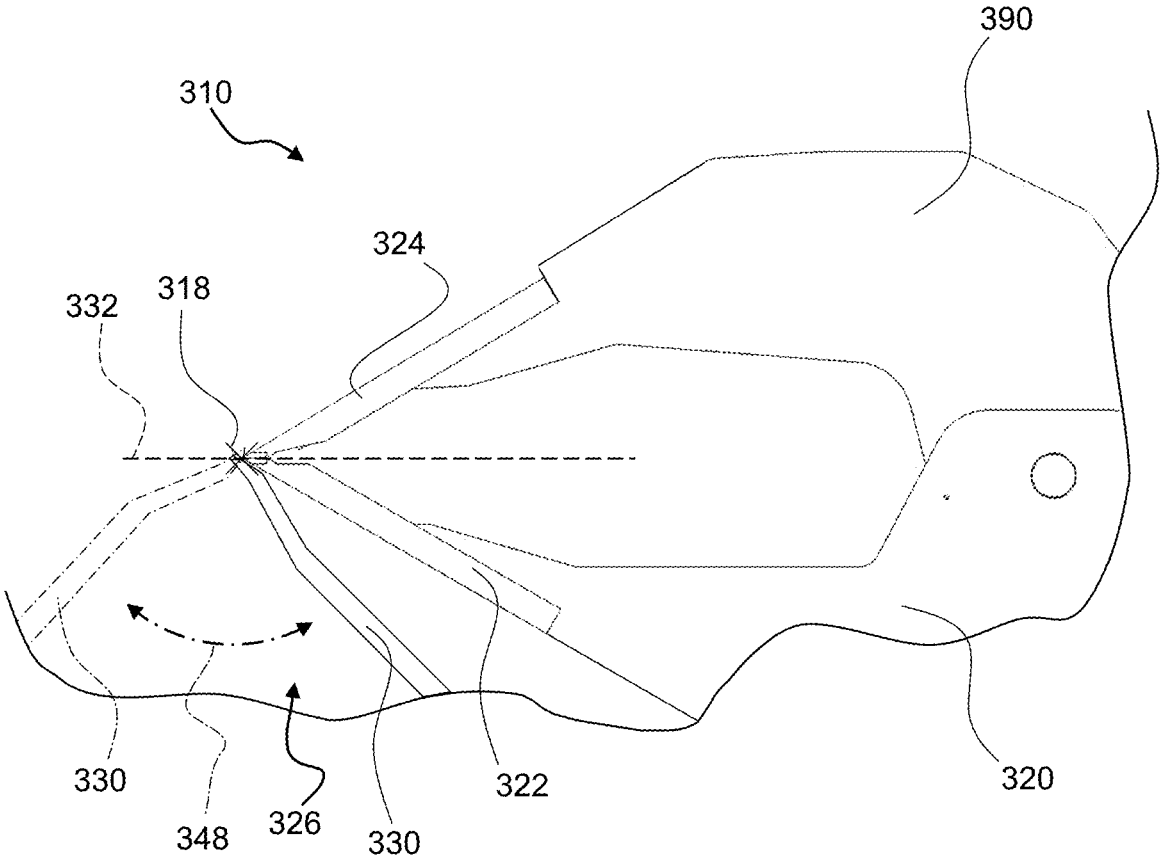
FIG. 19 is a schematic side view of a portion of a bending machine configured as a swivel bending machine and a single bending machine.

Alternatively, the swivel mechanism of the bending unit 326 may be configured in accordance with the swivel bending machine disclosed in the publication EP 2 014 381 A2 or DE 199 01 797 A1. Basically, any swivel mechanism may be used as long as it allows a swivel movement 348 of the bending tool 330 about the bending axis 118. Such a swivel movement 348 is indicated in FIG. 19 by an arrow and a swiveled-out position of the bending tool 330, shown as dash-dotted lines.

The bending tool 330 is swiveled relative to the first clamping jaw 322 by retracting and extending the bending unit 326 relative to the clamping jaw 322 and rotating the bending tool 330 about the bending axis 318 relative to the clamping jaw 322. In FIG. 19, FIG. 20A through FIG. 20F as well as FIG. 24A and FIG. 24B, the swivel mechanism is shown schematically. A structural design of the bending unit 326 is not specified further and can be taken from known swivel bending machines, such as those described in the aforementioned publications.

With regard to the description, reference can thus also be made to the explanations above, taking into account the differences described herein. In other words, the bending machine 310 has all the features of the bending machine 10' that do not belong to the bending unit 26' of the bending machine 10'. Therefore, no further detailed description of these features is provided. It is understood that the bending machine 310 may also be configured as a double bending machine. Such a bending machine configured as a double bending machine comprises an additional upper bending unit corresponding to the bending unit 326 and can perform the methods described below in the same manner.

Figure 21:
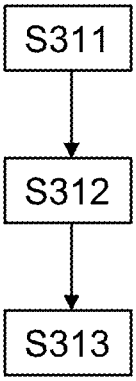
FIG. 21 is a flow chart of the method for producing a closed seam using the bending machine configured as a swivel bending machine.
Figure 20A:
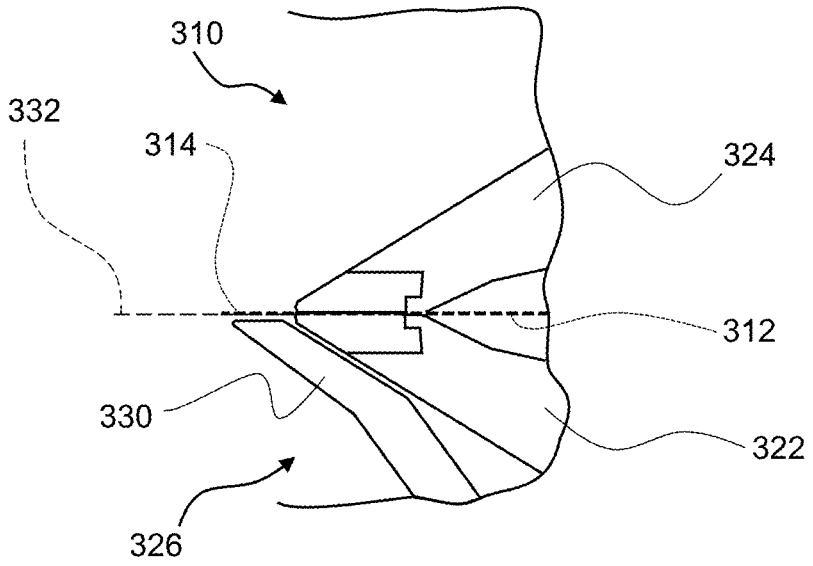
FIG. 20A is a schematic side view of a portion of the bending machine configured as a swivel bending machine in a first position of a method for producing a closed seam.
Figure 20B:
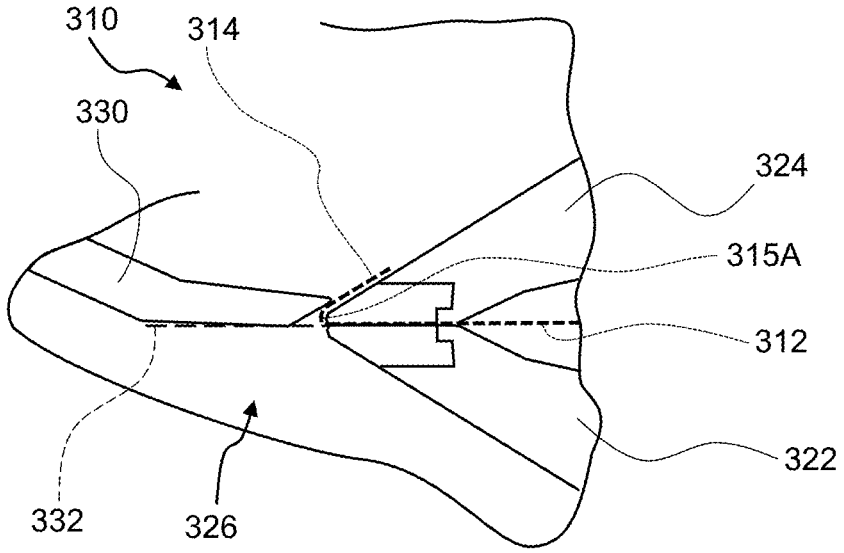
FIG. 20B is a schematic side view of a portion of the bending machine configured as a swivel bending machine in a second position of the method for producing a closed seam.
Figure 20C:
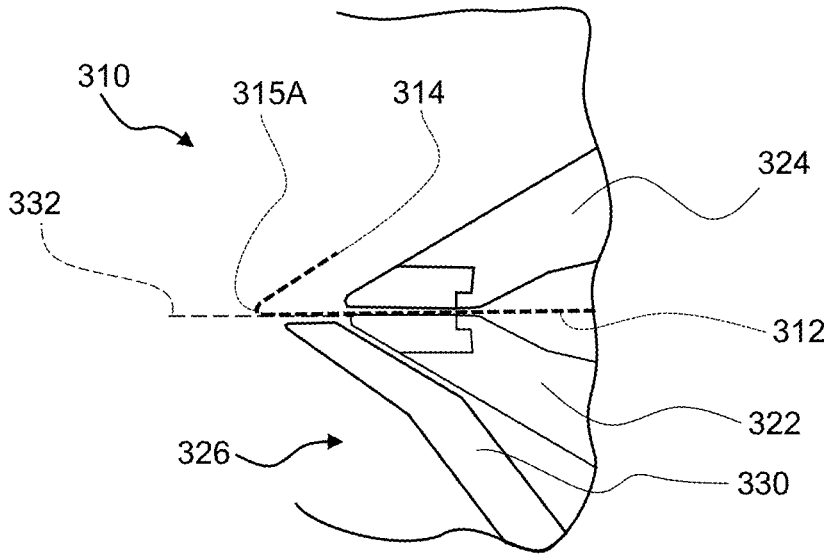
FIG. 20C is a schematic side view of a portion of the bending machine configured as a swivel bending machine in a third position of the method for producing a closed seam.
Figure 20D:
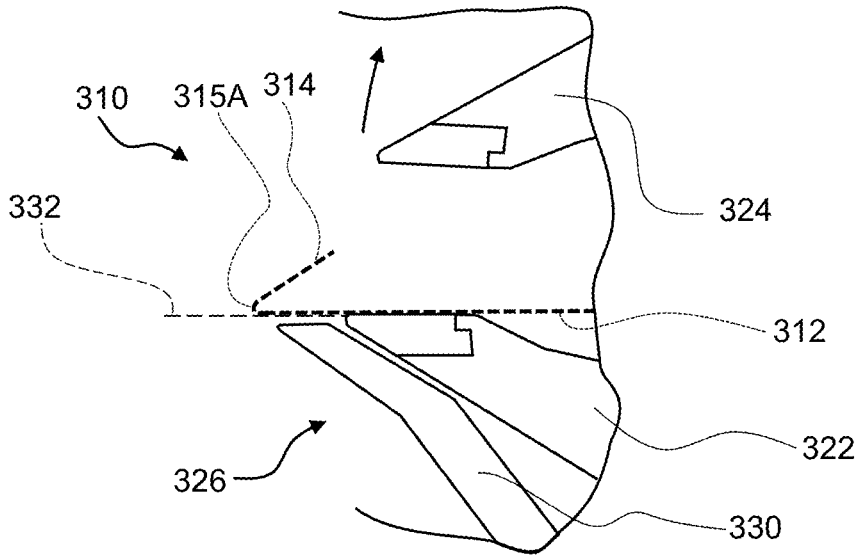
FIG. 20D is a schematic side view of a portion of the bending machine configured as a swivel bending machine in a fourth position of the method for producing a closed seam.
Figure 20E:
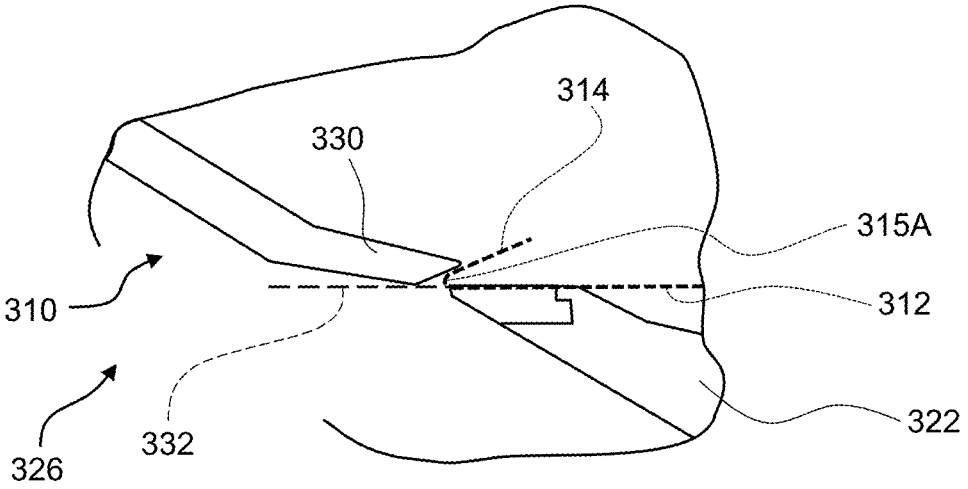
FIG. 20E is a schematic side view of a portion of the bending machine configured as a swivel bending machine in a fifth position of the method for producing a closed seam.
Figure 20F:
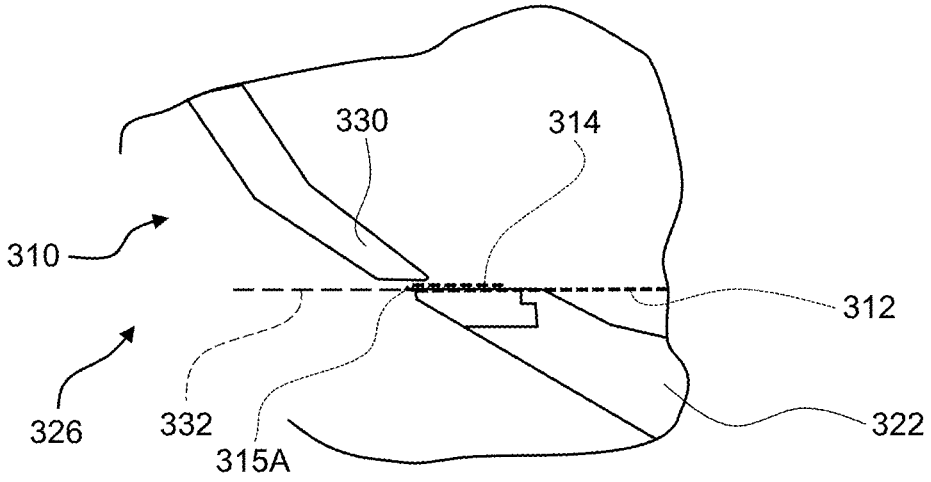
FIG. 20F is a schematic side view of a portion of the bending machine configured as a swivel bending machine in a sixth position of the method for producing a closed seam.

FIG. 20A through FIG. 20F show a further exemplary method for producing a closed seam according to the first aspect with the alternative bending machine 310 configured as a swivel bending machine. FIG. 20A is a schematic side view of a portion of the bending machine 310 configured as a swivel bending machine in a first position of the method for producing a closed seam; FIG. 20B is a schematic side view of a portion of the bending machine 310 configured as a swivel bending machine in a second position of the method for producing a closed seam, FIG. 20C is a schematic side view of a portion of the bending machine 310 configured as a swivel bending machine in a third position of the method for producing a closed seam, FIG. 20D is a schematic side view of a portion of the bending machine 310 configured as a swivel bending machine in a fourth position of the method for producing a closed seam, FIG. 20E is a schematic side view of a portion of the bending machine 310 configured as a swivel bending machine in a fifth position of the method for producing a closed seam, FIG. 20F is a schematic side view of a portion of the bending machine 310 configured as a swivel bending machine in a sixth position of the method for producing a closed seam, and FIG. 21 is a flow chart of the method for producing a closed seam. Below, reference may be made to several of these figures at the same time.

The further method for producing a closed seam with the alternative bending machine 310 comprises a first step S311 of producing the pre-seam on the workpiece 312, comprising forming a first fold 315A, as shown in FIG. 20A and FIG. 20B, a second step S312 of moving the second clamping jaw 324 away from the workpiece 312, as shown in FIG. 20C and FIG. 20D, and a third step S313 of closing the pre-seam to form a closed seam by closing the first fold 315A to form a U bend with the bending unit 326 in a state in which the second clamping jaw 324 is spaced from the workpiece 312, as shown in FIG. 20E and FIG. 20F.

As shown in FIG. 20C and FIG. 20D, the second step S312 of moving the second clamping jaw 324 away from the workpiece 312 is performed by pushing the workpiece 312 forward and backward and by swiveling the second clamping jaw 324. Meanwhile, the bending tool 330 is swiveled back and thus retracted. As a result, the workpiece 312 may be pushed forward to move the second clamping jaw 324 away from the workpiece 312, and then pushed back again. This may be done as previously described in step S12.

As shown in FIG. 20E, the third step S313 of closing the pre-seam is performed in a state in which the workpiece 312 rests on the first clamping jaw 322, the second clamping jaw 324 having moved away. The workpiece 312 thus lies in the clamping plane 332 in a state in which it is not clamped. In the present case, closing is effected by pressing the bending tool 330 against the protruding portion 314, which forms the pre-seam, as the bending tool 330 swivels out relative to the second clamping jaw 322. Optionally, the bending tool may be swiveled out toward the second clamping jaw 322 with a movement perpendicular to the clamping plane 332. This optional movement perpendicular to the clamping plane 332 may be performed, for example, with simultaneous linear retraction of the bending tool 330 or by means of a swivel joint configured for this purpose, and allows the pre-seam to be closed, similarly to the bending machines 10, 10' described above. In the course of the swivel movement 348 and, if applicable, the further optional movement, the bending tool 330 further bends the protruding portion 314 by pressing against it in such a way that, as shown in FIG. 20F, the first fold 315A of the seam is completely closed to form a U bend.

A control unit of the bending machine 310 is configured to perform steps S311, S312 and S313 as shown in FIG. 21.

Figure 23:
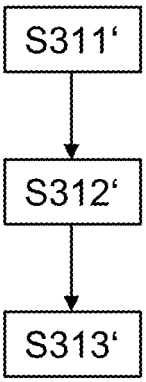
FIG. 23 is a flow chart of the further method for producing a closed seam.
Figure 22A:
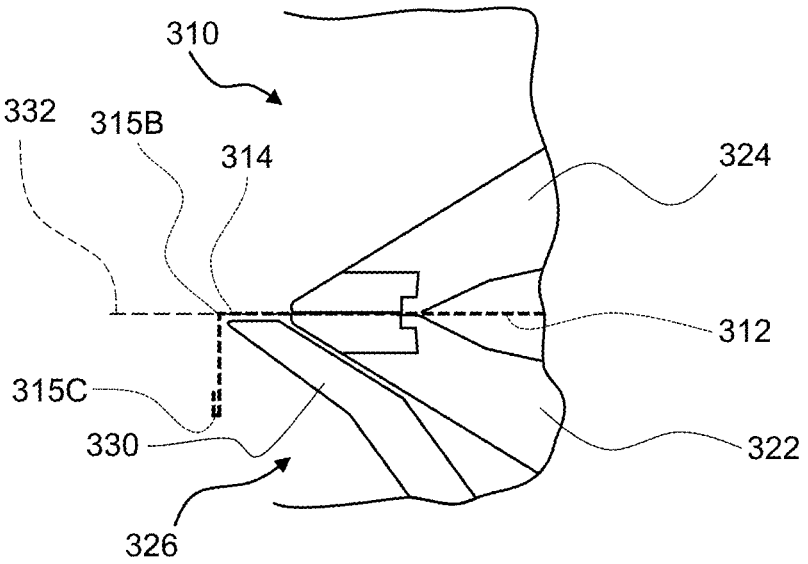
FIG. 22A is a schematic side view of a portion of the bending machine configured as a swivel bending machine in a first position of a further method for producing a closed seam.
Figure 22B:
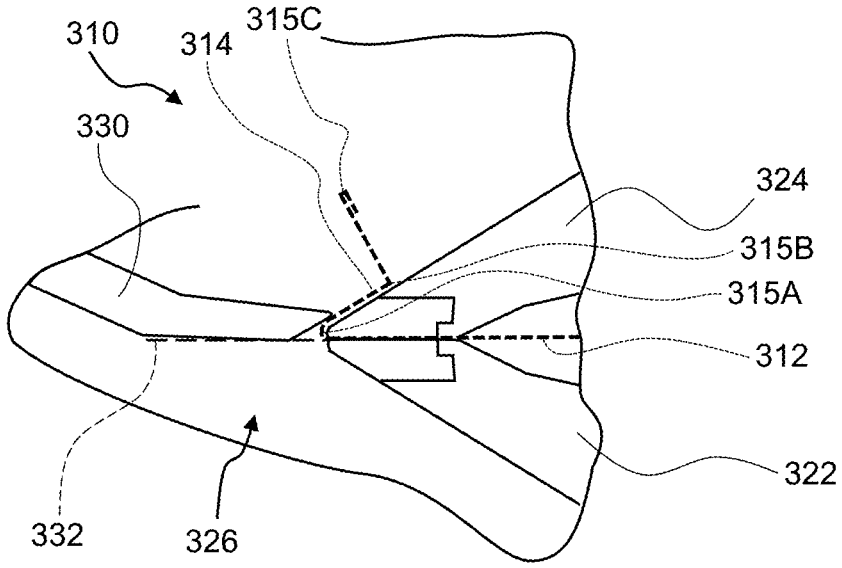
FIG. 22B is a schematic side view of a portion of the bending machine configured as a swivel bending machine in a second position of the further method for producing a closed seam.
Figure 22C:
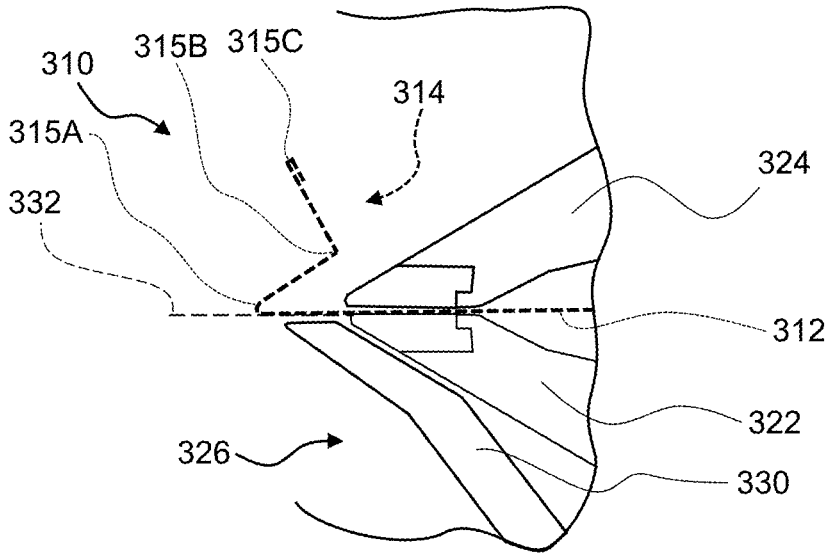
FIG. 22C is a schematic side view of a portion of the bending machine configured as a swivel bending machine in a third position of the further method for producing a closed seam.
Figure 22D:
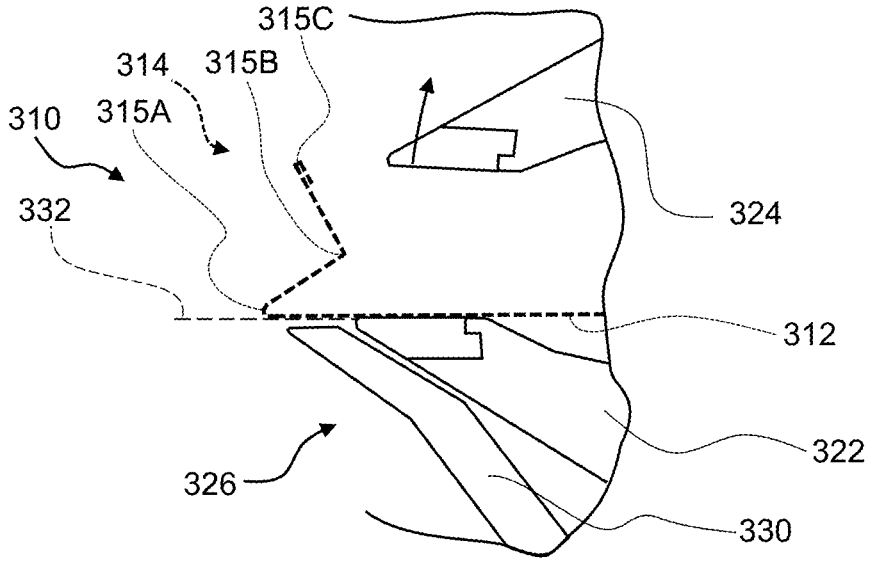
FIG. 22D is a schematic side view of a portion of the bending machine configured as a swivel bending machine in a fourth position of the further method for producing a closed seam.
Figure 22E:
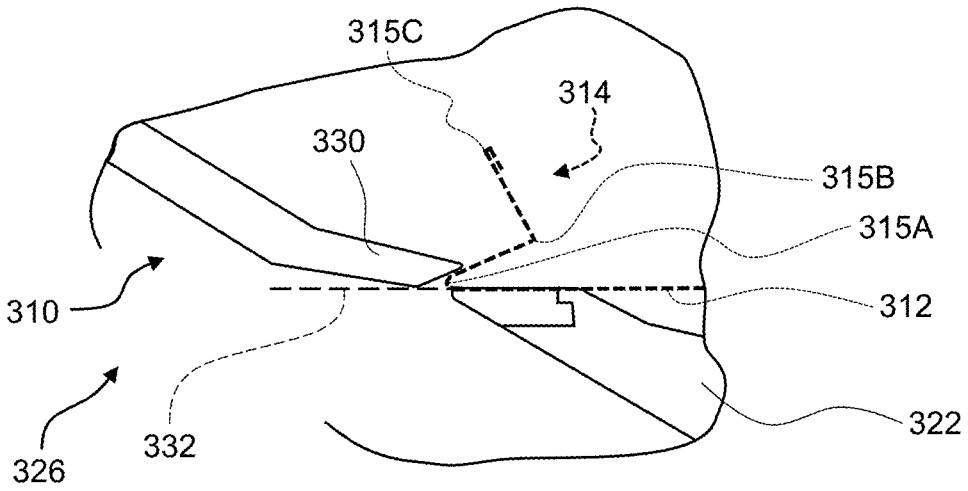
FIG. 22E is a schematic side view of a portion of the bending machine configured as a swivel bending machine in a fifth position of the further method for producing a closed seam.
Figure 22F:
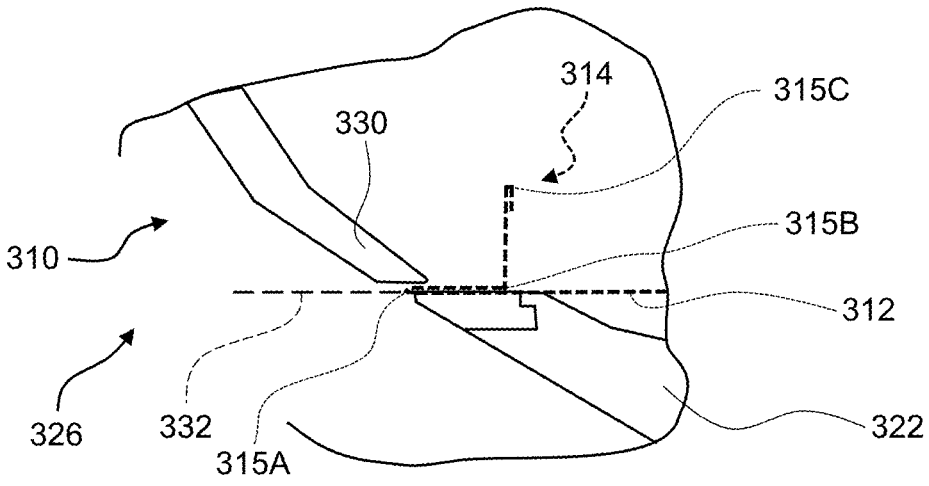
FIG. 22F is a schematic side view of a portion of the bending machine configured as a swivel bending machine in a sixth position of the further method for producing a closed seam.

FIG. 22A through FIG. 22F and FIG. 23 show a further method for producing a closed seam according to a first aspect with the bending machine 310 according to the invention, which is configured as a swivel bending machine. FIG. 22A is a schematic side view of a portion of the bending machine 310 in a first position of the method for producing a closed seam; FIG. 22B is a schematic side view of a portion of the bending machine 310 in a second position of the method for producing a closed seam, FIG. 22C is a schematic side view of a portion of the bending machine 310 in a third position of the method for producing a closed seam, FIG. 22D is a schematic side view of a portion of the bending machine 310 in a fourth position of the method for producing a closed seam, FIG. 22E is a schematic side view of a portion of the bending machine 310 in a fifth position of the method for producing a closed seam, FIG. 22F is a schematic side view of a portion of the bending machine 310 in a sixth position of the method for producing a closed seam, and FIG. 23 is a flow chart of the method for producing a closed seam. Below, reference may be made to several of these figures at the same time.

The further method for producing a closed seam on a workpiece 312 with the bending machine 310 comprises a first step S311' of producing the pre-seam on the workpiece 312, comprising forming a first fold 315A, as shown in FIG. 22A and FIG. 22B, a second step S312' of moving the second clamping jaw 324 away from the workpiece 312, as shown in FIG. 22C and FIG. 22D, and a third step S313' of closing the pre-seam to form a seam by closing the first fold 315A with the bending unit 328 in a state in which the second clamping jaw 324 is spaced from the workpiece 312, as shown in FIG. 22E and FIG. 22F.

The further method for producing a closed seam in steps S311' to S313' is an extended embodiment of the method for producing a closed seam in steps S311 to S313 as described above and may be used, for example, to manufacture a sheet of metal having a drip edge for eaves. Step S312' equals step S312, and step S313' equals step S313. Step S311' is based on step S311 but differs in the production of a pre-seam with a profile leg. The same or similar steps have the same reference signs as above although the reference signs of the alternative method steps have inverted commas for identification purposes. With regard to the description, reference can thus be made to the explanations above. Therefore, no further detailed description of these method steps is provided.

The first step S311' of producing the pre-seam with a profile leg on the workpiece 312, comprising forming a plurality of folds 315, with the bending machine 310 is partially performed in a plurality of bending processes by means of movements, in the present case swivel movements, of the bending tool 330 relative to the first clamping jaw 322. Between the bending processes, the workpiece 312 is pushed forward to perform the bending processes at different positions on the workpiece 312. The positioning unit (not shown) is particularly suitable for this purpose. However, other devices may be used or the workpiece may be pushed forward manually. To form a second fold 315B, the workpiece 312 is turned over accordingly. FIG. 22A and FIG. 22B show the last bending process of the plurality of bending processes of the first step S311' of producing the pre-seam on the workpiece 312 by forming the first fold 315A.

The first step S311' of producing the pre-seam with a profile leg comprises forming the second fold 315B as a standing seam, the second fold 315B being different from the first fold 315A. The first step S311' further comprises forming a third fold 315C as a U bend, the third fold 315C being different from the first fold 315A and the second fold 315B. The profile leg is produced as a standing seam with a U bend by bending a portion of the workpiece 312 about the second fold 315B. In the first step S311' of producing the pre-seam, the standing seam is bent about the first fold 315A relative to a clamped portion of the workpiece 312. In the third step S313' of closing the pre-seam, the standing seam protrudes from the first clamping jaw 322 in the direction of the spaced second clamping jaw 324, as shown in FIG. 22E and FIG. 22F. In the present case, therefore, the third fold 315C is formed first, followed by the second fold 315B and then the first fold 315A.

For this further method for producing a closed seam, the control unit of the bending machine 310 is further configured to perform steps S311', S312' and S313' as shown in FIG. 23.

Figure 25:
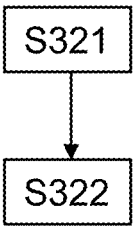
FIG. 25 is a flow chart of the method for producing an inclined seam using the bending machine configured as a swivel bending machine.
Figure 24A:
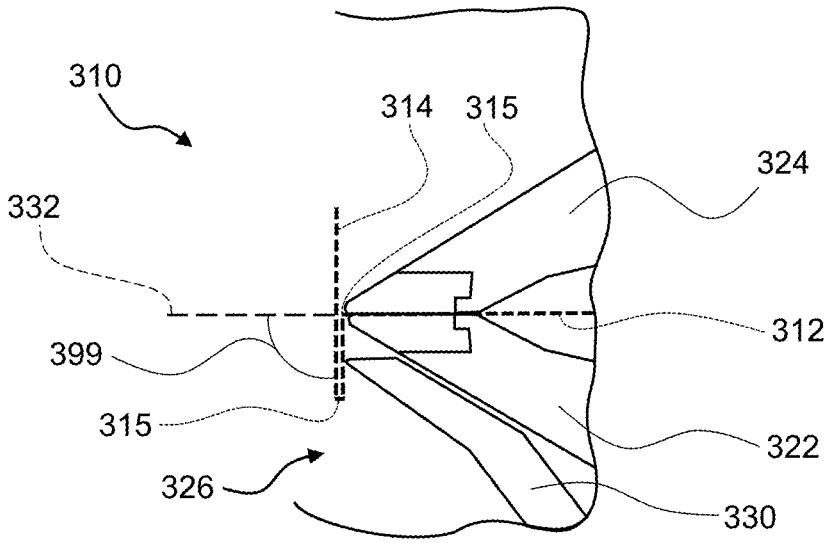
FIG. 24A is a schematic side view of a portion of a bending machine configured as a swivel bending machine in a first position of a method for producing an inclined seam.
Figure 24B:
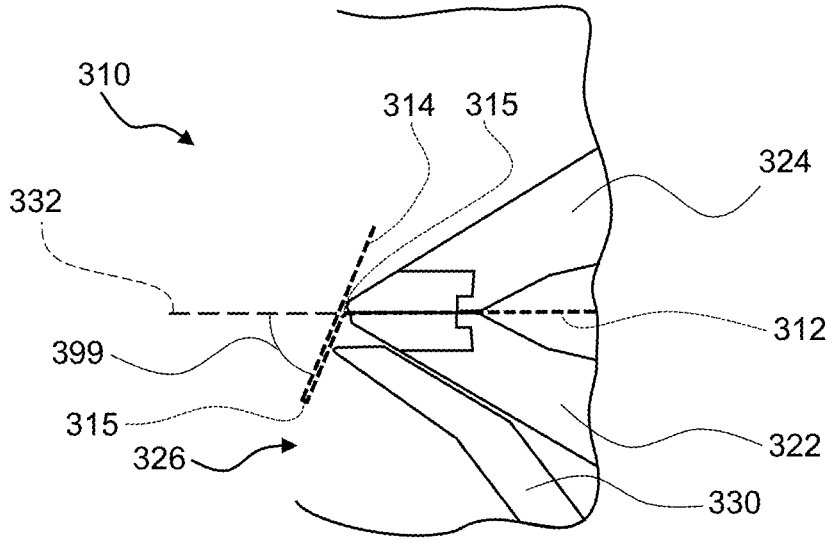
FIG. 24B is a schematic side view of a portion of a bending machine configured as a swivel bending machine in a second position of a method for producing an inclined seam.

FIG. 24A, FIG. 24B and FIG. 25 show a further method for producing an inclined seam according to the second aspect with the bending machine 310, which is configured as a swivel bending machine and a single bending machine. FIG. 24A is a schematic side view of a portion of the bending machine 310 in a first position of a method for producing an inclined seam; FIG. 24B is a schematic side view of a portion of the bending machine 310 in a second position of the method for producing an inclined seam, and FIG. 25 is a flow chart of the method for producing an inclined seam. Below, reference may be made to several of these figures at the same time.

The method for producing an inclined seam comprises a first step S321 of producing a pre-seam on the workpiece 312 such that it is located in an area in front of the clamping jaws 322, 324, comprising forming two folds 315, wherein the pre-seam extends at an angle 399 relative to the clamping plane 332, and a second step S322 of changing the angle 399 by displacing the bending tool 330.

In the present case, step S321 of producing the pre-seam on the workpiece 312 is performed by controlling a bending operation of the bending machine 310 in which a pre-seam with two folds 315 is produced. This involves a bending operation according to conventional swivel bending where the workpiece 312 is turned over accordingly. As shown in FIG. 24A, in the present example, the protruding portion 314 is formed by two folds 315 to form a pre-seam with a profile leg.

As shown in FIG. 24B, step S322 of changing the angle 399 is performed by pressing with the bending tool 330 as the bending tool 330 extends relative to the first clamping jaw 322. Optionally, the bending tool 330 may additionally be swiveled relative to the clamping jaw 322 as in a swivel bending process.

The control unit (not shown) of the bending machine 310 is configured to perform steps S321 and S322 as shown in FIG. 25.

The method for producing an inclined seam comprising steps S321 and S322 may be performed in particular in combination with the method for producing a closed seam comprising steps S311, S312 and S313 according to the first aspect, in particular immediately before or immediately afterwards.

Figure 26:
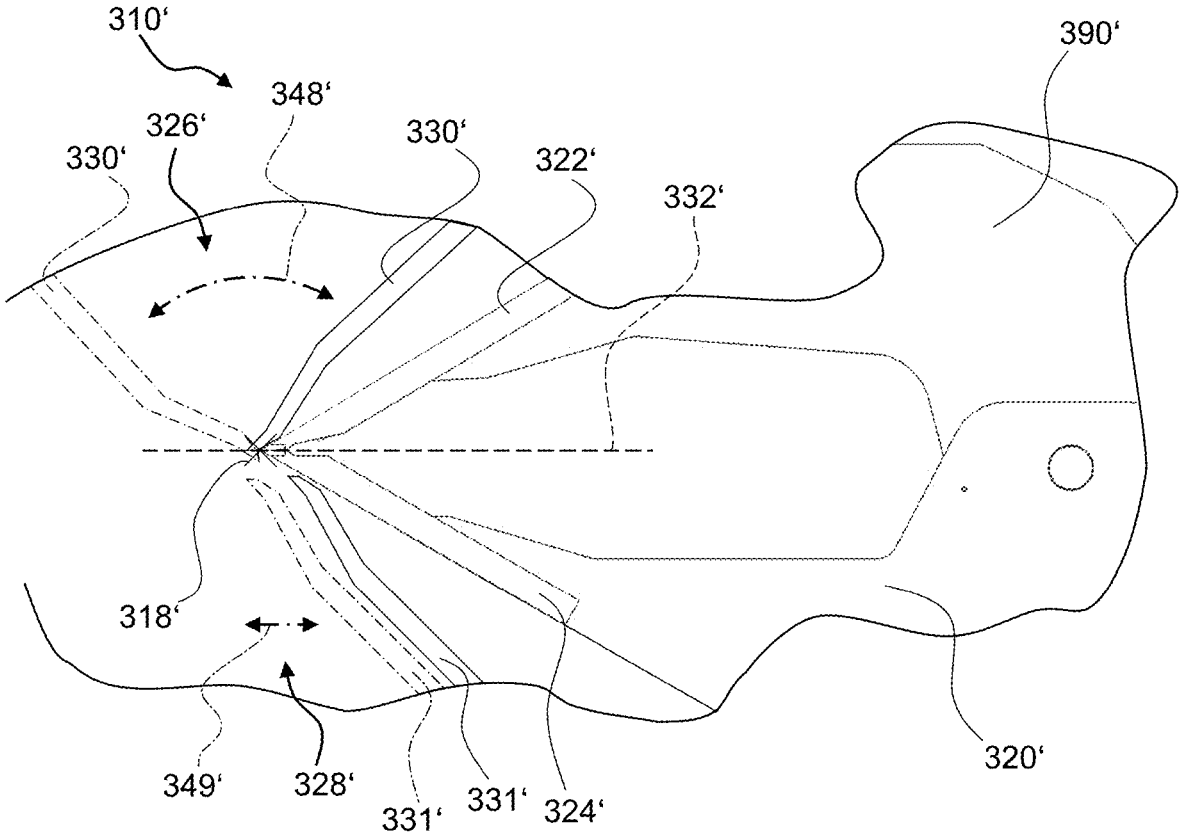
FIG. 26 is a schematic side view of a portion of a bending machine configured as a swivel bending machine and a double bending machine.
Figure 27A:
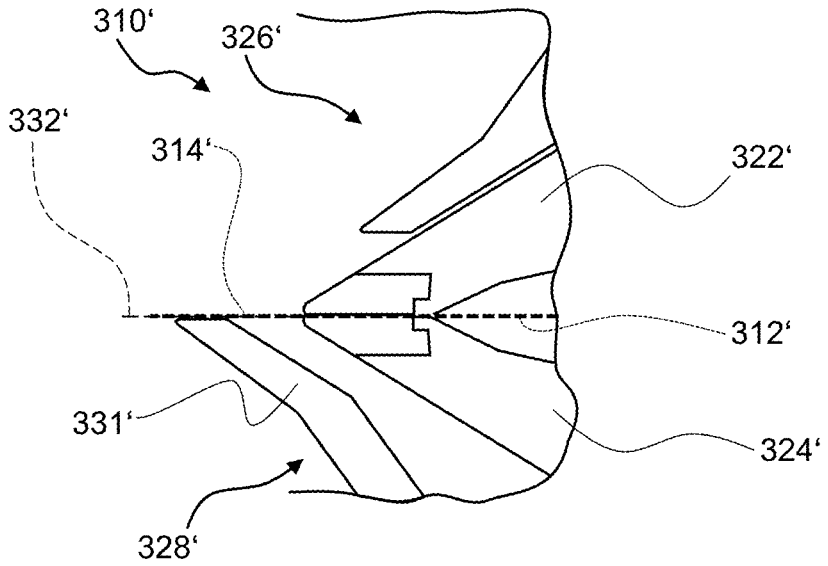
FIG. 27A is a schematic side view of a portion of the bending machine configured as a swivel bending machine and a double bending machine in a first position of a method for producing a recess.
Figure 27B:
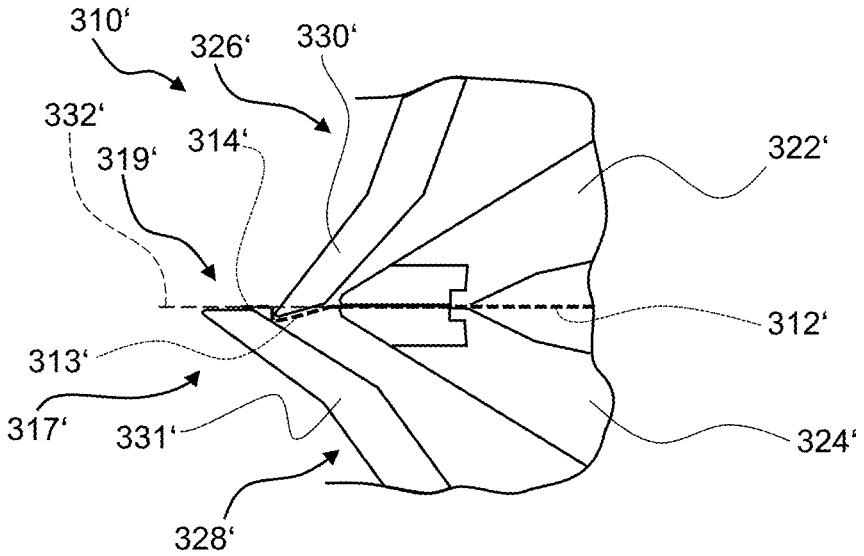
FIG. 27B is a schematic side view of a portion of the bending machine configured as a swivel bending machine and a double bending machine in a second position of the method for producing a recess.

FIG. 26, FIG. 27A and FIG. 27B show an alternative embodiment of a bending machine 310' configured as a swivel bending machine. The bending machine 310' is configured as a double bending machine. Below, reference may be made to several of these figures at the same time.

The bending machine 310' is basically constructed in the same way as the bending machine 310 of the previous embodiment but comprises a further bending unit 326' for swivel bending operations. Similar components have the same reference signs as above although the reference signs of the alternative embodiment have inverted commas for identification purposes.

For better understanding, the bending units 326', 328' are referred to as the first bending unit 326' and the second bending unit 328'. The bending machine 310' thus comprises a first clamping jaw 322' to which the first bending unit 326' configured for swivel bending and including a first bending tool 330' is attached, and a second clamping jaw 324 to which the second bending unit 328' configured for swivel bending and including a second bending tool 331' is attached. Here, the first clamping jaw 322' is the upper clamping jaw, and the second clamping jaw 324' is the lower clamping jaw, which can clamp a workpiece 312' in a clamping plane 332'. The first and second bending units 326', 328' are thus configured to bend a portion of the workpiece 312' by moving, in the present case swiveling, the bending tools 330', 331' relative to the associated clamping jaw 322', 344' to form a fold 315'.

Both the first bending tool 330' and the second bending tool 331' are each movable relative to the clamping jaws 322', 324', in particular each can be swiveled about the bending axis 318'. A swivel movement 348' of the first bending tool 330' is indicated by an arrow and a bending tool 330' arranged in a swiveled-out position, shown as dash-dotted lines.

In addition to the further bending unit, the bending machine 310' comprises a modified lower bending unit. This second bending unit 328' is configured to move the bending tool 331' along the clamping plane 332'. Such a movement 349' may take place in addition to the swivel movement and is indicated by an arrow and a bending tool 331' moved in a position spaced from the clamping jaw 324', shown as dash-dotted lines.

With regard to the description, reference can thus also be made to the explanations above, taking into account the differences described herein. In other words, the bending machine 310' has all the features of the bending machine 310, but with a further bending unit and an additional movement mechanism of the lower bending unit. Therefore, no further detailed description of these features is provided.

Figure 28:
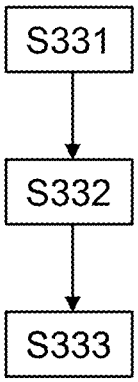
FIG. 28 is a flow chart of the method for producing a recess using the bending machine configured as a swivel bending machine and a double bending machine.

FIG. 27A, FIG. 27B and FIG. 28 show a further exemplary method for producing a recess according to the third aspect with the bending machine 310', which is configured as a swivel bending machine and a double bending machine. FIG. 27A is a schematic side view of a portion of the bending machine 310' configured as a swivel bending machine and a double bending machine in a first position of a method for producing a recess; FIG. 27B is a schematic side view of a portion of the bending machine 310' configured as a swivel bending machine and a double bending machine in a second position of the method for producing a recess, and FIG. 28 is a flow chart of the method for producing a recess with a bending machine 310' configured as a swivel bending machine and a double bending machine. Below, reference may be made to several of these figures at the same time.

The method for producing a recess comprises a first step S331 of clamping the workpiece 312' with the first clamping jaw 322' and the second clamping jaw 324' such that a protruding portion 314' of the workpiece 312' protrudes from the clamping jaws 322', 324', and a second step S332 of displacing the second bending tool 331' into a counter-action position as shown in FIG. 27A such that it rests against the protruding portion 314' of the workpiece 312' at a distance from the clamping jaw 324', and a third step S333 of extending the first bending tool 330' such that it presses against the workpiece 312' so that a recess 313' is formed in the workpiece 312' as shown in FIG. 27B.

In the first step S331 of clamping the workpiece 312', the workpiece 312' is clamped in the clamping plane 332'. As shown in FIG. 27A, the workpiece 312' is clamped between the first clamping jaw 322' and the second clamping jaw 324' such that the workpiece 312' is fixed.

In the second step S332 of moving, the second bending tool 331' rests against a first side 317' of the workpiece 312' as shown in FIG. 27A, and in the third step S333 of extending the first bending tool 330', the first bending tool 330' presses against the workpiece 312' on a second side 319' of the workpiece 312' opposite the first side 317' such that the recess 313' is formed in the workpiece 312' as shown in FIG. 27B. As a result of the movement 349', the second bending tool 331' rests against the protruding portion 314' of the workpiece 312' at a distance.

The control unit 82 of the bending machine 10 is configured to perform steps S331 to S333 as shown in FIG. 28.

The method for producing a recess comprising steps S331, S332 and S333 may be performed in particular in combination with the method of the first aspect or the method of the second aspect, in particular before and/or afterwards in each case. However, a combination of all three methods in any order is also possible.

LIST OF REFERENCE SIGNS

10 Bending machine
12 Workpiece
13 Recess
14 Protruding portion
15 Fold
16 Clamped portion
17 First side
18 Bending axis
19 Second side
20 Machine frame
22 First clamping jaw
24 Second clamping jaw
26 (First) bending unit
28 Second bending unit
30 (First) bending tool
31 Second bending tool
32 Clamping plane
34 Linear guide
36 Linear guide
38 Linear guide
40 Linear guide
42 Linear guide
44 Linear guide
46 Linear guide
48 Advance plane
50 Drive
52 Drive
54 (First) base member
55 Second base member
56 Linear guide
58 Linear guide
60 Linear guide
62 Linear guide
64 Advance plane
66 Drive
68 Drive
78 Hook-shaped bending portion
80 (First) bending tool carrier
81 Second bending tool carrier
82 Control unit
88 Table
90 Carrier
92 Inner surface
94 Outer surface
96 End portion
98 Vertical direction
99 Angle
100 Longitudinal direction
102 Transverse direction
206 Positioning unit
216 User interface
310 Bending machine
312 Workpiece
314 Protruding portion
315 Fold
317 First side
318 Bending axis
319 Second side
320 Machine frame
322 First clamping jaw

324 Second clamping jaw
326 (First) bending unit
328 Second bending unit
330 (First) bending tool
331 Second bending tool
332 Clamping plane
348 Swivel movement
349 Movement
390 Carrier
399 Angle

The invention claimed is:

1. A method for producing a recess in a workpiece made of flat material using a bending machine, the bending machine comprising:

a first clamping jaw;

a second clamping jaw that is mounted movably relative to the first clamping jaw and configured to clamp, together with the first clamping jaw, the workpiece;

a first bending unit that is arranged on the first clamping jaw and has a first bending tool, the first bending unit being configured to bend a portion of the workpiece by moving the first bending tool relative to the first clamping jaw to form a fold; and a second bending unit that is arranged on the second clamping jaw and has a second bending tool, the second bending unit being configured to bend a portion of the workpiece by moving the second bending tool relative to the second clamping jaw;

the method comprising:

clamping the workpiece with the first clamping jaw and the second clamping jaw such that a protruding portion of the workpiece protrudes from the clamping jaws;

moving one of the two bending tools into a counteraction position such that it rests against the protruding portion of the workpiece at a distance from the clamping jaws; and extending the other bending tool such that it presses against the workpiece so that the recess is formed in the workpiece.

2. The method of claim 1, wherein, in the step of moving, the one bending tool rests against a first side of the workpiece, and wherein, in the step of extending, the other bending tool presses against the workpiece on a second side of the workpiece opposite the first side such that the recess is formed in the workpiece.

3. The method of claim 1, wherein, in the step of clamping, the workpiece is clamped in a clamping plane, and wherein, in the step of moving, one of the two bending tools rests against the protruding portion of the workpiece at a distance along the clamping plane.

4. The method of claim 1, wherein at least the other bending tool comprises a hook-shaped bending portion having an inner surface and an outer surface, and wherein, in the step of extending the other bending tool, the outer surface thereof presses against the workpiece on the second side of the workpiece such that the recess is formed in the workpiece.

5. The method of claim 1, wherein at least the one bending tool comprises a hook-shaped bending portion having an inner surface and an outer surface, and wherein, in the step of extending, the one bending tool, in the counteraction position, rests with its outer surface against the protruding portion of the workpiece on the first side of the workpiece.

6. The method of claim 1, wherein the bending machine comprises a long folding machine.

7. The method of claim 1, wherein the recess comprises a reverse bend or bead.

8. The method of claim 1, wherein the flat material comprises sheet metal.

9. A bending machine for producing a recess in a workpiece made of flat material, the bending machine comprising:

a first clamping jaw;

a second clamping jaw that is mounted movably relative to the first clamping jaw and configured to clamp, together with the first clamping jaw, the workpiece;

a first bending unit that is arranged on the first clamping jaw and has a first bending tool, the first bending unit being configured to bend a portion of the workpiece by moving the first bending tool relative to the first clamping jaw to form a fold;

a second bending unit that is arranged on the second clamping jaw and has a second bending tool, the second bending unit being configured to bend a portion of the workpiece by moving the second bending tool relative to the second clamping jaw; and a control unit that is configured to:

clamp the workpiece with the first clamping jaw and the second clamping jaw such that a protruding portion of the workpiece protrudes from the clamping jaws;

move one of the two bending tools into a counteraction position such that it rests against the protruding portion of the workpiece at a distance from the clamping jaws; and extend the other bending tool such that it presses against the workpiece so that the recess is formed in the workpiece.

10. The bending machine of claim 9, wherein at least the other bending tool comprises a hook-shaped bending portion having an inner surface and an outer surface.

11. The bending machine of claim 9, wherein at least the one bending tool comprises a hook-shaped bending portion having an inner surface and an outer surface, and wherein the control unit is further configured to place, in the step of displacing, the one bending tool in the counteraction position against the protruding portion of the workpiece on the first side of the workpiece with its outer surface.

12. The bending machine of claim 9, wherein the bending machine comprises a long folding machine.

13. The bending machine of claim 9, wherein the recess comprises a reverse bend or bead.

14. The bending machine of claim 9, wherein the flat material comprises sheet metal.

* * * * *